US007839063B2

(12) United States Patent
Matsuo et al.

(10) Patent No.: US 7,839,063 B2
(45) Date of Patent: Nov. 23, 2010

(54) DISPLAY PANEL AND DISPLAY DEVICE HAVING COLOR FILTER ELEMENTS WITH COLOR FILTER PROTECTIVE LAYER

(75) Inventors: Akemi Matsuo, Gifu (JP); Kunio Goto, Aichi (JP); Yasushi Ito, Gifu (JP); Shinjiro Kida, Kanagawa (JP); Takahide Ishii, Gifu (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/020,467

(22) Filed: Dec. 22, 2004
(Under 37 CFR 1.47)

(65) Prior Publication Data

US 2005/0258728 A1 Nov. 24, 2005

(30) Foreign Application Priority Data

Dec. 26, 2003 (JP) ..... 2003-434348

(51) Int. Cl.
*H01J 63/04* (2006.01)
*H01J 1/62* (2006.01)
*H01J 5/16* (2006.01)

(52) U.S. Cl. ..... 313/112; 313/110; 313/483; 313/495; 313/496; 313/497

(58) Field of Classification Search ..... 313/496
See application file for complete search history.

(56) References Cited

U.S. PATENT DOCUMENTS

| | | | | |
|---|---|---|---|---|
| 4,717,856 | A | 1/1988 | Kato | |
| 4,857,799 | A | 8/1989 | Spindt et al. | |
| 5,015,912 | A | 5/1991 | Spindt et al. | |
| 5,508,584 | A * | 4/1996 | Tsai et al. | 313/497 |
| 5,543,685 | A * | 8/1996 | Okamoto et al. | 313/496 |
| 5,703,432 | A * | 12/1997 | Jeong | 313/461 |
| 5,789,856 | A * | 8/1998 | Itoh et al. | 313/495 |
| 6,320,309 | B1 | 11/2001 | Nomura et al. | |
| 6,812,636 | B2 * | 11/2004 | Porter et al. | 313/496 |
| 6,855,636 | B2 * | 2/2005 | Theiss et al. | 438/694 |
| 2002/0113546 | A1 * | 8/2002 | Seo et al. | 313/504 |
| 2003/0076609 | A1 * | 4/2003 | Kawase | 359/885 |

FOREIGN PATENT DOCUMENTS

| | | |
|---|---|---|
| JP | 06-310061 | 11/1994 |
| JP | 07-335141 | 12/1995 |
| JP | 08-329867 | 12/1996 |

(Continued)

*Primary Examiner*—Nimeshkumar D Patel
*Assistant Examiner*—Natalie K Walford
(74) *Attorney, Agent, or Firm*—Robert J. Depke; Rockey, Depke & Lyons, LLC

(57) ABSTRACT

To provide a display panel having such a structure that a color filter is unlikely to suffer damage due to a heat treatment in a reducing atmosphere in the fabrication process for display device. A display panel (anode panel AP) includes a fluorescent region formed on a substrate, and an electrode (anode electrode), formed on the fluorescent region, wherein electrons emitted from an electron source penetrate the electrode and collide with the fluorescent region to allow the fluorescent region to emit light to obtain a desired image, wherein a color filter and a color filter protective film are formed in this order from the side of the substrate between the substrate and the fluorescent region.

30 Claims, 23 Drawing Sheets

FOREIGN PATENT DOCUMENTS

| | | |
|---|---|---|
| JP | 09-274103 | 10/1997 |
| JP | 10-282330 | 10/1998 |
| JP | 10-308184 | 11/1998 |
| JP | 10-326583 | 12/1998 |
| JP | 11-213923 | 8/1999 |
| JP | 2000-047190 | 2/2000 |
| JP | 2001-195004 | 7/2001 |
| JP | 2001-325904 | 11/2001 |
| JP | 2002-175764 | 6/2002 |
| JP | 2003-242911 | 8/2003 |
| JP | 2003-249165 | 9/2003 |
| WO | WO 98/54742 | 12/1998 |

* cited by examiner

DISPLAY PANEL AND DISPLAY DEVICE HAVING COLOR FILTER ELEMENTS WITH COLOR FILTER PROTECTIVE LAYER

CROSS REFERENCE TO RELATED APPLICATION

This application claims priority from Japanese Priority Document No. 2003-434348, filed on Dec. 26, 2003 with the Japanese Patent Office, which document is hereby incorporated by reference.

BACKGROUND OF THE INVENTION

1. Field of the Invention

The present invention relates to a display panel having a color filter, and a display device.

2. Description of Related Art

A display panel constituting a cold cathode field emission display device, cathode-ray tube, or fluorescent display tube (hereinafter, they are frequently collectively referred to simply as "display device") generally is configured with a substrate including a glass substrate or the like, a fluorescent region formed on the substrate, and an anode electrode formed on the fluorescent region. Between the substrate and the fluorescent region is disposed a color filter. As a material constituting a red color filter, for example, as disclosed in Unexamined Japanese Patent Application Laid-Open Specification No. Hei 6-310061, $Fe_2O_3$ particles are generally used.

Patent document 1: Unexamined Japanese Patent Application Laid-Open Specification No. Hei 6-310061

By the way, in the assembly and fabrication process for the display device, a heat treatment is frequently carried out in a reducing gas atmosphere or a deoxidizing atmosphere. For example, in the fabrication process for the cold cathode field emission display device, for assembling a cathode panel having a cold cathode field emission element and an anode panel including the above-mentioned display panel, the circumferential portion of the cathode panel and the circumferential portion of the anode panel are joined together using frit glass. For joining them, the frit glass is burned in a reducing gas atmosphere or a deoxidizing atmosphere (e.g., in a nitrogen gas atmosphere).

Therefore, during the burning of frit glass in a reducing gas atmosphere or a deoxidizing atmosphere, $Fe_2O_3$ particles constituting a red color filter are reduced, or oxygen atoms constituting $Fe_2O_3$ are eliminated (i.e., deoxidized), so that the red color filter cannot function appropriately.

SUMMARY OF THE INVENTION

Accordingly, a task of the present invention is to provide a display panel having such a structure that a color filter is unlikely to suffer a damage due to a heat treatment in a reducing atmosphere, or a deoxidizing atmosphere in the fabrication process for various types of display devices, and a display device having the display panel incorporated therein.

For achieving the above task, the display panel according to the first embodiment of the present invention is configured to include a fluorescent region formed on a substrate, and an electrode formed on the fluorescent region, wherein electrons emitted from an electron source penetrate the electrode and collide with the fluorescent region to allow the fluorescent region to emit light to obtain a desired image, wherein a color filter and a color filter protective film are formed in this order from the side of the substrate between the substrate and the fluorescent region.

For achieving the above task, the display panel according to the second embodiment of the present invention is configured to include a fluorescent region formed on a substrate, and an electrode formed on the fluorescent region, wherein electrons emitted from an electron source penetrate the electrode and collide with the fluorescent region to allow the fluorescent region to emit light to obtain a desired image, wherein the electrode includes a plurality of electrode units, the electrode unit and the electrode unit are electrically connected to each other through a resistant layer, and a color filter and a color filter protective film are formed in this order from the side of the substrate between the substrate and the fluorescent region.

For achieving the above task, the display panel according to the third embodiment of the present invention is configured to include a fluorescent region formed on a substrate, and an electrode, wherein electrons emitted from an electron source collide with the fluorescent region to allow the fluorescent region to emit light to obtain a desired image, wherein the electrode is formed on a portion of the substrate on which the fluorescent region is not formed, and is not formed on a portion of the substrate on which the fluorescent region is formed, and a color filter and a color filter protective film are formed in this order from the side of the substrate between the substrate and the fluorescent region.

For achieving the above task, the display device according to the first embodiment of the present invention is configured to include:

(A) a cathode panel having an electron source formed on a support; and (B) a display panel having a fluorescent region formed on a substrate, and an electrode formed on the fluorescent region, wherein electrons emitted from the electron source penetrate the electrode and collide with the fluorescent region to allow the fluorescent region to emit light to obtain a desired image, wherein the cathode panel and the display panel are joined together at their circumferential portions through a vacuum layer, wherein a color filter and a color filter protective film are formed in this order from the side of the substrate between the substrate and the fluorescent region.

For achieving the above task, the display device according to the second embodiment of the present invention is configured to include:

(A) a cathode panel having an electron source formed on a support; and (B) a display panel having a fluorescent region formed on a substrate, and an electrode formed on the fluorescent region, wherein electrons emitted from the electron source penetrate the electrode and collide with the fluorescent region to allow the fluorescent region to emit light to obtain a desired image, wherein the cathode panel and the display panel are joined together at their circumferential portions through a vacuum layer, wherein the electrode is comprised of a plurality of electrode units, the electrode unit and the electrode unit being electrically connected to each other through a resistant layer, wherein a color filter and a color filter protective film are formed in this order from the side of the substrate between the substrate and the fluorescent region.

For achieving the above task, the display device according to the third embodiment of the present invention is configured to include:

(A) a cathode panel comprising an electron source formed on a support; and (B) a display panel comprising a fluorescent region formed on a substrate, and an electrode, wherein electrons emitted from the electron source collide with the fluorescent region to allow the fluorescent region to emit light to obtain a desired image, wherein the cathode panel and the display panel are joined together at their circumferential portions through a vacuum layer, wherein the electrode is formed on a portion of the substrate on which the fluorescent region is not formed, and is not formed on a portion of the substrate on which the fluorescent region is formed, wherein a color filter and a color filter protective film are formed in this order from the side of the substrate between the substrate and the fluorescent region.

In the following description, the display panel according to the first embodiment of the present invention and the display device according to the first embodiment of the present invention are frequently collectively referred to simply as "the first embodiment of the present invention", the display panel according to the second embodiment of the present invention and the display device according to the second embodiment of the present invention are frequently collectively referred to simply as "the second embodiment of the present invention", and the display panel according to the third embodiment of the present invention and the display device according to the third embodiment of the present invention are frequently collectively referred to simply as "the third embodiment of the present invention".

In the third embodiment of the present invention, for protecting the fluorescent region from ions or the like generated in the display device due to the operation of the display device, for suppressing generation of gas from the fluorescent region, and for preventing the fluorescent region from being removed, it is desired that a fluorescent protective film is formed at least on the fluorescent region. The fluorescent protective film may be extend to and be presented on the electrode. The fluorescent region is generally is configured to include a group of a number of fluorescent particles, and hence the fluorescent region has an uneven surface. Therefore, when a fluorescent protective film is formed on the fluorescent region, the fluorescent protective film may be in a state such that part of the fluorescent protective film is not in contact with part of the fluorescent region, or part of the fluorescent protective film may be in a discontinuous state on the fluorescent region (a state such that a kind of recess is formed in part of the fluorescent protective film), and these modes are involved in the construction in which "a fluorescent protective film is formed on the fluorescent region". This applies to the following description. It is preferred that the fluorescent protective film is comprised of a transparent material. When the fluorescent protective film is comprised of an opaque material, the color of light emitted from the fluorescent region may be adversely affected. The term "transparent material" means a material having a light transmittance possibly close to 100% in the visible light region. The thickness of the fluorescent protective film (average thickness of the fluorescent protective film on the fluorescent region) is desirably $1\times10^{-8}$ to $1\times10^{-7}$ m, preferably $1\times10^{-8}$ to $5\times10^{-8}$ m. The fluorescent protective film is preferably comprised of at least one material selected from the group consisting of aluminum nitride ($AlN_x$), aluminum oxide ($Al_2O_3$), silicon oxide ($SiO_x$), indium tin oxide (ITO), silicon carbide (SiC), chromium oxide ($CrO_x$), and chromium nitride ($CrN_x$), especially, further preferably comprised of aluminum nitride ($AlN_x$). Examples of methods for forming the fluorescent protective film include various types of physical vapor deposition processes (PVD processes), such as a vacuum deposition process and a sputtering process, and various types of chemical vapor deposition processes (CVD processes).

The electrode may be comprised of either single electrode (the first embodiment of the present invention or the third embodiment of the present invention) or a plurality of electrode units (preferred mode in the first embodiment of the present invention or the third embodiment of the present invention). The preferred mode in the third embodiment of the present invention in which the electrode is comprised of a plurality of electrode units is, for convenience sake, referred to as "the fourth embodiment of the present invention (the display panel according to the fourth embodiment of the present invention or the display device according to the fourth embodiment of the present invention)". When the electrode is comprised of a plurality of electrode units, it is necessary that the electrode unit and the electrode unit are electrically connected to each other through a resistant layer. Examples of materials constituting the resistant layer include carbon materials, such as silicon carbide (SiC) and SiCN; SiN materials; high melting-point metal oxides, such as ruthenium oxide ($RuO_2$), tantalum oxide, tantalum nitride, chromium oxide, and titanium oxide; and semiconductor materials, such as amorphous silicon. The sheet resistance of the resistant layer may be, for example, $1\times10^{-1}$ to $1\times10^{10}\Omega/\square$, preferably $1\times10^{3}$ to $1\times10^{8}\ \Omega/\square$. The number (N) of the electrode units may be 2 or more, and, for example, when the total number of columns of the fluorescent regions arranged in a line is n, N=n, or $n=\alpha\cdot N$ (wherein $\alpha$ is an integer of 2 or more, preferably $10\leqq\alpha\leqq100$, further preferably $20\leqq\alpha\leqq50$), or the number of the electrode units may be the number obtained by adding one to the number of spaces (mentioned below) formed at predetermined intervals, or may be equal to the number of pixels or the number of subpixels or one by an integer corresponding to the number of pixels or the number of subpixels. The individual electrode units may have either the same size, irrespective of the positions of the electrode units, or different sizes depending on the positions of the electrode units.

When the display device is of color display, one column of the fluorescent regions arranged in a line may be a column comprised solely of red light-emitting fluorescent regions, a column comprised solely of green light-emitting fluorescent regions, a column comprised solely of blue light-emitting fluorescent regions, or a column comprised of red light-emitting fluorescent regions, green light-emitting fluorescent regions, and blue light-emitting fluorescent regions, which are successively arranged. The fluorescent region is defined as a fluorescent region which forms one luminescent spot on the display panel. One pixel is comprised of a group of one red light-emitting fluorescent region, one green light-emitting fluorescent region, and one blue light-emitting fluorescent region, and one subpixel is comprised of one fluorescent region (one red light-emitting fluorescent region, one green light-emitting fluorescent region, or one blue light-emitting fluorescent region). The size of the electrode unit corresponding to one subpixel means the size of the electrode unit surrounding one fluorescent region.

In the fourth embodiment of the present invention in which the electrode is comprised of a plurality of electrode units, for protecting the fluorescent region from ions or the like generated in the display device, for suppressing generation of gas from the fluorescent region, and for preventing the fluorescent region from being removed, it is desired that a fluorescent protective film is formed at least on the fluorescent region. The fluorescent protective film may be present on the electrode, on the resistant layer, or on the electrode and the resistant layer. The resistance of the fluorescent protective film is desirably equal to or higher than the resistance of the resistant layer, preferably 10 times or more the resistance of the resistant layer. It is preferred that the fluorescent protective film is comprised of a transparent material. When the fluorescent protective film is comprised of an opaque material, the color of light emitted from the fluorescent region may be adversely affected. The thickness of the fluorescent protective film (average thickness of the fluorescent protective film on the fluorescent region) is desirably $1\times10^{-8}$ to $1\times10^{-7}$ m, preferably $1\times10^{-8}$ to $5\times10^{-8}$ m. The fluorescent protective film is preferably comprised of at least one material selected from the group consisting of aluminum nitride ($AlN_x$), aluminum oxide ($Al_2O_3$), silicon oxide ($SiO_x$), chromium oxide ($CrO_x$), and chromium nitride ($CrN_x$), especially, further preferably comprised of aluminum nitride ($AlN_x$). The sheet resistance of the fluorescent protective film is, for example, $1\times10^{6}\Omega/\square$ or more, preferably $1\times10^{8}\Omega/\square$ or more.

In the first to fourth embodiments of the present invention including the above various preferred modes, the color filter protective film may be selected from the materials which can satisfy the following requirements:

(1) that the material have excellent light transmission properties in the visible light region;

(2) that the material be stable in an electron beam irradiation;

(3) that the material be a dense film such that it is not or substantially not permeable to gas; and (4) that the material be stable in a thermal process or a wet process. Specifically, it is preferred that the color filter protective film is comprised of at least one material selected from the group consisting of aluminum nitride ($AlN_x$), chromium nitride ($CrN_x$), aluminum oxide ($AlO_x$), chromium oxide ($CrO_x$), silicon oxide ($SiO_x$), silicon nitride ($SiN_y$), and silicon oxide nitride ($SiO_xN_y$). The color filter protective film can be formed by a deposition process, such as an electron beam deposition process or a hot-filament deposition process; a PVD process, such as a sputtering process, an ion plating process, or a laser abrasion process; a CVD process; a screen printing process; a lift-off process; or a sol-gel process.

Examples of combinations of the material constituting the resistant layer and the material constituting the fluorescent protective film include combinations of the 9 types of materials mentioned above as examples of the material constituting the resistant layer, i.e., silicon carbide (SiC), SiCN, an SiN material, ruthenium oxide ($RuO_2$), tantalum oxide, tantalum nitride, chromium oxide, titanium oxide, and amorphous silicon, and the 7 types of materials mentioned above as examples of the material constituting the fluorescent protective film, i.e., aluminum nitride ($AlN_x$), aluminum oxide ($Al_2O_3$), silicon oxide ($SiO_x$), indium tin oxide (ITO), silicon carbide (SiC), chromium oxide ($CrO_x$), and chromium nitride ($CrN_x$) (9×7=63 combinations in total).

Examples of combinations of the material constituting the color filter protective film and the material constituting the resistant layer include combinations of the 7 types of materials mentioned above as examples of the material constituting the color filter protective film, i.e., aluminum nitride ($AlN_x$), chromium nitride ($CrN_x$), aluminum oxide ($AlO_x$), chromium oxide ($CrO_x$), silicon oxide ($SiO_x$), silicon nitride ($SiN_y$), and silicon oxide nitride ($SiO_xN_y$), and the 9 types of materials mentioned above as examples of the material constituting the resistant layer (7×9=63 combinations in total), and, of these, as a preferred example of the combination of (material constituting the color filter protective film)/(material constituting the resistant layer), there can be mentioned a combination of (aluminum nitride ($AlN_x$))/(silicon carbide (SiC))

Examples of combinations of the material constituting the color filter protective film and the material constituting the fluorescent protective film include combinations of the 7 types of materials mentioned above as examples of the material constituting the color filter protective film and the 7 types of materials mentioned above as examples of the material constituting the fluorescent protective film (7×7=49 combinations in total), and, of these, as a preferred example of the combination of (material constituting the color filter protective film)/(material constituting the fluorescent protective film), there can be mentioned a combination of (aluminum nitride ($AlN_x$))/(aluminum nitride ($AlN_x$)).

Further, examples of combinations of the material constituting the color filter protective film, the material constituting the resistant layer, and the material constituting the fluorescent protective film include combinations of the 7 types of materials mentioned above as examples of the material constituting the color filter protective film, the 9 types of materials mentioned above as examples of the material constituting the resistant layer, and the 7 types of materials mentioned above as examples of the material constituting the fluorescent protective film (7×9×7=441 combinations in total), and, of these, as a preferred example of the combination of (material constituting the color filter protective film)/(material constituting the resistant layer)/(material constituting the fluorescent protective film), there can be mentioned a combination of (aluminum nitride ($AlN_x$))/(silicon carbide (SiC))/(aluminum nitride ($AlN_x$)).

In the display panel according to the first to fourth embodiments of the present invention including the above various preferred modes, the display panel may constitute an anode panel in a cold cathode field emission display device, and the electrode may constitute an anode electrode in the anode panel. In the display device according to the first to fourth embodiments of the present invention including the above various preferred modes, the display device may constitute a cold cathode field emission display device, the display panel may constitute an anode panel in the cold cathode field emission display device, the electrode may constitute an anode electrode in the anode panel, and the electron source is comprised of a cold cathode field emission element. Examples of display devices include a cathode-ray tube (CRT) and a fluorescent character display tube, and examples of display panels include plates and panels constituting the cathode-ray tube (CRT) or fluorescent character display tube.

In the first embodiment of the present invention to the fourth embodiment of the present invention (hereinafter, frequently, collectively referred to simply as "the present invention"), examples of color filters include a red color filter, a blue color filter, and a green color filter. The color filter can be obtained by, for example, forming (applying) a paste material constituting the color filter on a substrate, and then, for example, subjecting the paste material to exposure, development, and drying. Examples of red pigments constituting the paste material as a raw material for the red color filter include $Fe_2O_3$, examples of blue pigments constituting the paste material as a raw material for the blue color filter include $CoO.Al_2O_3$, and examples of green pigments constituting the paste material as a raw material for the green color filter include $TiO_2.NiO.CoO.ZnO$ and $CoO.CrO.TiO_2.Al_2O_3$. Examples of methods for forming a film of the paste material include a spin coating process, a screen printing process, and a roll coater process. Further, as an example of the material constituting the color filter, there can be mentioned a so-called dry film, and, in this case, the color filter can be formed by a so-called heat transfer method.

In the present invention, the display panel may have a construction in which a plurality of partitions are formed for preventing the occurrence of so-called optical cross talk (color turbidity) caused by the electrons from the fluorescent region or secondary electrons emitted from the fluorescent region, which electrons enter another fluorescent region.

Examples of planar forms of the partition include a lattice form (form of parallel crosses), namely, a form such that the partition surrounds, for example, all the four sides of the fluorescent region having a substantially rectangular form (dot form) in planar form corresponding to one subpixel, and a strip form or stripe form extending in parallel with the opposite sides of the substantially rectangular or stripe-form fluorescent region. When the partition is in a lattice form, the partition may have either a form such that it continuously surrounds all the sides of one fluorescent region or a form such that it discontinuously surrounds the sides of one fluorescent region. When the partition is in a strip form or stripe form, the partition may have either a continuous form or a discontinuous form. After forming the partition, the partition may be subjected to abrasion to flatten the top surface of the partition.

In the first embodiment of the present invention, the color filter protective film may be formed so that it not only is present on the color filter but also extends to and is present on a portion of the substrate on which the color filter is not formed. Further, the electrode may be formed so that it not only is present on the fluorescent region but also extends to and is present on a portion of the substrate on which the fluorescent region is not formed. Specifically, in the first embodiment of the present invention, the electrode can be obtained by a method in which, for example, a fluorescent region is formed on a substrate, and then an intermediate film comprised of a polymer material is formed on the entire surface, and subsequently a conductive material layer is formed on the intermediate film, followed by removal of the intermediate film by burning. In the first embodiment of the present invention, the electrode is in the form of one sheet which, for example, covers the effective region (region which functions as an actual display portion). When a partition is formed, the electrode is formed in the effective region, more specifically, over the partition to the fluorescent region (including a portion above the fluorescent region).

In the first embodiment of the present invention, the display panel can be fabricated in the order shown in (A) of Table 1 below. In Tables 1 to 6 below, the figures designate the order of steps. "CF" means a color filter, "Formation of electrode units" means formation of electrode units by patterning of a conductive material layer, "Formation of resistant layer" means formation of a resistant layer for electrically connecting the electrode units to one another, "Formation of conductive material layer" means formation of a conductive material layer for forming a plurality of electrode units, and "Electrode unit formation" means a step for patterning the conductive material layer to obtain electrode units.

In the second embodiment of the present invention, the color filter protective film may be formed so that it not only is present on the color filter but also extends to and is present on a portion of the substrate on which the color filter is not formed. Further, the conductive material layer may be formed so that it not only is present on the fluorescent region but also extends to and is present on a portion of the substrate on which the fluorescent region is not formed. Specifically, in the second embodiment of the present invention, the electrode units can be obtained by a method in which, for example, a fluorescent region is formed on a substrate, and then an intermediate film comprised of a polymer material is formed on the entire surface, and subsequently a conductive material layer is formed on the intermediate film, followed by removal of the intermediate film by burning, to obtain a sheet-form conductive material layer, and then the sheet-form conductive material layer is patterned.

In the second embodiment of the present invention, when a partition is formed, it is preferred that the boundary of the electrode unit (or boundary between the electrode unit and the electrode unit) is positioned on the top surface of the partition, and it is desired that the resistant layer is formed on or under the electrode unit at least on the top surface of the partition so that the resistant layer has disposed therebetween the boundary of the electrode unit. Specifically, there can be mentioned a mode in which the resistant layer is formed on the electrode unit positioned on the top surface of the partition, a mode in which the resistant layer is formed on the electrode unit positioned on the top surface of the partition and the upper portion of the sidewall of the partition, and a mode in which the resistant layer is formed on the electrode unit positioned on the top surface of the partition and the sidewall of the partition. In addition, there can be mentioned a mode in which the resistant layer is formed under the electrode unit positioned on the top surface of the partition, a mode in which the resistant layer is formed under the electrode unit positioned on the top surface of the partition and the upper portion of the sidewall of the partition, and a mode in which the resistant layer is formed under the electrode unit positioned on the top surface of the partition and the sidewall of the partition. When the material constituting the resistant layer is transparent with respect to light emitted from the fluorescent region, the resistant layer may be formed so that it extends to and is present on a region in which the fluorescent region is formed. The resistant layer may be formed from a resistant material, and patterned in accordance with a lithography technique and an etching technique, which method is selected depending on the material constituting the resistant layer, or the resistant layer can be obtained by forming a resistant material by a PVD process or a screen printing process through a mask or screen having a pattern of the resistant layer, or by employing an oblique incident vacuum deposition process, which method is selected depending on the form of the partition.

In the second embodiment of the present invention, the display panel can be fabricated in the order shown in (B) of Table 1 below, especially, preferably fabricated in the order shown in case No. "3" in (B) of Table 1 below.

In the third embodiment and the fourth embodiment of the present invention, the electrode is formed on a portion of the substrate on which the fluorescent region is not formed, and is not formed on a portion of the substrate on which the fluorescent region is formed. When no partition is formed, it is preferred that the electrode is formed on the substrate so as to surround the fluorescent region. On the other hand, when a partition is formed so as to completely surround one fluorescent region, it is preferred that the electrode is formed on the partition and is not formed on a portion of the substrate on which the fluorescent region is formed. For example, when the partition is formed along the opposite two sides of the fluorescent region, it is preferred that the electrode is formed on the partition, and formed along the fluorescent region on a portion of the substrate on which the fluorescent region is not formed, and is not formed on a portion of the substrate on which the fluorescent region is formed. The mode in which the electrode is formed on the partition involves a mode in which the electrode is formed on the top surface of the partition, a mode in which the electrode is formed on the top surface of the partition and the upper portion of the sidewall of the partition, and a mode in which the electrode is formed on the top surface of the partition and the sidewall of the partition. When the electrode is comprised of a plurality of electrode units (the fourth embodiment of the present invention), it is preferred that the boundary of the electrode unit (or boundary between the electrode unit and the electrode unit) is positioned on the top surface of the partition, and it is desired that the resistant layer is formed on or under the electrode unit at least on the top surface of the partition so that the resistant layer has disposed therebetween the boundary of the electrode unit. Specifically, there can be mentioned a mode in which the resistant layer is formed on the electrode unit positioned on the top surface of the partition, a mode in which the resistant layer is formed on the electrode unit positioned on the top surface of the partition and the upper portion of the sidewall of the partition, and a mode in which the resistant layer is formed on the electrode unit positioned on the top surface of the partition and the sidewall of the partition. In addition, there can be mentioned a mode in which the resistant layer is formed under the electrode unit positioned on the top surface of the partition, a mode in which the resistant layer is formed under the electrode unit positioned on the top surface of the partition and the upper portion of the sidewall of the partition, and a mode in which the resistant layer is formed under the electrode unit positioned on the top surface of the partition and the sidewall of the partition. When the material constituting the resistant layer is transparent with respect to light emitted from the fluorescent region, the resistant layer may be formed so that it extends to and is present on a region in which the fluorescent region is formed. It is preferred that the electrode or electrode unit or the resistant layer is formed prior to formation of the fluorescent region (when a partition is formed, after forming the partition), but there is no particular limitation.

In the third embodiment and the fourth embodiment of the present invention, the electrode or electrode unit may be formed on the substrate using a conductive material layer. Specifically, the electrode or electrode unit can be obtained by a method in which a conductive material layer comprised of a conductive material is formed on a substrate, and the conductive material layer is patterned in accordance with a lithography technique and an etching technique. Alternatively, the electrode or electrode unit can be obtained by a method in which a conductive material is formed by a PVD process or a screen printing process through a mask or screen having a pattern of the electrode or electrode unit. As a method for forming the electrode or electrode unit, more specifically, in addition to the below-mentioned method for forming a conductive material layer constituting the electrode or electrode unit, an oblique incident vacuum deposition process can be employed depending on the form of the partition. That is, the electrode or electrode unit can be formed by an oblique incident vacuum deposition process only on the top surface of the partition and the sidewall (or the upper portion of the sidewall) of the partition. In the fourth embodiment of the present invention, the resistant layer can be formed by a similar method. Specifically, the resistant layer may be formed from a resistant material, and patterned in accordance with a lithography technique and an etching technique, or the resistant layer can be obtained by forming a resistant material by a PVD process or a screen printing process through a mask or screen having a pattern of the resistant layer, or by employing an oblique incident vacuum deposition process, which method is selected depending on the form of the partition.

In the third embodiment of the present invention, the display panel can be fabricated in the order shown in (C) or (D) of Table 1 below, especially, preferably fabricated in the order shown in case No. "5" in (D) of Table 1 below. In the fourth embodiment of the present invention, the display panel can be fabricated in the order shown in Table 2, Table 3, Table 4, Table 5, and Table 6 below, especially, preferably fabricated in the order shown in case No. "69" in Table 6 below or case No. "20" in Table 4 below. It is noted that, in the third embodiment or the fourth embodiment of the present invention, when the color filter protective film is comprised of an insulating material, it is necessary that the electrode or electrode unit be formed after forming the color filter protective film.

TABLE 1

(A) First embodiment of the present invention

| Case No. | Formation of CF | Formation of CF protective film | Formation of fluorescent region | Formation of electrode |
|---|---|---|---|---|
| 1 | 1 | 2 | 3 | 4 |

(B) Second embodiment of the present invention

| Case No. | Formation of CF | Formation of CF protective film | Formation of fluorescent region | Formation of electrode units | Formation of resistant layer |
|---|---|---|---|---|---|
| 1 | 1 | 2 | 3 | 4 | 5 |
| 2 | 1 | 2 | 3 | 5 | 4 |
| 3 | 2 | 3 | 4 | 5 | 1 |

(C) Third embodiment of the present invention (1)

| Case No. | Formation of CF | Formation of CF protective film | Formation of fluorescent region | Formation of electrode |
|---|---|---|---|---|
| 1 | 1 | 2 | 3 | 4 |
| 2 | 1 | 2 | 4 | 3 |
| 3 | 1 | 3 | 4 | 2 |
| 4 | 2 | 3 | 4 | 1 |

(D) Third embodiment of the present invention (2)

| Case No. | Formation of CF | Formation of CF protective film | Formation of fluorescent region | Formation of electrode | Formation of fluorescent protective film |
|---|---|---|---|---|---|
| 1 | 1 | 2 | 3 | 4 | 5 |
| 2 | 1 | 2 | 3 | 5 | 4 |
| 3 | 1 | 2 | 4 | 3 | 5 |
| 4 | 1 | 3 | 4 | 2 | 5 |
| 5 | 2 | 3 | 4 | 1 | 5 |

TABLE 2

Fourth embodiment of the present invention (1)

| Case No. | Formation of CF | Formation of CF protective film | Formation of fluorescent region | Formation of conductive material layer | Electrode unit formation | Formation of resistant layer |
|---|---|---|---|---|---|---|
| 1 | 1 | 2 | 3 | 4 | 5 | 6 |
| 2 | 1 | 2 | 3 | 5 | 6 | 4 |
| 3 | 1 | 2 | 4 | 3 | 5 | 6 |
| 4 | 1 | 2 | 4 | 5 | 6 | 3 |
| 5 | 1 | 2 | 5 | 4 | 6 | 3 |
| 6 | 1 | 2 | 5 | 3 | 4 | 6 |
| 7 | 1 | 2 | 6 | 4 | 5 | 3 |
| 8 | 1 | 2 | 6 | 3 | 4 | 5 |
| 9 | 1 | 3 | 4 | 2 | 5 | 6 |
| 10 | 1 | 3 | 4 | 5 | 6 | 2 |
| 11 | 1 | 3 | 5 | 4 | 6 | 2 |
| 12 | 1 | 3 | 5 | 2 | 4 | 6 |
| 13 | 1 | 3 | 6 | 4 | 5 | 2 |
| 14 | 1 | 3 | 6 | 2 | 4 | 5 |
| 15 | 1 | 4 | 5 | 2 | 3 | 6 |
| 16 | 1 | 4 | 5 | 3 | 6 | 2 |
| 17 | 1 | 4 | 6 | 2 | 3 | 5 |
| 18 | 1 | 4 | 6 | 3 | 5 | 2 |
| 19 | 1 | 5 | 6 | 2 | 3 | 4 |
| 20 | 1 | 5 | 6 | 3 | 4 | 2 |
| 21 | 2 | 3 | 4 | 1 | 5 | 6 |
| 22 | 2 | 3 | 4 | 5 | 6 | 1 |
| 23 | 2 | 3 | 5 | 4 | 6 | 1 |
| 24 | 2 | 3 | 5 | 1 | 4 | 6 |
| 25 | 2 | 3 | 6 | 4 | 5 | 1 |
| 26 | 2 | 3 | 6 | 1 | 4 | 5 |
| 27 | 2 | 4 | 5 | 1 | 3 | 6 |
| 28 | 2 | 4 | 5 | 3 | 6 | 1 |
| 29 | 2 | 4 | 6 | 1 | 3 | 5 |
| 30 | 2 | 4 | 6 | 3 | 5 | 1 |

TABLE 3

Fourth embodiment of the present invention (2)

| Case No. | Formation of CF | Formation of CF protective film | Formation of fluorescent region | Formation of conductive material layer | Electrode unit formation | Formation of resistant layer |
|---|---|---|---|---|---|---|
| 31 | 2 | 5 | 6 | 1 | 3 | 4 |
| 32 | 2 | 5 | 6 | 3 | 4 | 1 |
| 33 | 3 | 4 | 5 | 2 | 6 | 1 |
| 34 | 3 | 4 | 5 | 1 | 2 | 6 |
| 35 | 3 | 4 | 6 | 2 | 5 | 1 |
| 36 | 3 | 4 | 6 | 1 | 2 | 5 |
| 37 | 3 | 5 | 6 | 2 | 4 | 1 |
| 38 | 3 | 5 | 6 | 1 | 2 | 4 |
| 39 | 4 | 5 | 6 | 1 | 2 | 3 |
| 40 | 4 | 5 | 6 | 2 | 3 | 1 |

TABLE 4

Fourth embodiment of the present invention (3)

| Case No. | Formation of CF | Formation of CF protective film | Formation of fluorescent region | Formation of conductive material layer | Electrode unit formation | Formation of resistant layer | Formation of fluorescent protective film |
|---|---|---|---|---|---|---|---|
| 1 | 1 | 2 | 3 | 4 | 5 | 6 | 7 |
| 2 | 1 | 2 | 3 | 4 | 5 | 7 | 6 |
| 3 | 1 | 2 | 3 | 4 | 6 | 7 | 5 |
| 4 | 1 | 2 | 3 | 5 | 6 | 4 | 7 |
| 5 | 1 | 2 | 3 | 5 | 6 | 7 | 4 |
| 6 | 1 | 2 | 3 | 5 | 7 | 4 | 6 |

TABLE 4-continued

| Fourth embodiment of the present invention (3) | | | | | | | |
|---|---|---|---|---|---|---|---|
| Case No. | Formation of CF | Formation of CF protective film | Formation of fluorescent region | Formation of conductive material layer | Electrode unit formation | Formation of resistant layer | Formation of fluorescent protective film |
| 7 | 1 | 2 | 3 | 6 | 7 | 5 | 4 |
| 8 | 1 | 2 | 3 | 6 | 7 | 4 | 5 |
| 9 | 1 | 2 | 4 | 3 | 5 | 6 | 7 |
| 10 | 1 | 2 | 4 | 3 | 5 | 7 | 6 |
| 11 | 1 | 2 | 4 | 3 | 6 | 7 | 5 |
| 12 | 1 | 2 | 4 | 5 | 6 | 3 | 7 |
| 13 | 1 | 2 | 4 | 5 | 7 | 3 | 6 |
| 14 | 1 | 2 | 4 | 6 | 7 | 3 | 5 |
| 15 | 1 | 2 | 5 | 4 | 6 | 3 | 7 |
| 16 | 1 | 2 | 5 | 4 | 7 | 3 | 6 |
| 17 | 1 | 2 | 5 | 3 | 4 | 6 | 7 |
| 18 | 1 | 2 | 5 | 3 | 4 | 7 | 6 |
| 19 | 1 | 2 | 6 | 4 | 5 | 3 | 7 |
| 20 | 1 | 2 | 6 | 3 | 4 | 5 | 7 |
| 21 | 1 | 3 | 4 | 2 | 5 | 6 | 7 |
| 22 | 1 | 3 | 4 | 2 | 5 | 7 | 6 |
| 23 | 1 | 3 | 4 | 2 | 6 | 7 | 5 |
| 24 | 1 | 3 | 4 | 5 | 6 | 2 | 7 |
| 25 | 1 | 3 | 4 | 5 | 7 | 2 | 6 |
| 26 | 1 | 3 | 4 | 6 | 7 | 2 | 5 |
| 27 | 1 | 3 | 5 | 4 | 6 | 2 | 7 |
| 28 | 1 | 3 | 5 | 4 | 7 | 2 | 6 |
| 29 | 1 | 3 | 5 | 2 | 4 | 6 | 7 |
| 30 | 1 | 3 | 5 | 2 | 4 | 7 | 6 |

TABLE 5

| Fourth embodiment of the present invention (4) | | | | | | | |
|---|---|---|---|---|---|---|---|
| Case No. | Formation of CF | Formation of CF protective film | Formation of fluorescent region | Formation of conductive material layer | Electrode unit formation | Formation of resistant layer | Formation of fluorescent protective film |
| 31 | 1 | 3 | 6 | 4 | 5 | 2 | 7 |
| 32 | 1 | 3 | 6 | 2 | 4 | 5 | 7 |
| 33 | 1 | 4 | 5 | 2 | 3 | 6 | 7 |
| 34 | 1 | 4 | 5 | 2 | 3 | 7 | 6 |
| 35 | 1 | 4 | 5 | 3 | 6 | 2 | 7 |
| 36 | 1 | 4 | 5 | 3 | 7 | 2 | 6 |
| 37 | 1 | 4 | 6 | 2 | 3 | 5 | 7 |
| 38 | 1 | 4 | 6 | 3 | 5 | 2 | 7 |
| 39 | 1 | 5 | 6 | 2 | 3 | 4 | 7 |
| 40 | 1 | 5 | 6 | 3 | 4 | 2 | 7 |
| 41 | 2 | 3 | 4 | 1 | 5 | 6 | 7 |
| 42 | 2 | 3 | 4 | 1 | 5 | 7 | 6 |
| 43 | 2 | 3 | 4 | 1 | 6 | 7 | 5 |
| 44 | 2 | 3 | 4 | 5 | 6 | 1 | 7 |
| 45 | 2 | 3 | 4 | 5 | 7 | 1 | 6 |
| 46 | 2 | 3 | 4 | 6 | 7 | 1 | 5 |
| 47 | 2 | 3 | 5 | 4 | 6 | 1 | 7 |
| 48 | 2 | 3 | 5 | 4 | 7 | 1 | 6 |
| 49 | 2 | 3 | 5 | 1 | 4 | 6 | 7 |
| 50 | 2 | 3 | 5 | 1 | 4 | 7 | 6 |
| 51 | 2 | 3 | 6 | 4 | 5 | 1 | 7 |
| 52 | 2 | 3 | 6 | 1 | 4 | 5 | 7 |
| 53 | 2 | 4 | 5 | 1 | 3 | 6 | 7 |
| 54 | 2 | 4 | 5 | 1 | 3 | 7 | 6 |
| 55 | 2 | 4 | 5 | 3 | 6 | 1 | 7 |
| 56 | 2 | 4 | 5 | 3 | 7 | 1 | 6 |
| 57 | 2 | 4 | 6 | 1 | 3 | 5 | 7 |
| 58 | 2 | 4 | 6 | 3 | 5 | 1 | 7 |
| 59 | 2 | 5 | 6 | 1 | 3 | 4 | 7 |
| 60 | 2 | 5 | 6 | 3 | 4 | 1 | 7 |

TABLE 6

| Fourth embodiment of the present invention (5) | | | | | | | |
|---|---|---|---|---|---|---|---|
| Case No. | Formation of CF | Formation of CF protective film | Formation of fluorescent region | Formation of conductive material layer | Electrode unit formation | Formation of resistant layer | Formation of fluorescent protective film |
| 61 | 3 | 4 | 5 | 2 | 6 | 1 | 7 |
| 62 | 3 | 4 | 5 | 2 | 7 | 1 | 6 |
| 63 | 3 | 4 | 5 | 1 | 2 | 6 | 7 |
| 64 | 3 | 4 | 5 | 1 | 2 | 7 | 6 |
| 65 | 3 | 4 | 6 | 2 | 5 | 1 | 7 |
| 66 | 3 | 4 | 6 | 1 | 2 | 5 | 7 |
| 67 | 3 | 5 | 6 | 2 | 4 | 1 | 7 |
| 68 | 3 | 5 | 6 | 1 | 2 | 4 | 7 |
| 69 | 4 | 5 | 6 | 1 | 2 | 3 | 7 |
| 70 | 4 | 5 | 6 | 2 | 3 | 1 | 7 |

In the first embodiment or the second embodiment of the present invention, the average thickness of the electrode or electrode unit on the fluorescent region or on the upper portion of the fluorescent region may be, for example, $3\times10^{-8}$ m (30 nm) to $1.5\times10^{-7}$ m (150 nm), preferably $5\times10^{-8}$ m (50 nm) to $1\times10^{-7}$ m (100 nm). In the third embodiment or the fourth embodiment of the present invention, the average thickness of the electrode or electrode unit on the substrate (when a partition is formed, the average thickness of the electrode or electrode unit on the top surface of the partition) may be, for example, $3\times10^{-8}$ m (30 nm) to $1.5\times10^{-7}$ m (150 nm), preferably $5\times10^{-8}$ m (50 nm) to $1\times10^{-7}$ m (100 nm).

In the present invention, examples of conductive materials constituting the electrode (anode electrode) include metals, such as molybdenum (Mo), aluminum (Al), chromium (Cr), tungsten (W), niobium (Nb), tantalum (Ta), gold (Au), silver (Ag), titanium (Ti), cobalt (Co), zirconium (Zr), iron (Fe), platinum (Pt), and zinc (Zn); alloys or compounds containing these metal elements (e.g., nitrides, such as TiN, and silicides, such as $WSi_2$, $MoSi_2$, $TiSi_2$, and $TaSi_2$) semiconductors, such as silicon (Si); carbon thin films comprised of diamond or the like; and conductive metal oxides, such as ITO (indium tin oxide), indium oxide, and zinc oxide. When a resistant layer is formed, it is preferred that the electrode (anode electrode) is comprised of a conductive material which does not change the resistance of the resistant layer, and, for example, when the resistant layer is comprised of silicon carbide (SiC), it is preferred that the electrode (anode electrode) is comprised of molybdenum (Mo).

In the present invention, examples of methods for forming the conductive material layer constituting the electrode or electrode unit include deposition processes, such as an electron beam deposition process and a hot-filament deposition process; various types of PVD processes, such as a sputtering process, an ion plating process, and a laser abrasion process; various types of CVD processes; a screen printing process; a lift-off process; and a sol-gel process.

As an example of the material constituting an intermediate film, there can be mentioned a lacquer. A lacquer includes a kind of varnish in a broad sense, e.g., a solution of a composition comprised mainly of a cellulose derivative, generally nitrocellulose in a volatile solvent, such as a lower fatty acid ester, and an urethane lacquer or acrylic lacquer using another synthetic polymer. When no intermediate film is formed, the electrode or electrode unit on the fluorescent region becomes uneven due to the form of the surface of the fluorescent region to cause light emitted from the fluorescent region to undergo irregular reflection on the electrode or electrode unit on the fluorescent region, so that a disadvantage may occur in that high luminescence of the display device cannot be achieved. On the other hand, when an intermediate film is formed, the electrode or electrode unit on the fluorescent region becomes smooth, and therefore light emitted from the fluorescent region is reflected in the direction of the substrate by the electrode or electrode unit on the fluorescent region, so that high luminescence of the display device can be achieved.

As examples of methods for forming the partition, there can be mentioned a screen printing process, a dry film method, a photosensitizing method, and a method using sandblast. The screen printing process is a method in which a material for forming a partition on a screen, which has an opening at a portion of the screen corresponding to the portion on which a partition will be formed, is permitted to pass through the opening using a squeegee to form a material layer for forming a partition on a substrate, and then the material layer for forming a partition is burned. The dry film method is a method in which a photosensitive film is laminated on a substrate, and subjected to exposure and development to remove the photosensitive film at a site on which a partition will be formed, and the opening formed by the removal of the photosensitive film is filled with a material for forming a partition, followed by burning. The photosensitive film is burned up and removed by burning, so that the material for forming a partition remains in the opening to form a partition. The photosensitizing method is a method in which a material layer having photosensitivity for forming a partition is formed on a substrate, and subjected to exposure and development to pattern the material layer for forming a partition, followed by burning. The method using sandblast is a method in which a material layer for forming a partition is formed on a substrate, for example, by screen printing or using a roll coater, a doctor blade, a nozzle feeding coater, or the like, and dried, and then a portion of the material layer for forming a partition, at which a partition will be formed, is covered with a mask layer, and subsequently the exposed portion of the material layer for forming a partition is removed by a sandblast method.

It is preferred that a light absorbing layer (black matrix) which absorbs light emitted from the fluorescent region is formed between the partition and the substrate from the viewpoint of improving the contrast of the display image. As a material constituting the light absorbing layer, a material which absorbs 99% or more of the light emitted from the fluorescent region is preferably selected. Examples of such materials include carbon, metal thin films (comprised of e.g., chromium, nickel, aluminum, molybdenum, or an alloy thereof), metal oxides (e.g., chromium oxide), metal nitrides (e.g., chromium nitride), heat-resistant organic resins, glass pastes, and glass pastes containing a black pigment or conductive particles of silver or the like, and specific examples include photosensitive polyimide resins, chromium oxide, and a chromium oxide/chromium stacked film. When using a chromium oxide/chromium stacked film, the chromium film is in contact with the substrate. The light absorbing layer can be formed by a method appropriately selected depending on the material used, e.g., a combination of a vacuum deposition process or a sputtering process and an etching process, a combination of a vacuum deposition process, a sputtering process, or a spin coating process and a lift-off process, a screen printing process, a lithography technique, or the like.

The fluorescent region may be comprised of either single-color fluorescent particles or three primary-color fluorescent particles. The arrangement of the fluorescent regions may be either a dot form or a stripe form. In the arrangement in a dot form or a stripe form, a gap between the adjacent fluorescent regions may be filled with a light absorbing layer (black matrix) for improving the contrast.

The fluorescent region can be formed by a method using a light-emitting crystalline particle composition prepared from light-emitting crystalline particles (e.g., fluorescent particles having a particle size of about 5 to 10 nm), in which, for example, a red-photosensitive, light-emitting crystalline particle composition (red fluorescent slurry) is applied to the entire surface, and exposed and developed to form a red light-emitting fluorescent region, and then a green-photosensitive, light-emitting crystalline particle composition (green fluorescent slurry) is applied to the entire surface, and exposed and developed to form a green light-emitting fluorescent region, and further a blue-photosensitive, light-emitting crystalline particle composition (blue fluorescent slurry) is applied to the entire surface, and exposed and developed to form a blue light-emitting fluorescent region. The average thickness of the fluorescent region on the substrate is not limited, but it is desirably 3 to 20 μm, preferably 5 to 10 μm.

As the fluorescent material constituting the light-emitting crystalline particles, one appropriately selected from conventionally known fluorescent materials can be used. In color display, it is preferred to select a combination of fluorescent materials such that the color purity is close to that of the three primary colors prescribed in the NTSC standard, the white balance obtained when mixing the three primary colors is excellent, the persistence time is short, and the persistence times of the three primary colors are substantially equal to one another. Examples of fluorescent materials constituting the red light-emitting fluorescent region include ($Y_2O_3$:Eu), ($Y_2O_2S$:Eu), ($Y_3Al_5O_{12}$:Eu), ($Y_2SiO_5$:Eu), and ($Zn_3(PO_4)_2$:Mn), and, of these, ($Y_2O_3$:Eu) and ($Y_2O_2S$:Eu) are preferably used. Examples of fluorescent materials constituting the green light-emitting fluorescent region include ($ZnSiO_2$:Mn), ($Sr_4Si_3O_8C_{14}$:Eu), (ZnS:Cu, Al), (ZnS:Cu, Au, Al), ((Zn, Cd)S:Cu, Al), ($Y_3Al_5O_{12}$:Tb), ($Y_2SiO_5$:Tb), ($Y_3(Al, Ga)_5O_{12}$:Tb), ($ZnBaO_4$:Mn), ($GbBO_3$:Tb), ($Sr_6SiO_3Cl_3$:Eu), ($BaMgAl_{14}O_{23}$:Mn), ($ScBO_3$:Tb), ($Zn_2SiO_4$:Mn), (ZnO:Zn), ($Gd_2O_2S$:Tb), and ($ZnGa_2O_4$:Mn), and, of these, (ZnS:Cu, Al), (ZnS:Cu, Au, Al), ((Zn, Cd)S:Cu, Al), ($Y_3Al_5Ol_2$:Tb), ($Y_3(Al, Ga)_5O_{12}$:Tb), and ($Y_2SiO_5$:Tb) are preferably used. Examples of fluorescent materials constituting the blue light-emitting fluorescent region include ($Y_2SiO_5$:Ce), ($CaWO_4$:Pb), $CaWO_4$, $YP_{0.85}V_{0.15}O_4$, ($BaMgAl_{14}O_{23}$:Eu), ($Sr_2P_2O_7$:Eu), ($Sr_2P_2O_7$:Sn), (ZnS:Ag, Al), (ZnS:Ag), ZnMgO, and $ZnGaO_4$, and, of these, (ZnS:Ag) and (ZnS:Ag, Al) are preferably used.

When a cold cathode field emission display device is constituted by the display device of the present invention, the cold cathode field emission element (constituting the electron source; hereinafter, referred to as "field emission element") in the cold cathode field emission display device comprises, more specifically, for example, (A) a cathode electrode, formed on a support, extending in the first direction, (B) an insulating layer formed on the support and the cathode electrode, (C) a gate electrode, formed on the insulating layer, extending in the second direction different from the first direction, (D) an opening portion formed in the gate electrode and the insulating layer, and (E) an electron emitting portion exposed at the bottom of the opening portion.

With respect to the type of the field emission element, there is no particular limitation, and any of a Spindt-type field emission element, an edge-type field emission element, a plane-type field emission element, a flat-type field emission element, and a crown-type field emission element can be employed. From the viewpoint of obtaining the cold cathode field emission display device having a simplified structure, it is preferred that each of the cathode electrode and the gate electrode has a stripe form and the projected image of the cathode electrode and the projected image of the gate electrode are perpendicular to each other, that is, the first direction and the second direction are perpendicular to each other.

Further, the field emission element may have a focusing electrode. Specifically, the field emission element may be a field emission element in which an interlayer dielectric layer is further formed on the gate electrode and the insulating layer, and a focusing electrode is formed on the interlayer dielectric layer, or a field emission element in which a focusing electrode is formed on the upper portion of the gate electrode. The focusing electrode is an electrode which focuses the track of the electrons emitted from the opening portion toward the electrode (anode electrode), making it possible to improve the luminescence or prevent the occurrence of optical cross talk between the adjacent pixels. In a so-called high voltage-type cold cathode field emission display device in which the potential difference between the electrode (anode electrode) and the cathode electrode is on the order of several kV and the distance between the anode electrode and the cathode electrode is relatively large, the focusing electrode is especially effective. A relatively negative voltage is applied to the focusing electrode from a focusing electrode control circuit. The focusing electrode is not necessarily formed per field emission element, and a focusing electrode which extends to and is present along a predetermined direction of the arrangement of field emission elements can exhibit a focusing effect common to a plurality of field emission elements.

In the cold cathode field emission display device, a strong electric field generated by the voltage applied to the cathode electrode and gate electrode is applied to the electron emitting portion, so that electrons are emitted from the electron emitting portion due to a quantum tunnel effect. The electrons are attracted to the display panel (anode panel) by the electrode (anode electrode) formed in the display panel (anode panel), and collide with the fluorescent region. Collision of the electrons with the fluorescent region allows the fluorescent region to emit light, which can be recognized as an image. One or a plurality of electron emitting portions formed or positioned in a region (overlap region) where the projected image of the cathode electrode and the projected image of the gate electrode overlap constitute an electron emitting region.

Examples of substrates and supports include a glass substrate, a glass substrate having an insulating film formed on the surface, a quartz substrate, a quartz substrate having an insulating film formed on the surface, and a semiconductor substrate having an insulating film formed on the surface, and, from the viewpoint of achieving reduction of the production cost, a glass substrate or a glass substrate having an insulating film formed on the surface is preferably used. Examples of materials for the glass substrate include high strain-point glass, soda glass ($Na_2O.CaO.SiO_2$), borosilicate glass ($Na_2O.B_2O_3.SiO_2$), forsterite ($2MgO.SiO_2$), and lead glass ($Na_2O.PbO.SiO_2$).

Examples of constituent materials for the cathode electrode, gate electrode, and focusing electrode include metals, such as aluminum (Al), tungsten (W), niobium (Nb), tantalum (Ta), molybdenum (Mo), chromium (Cr), copper (Cu), gold (Au), silver (Ag), titanium (Ti), nickel (Ni), cobalt (Co), zirconium (Zr), iron (Fe), platinum (Pt), and zinc (Zn); alloys or compounds containing these metal elements (e.g., nitrides, such as TiN, and silicides, such as $WSi_2$, $MoSi_2$, $TiSi_2$, and $TaSi_2$); semiconductors, such as silicon (Si); carbon thin films comprised of diamond or the like; and conductive metal oxides, such as ITO (indium tin oxide), indium oxide, and zinc oxide. Examples of methods for forming these electrodes include combinations of a deposition processes, such as an electron beam deposition process or a hot-filament deposition process, a sputtering process, a CVD process, or an ion plating process and an etching; a screen printing process; a plating process (an electroplating process or an electroless plating process); a lift-off process; a laser abrasion process; and a sol-gel process. For example, the stripe-shaped electrode can be directly formed by a screen printing process or a plating process.

As a constituent material for the insulating layer or interlayer dielectric layer constituting the field emission element, $SiO_2$ materials, such as $SiO_2$, BPSG, PSG, BSG, AsSG, PbSG, SiON, SOG (spin on glass), low melting-point glass, and a glass paste; SiN materials; and insulating resins, such as polyimide, can be used individually or in combination. In formation of the insulating layer or interlayer dielectric layer, a known process, such as a CVD process, a coating process, a sputtering process, a screen printing process, or the like can be used.

A high resistant film may be formed between the cathode electrode and the electron emitting portion. By forming the high resistant film, the cold cathode field emission element having a stabilized operation and uniform electron emission properties can be achieved. Examples of materials constituting the high resistant film include carbon materials, such as silicon carbide (SiC) and SiCN; SiN materials; semiconductor materials, such as amorphous silicon; and high melting-point metal oxides, such as ruthenium oxide ($RuO_2$), tantalum oxide, and tantalum nitride. Examples of methods for forming the high resistant film include a sputtering process, a CVD process, and a screen printing process. The resistance may be generally $1\times10^5$ to $1\times10^7$ Ω, preferably several MΩ.

The planar form of the opening portion formed in the gate electrode or insulating layer (form obtained by cutting the opening portion on a virtual plane parallel with the support surface) may be an arbitrary form, such as a circular form, an elliptic form, a rectangular form, a polygonal form, a round rectangular form, or a round polygonal form. The opening portion can be formed by, for example, isotropic etching or a combination of anisotropic etching and isotropic etching. Alternatively, according to the method for forming the gate electrode, the opening portion can be directly formed in the gate electrode. The opening portion can be formed in the insulating layer or interlayer dielectric layer by, for example, isotropic etching or a combination of anisotropic etching and isotropic etching.

In the cold cathode field emission display device, the space between the anode panel and the cathode panel is a vacuum, and therefore, when no spacer is disposed between the anode panel and the cathode panel, the cold cathode field emission display device may suffer a damage due to atmospheric pressure. The spacer can be comprised of, for example, ceramic. When the spacer is comprised of ceramic, examples of ceramic include mullite, alumina, barium titanate, lead titanate zirconate, zirconia, cordierite, barium borosilicate, iron silicate, glass ceramic materials, and materials obtained by adding to these materials titanium oxide, chromium oxide, iron oxide, vanadium oxide, or nickel oxide. In this case, the spacer can be produced by shaping a so-called green sheet and burning the green sheet, and cutting the green sheet burned product. On the surface of the spacer may be formed a conductive material layer comprised of a metal or an alloy, a high resistant layer, or a thin layer comprised of a material having a low secondary emission coefficient. The spacer may be disposed between the partition and the partition and fixed to them, or spacer holding portions are formed on, for example, the anode panel, and the spacer may be disposed between the spacer holding portion and the spacer holding portion and fixed to them.

When the cathode panel and the anode panel are joined together at their circumferential portions, a bonding layer (including a frit bar) may be used, or a frame comprised of an insulating rigid material, such as glass or ceramic, and a bonding layer may be used in combination for the joint for them. When a frame and a bonding layer are used in combination, by appropriately selecting the height of the frame, the distance between the cathode panel and the anode panel can be large, as compared to the distance obtained when using only the bonding layer. As a constituent material for the bonding layer, frit glass is generally used, but a so-called low melting-point metal material having a melting point of about 120 to 400° C. may be used. Examples of the low melting-point metal materials include In (indium; melting point: 157° C.); indium-gold low melting-point alloys; tin (Sn) high-temperature solder, such as $Sn_{80}Ag_{20}$ (melting point: 220 to 370° C.) and $Sn_{95}Cu_5$ (melting point: 227 to 370° C.); lead (Pb) high-temperature solder, such as $Pb_{97.5}Ag_{2.5}$ (melting point: 304° C.), $Pb_{94.5}Ag_{5.5}$ (melting point: 304 to 365° C.), and $Pb_{97.5}Ag_{1.5}Sn_{1.0}$ (melting point: 309° C.); zinc (Zn) high-temperature solder, such as $Zn_{95}Al_5$ (melting point: 380° C.); tin-lead standard solder, such as $Sn_5Pb_{95}$ (melting point: 300 to 314° C.) and $Sn_2Pb_{98}$ (melting point: 316 to 322° C.); and brazing materials, such as $Au_{88}Ga_{12}$ (melting point: 381° C.)(wherein each subscript represents atomic %).

When the substrate, the support, and the frame are joined together, the three components may be joined simultaneously, or one of the substrate and the support is first joined to the frame at the first stage, and then another one may be joined to the frame at the second stage. As an example of gas constituting the atmosphere used in the joint, there can be mentioned nitrogen gas. After joining together the three components, the space defined by the substrate, support, frame, and bonding layer is evacuated to create a vacuum. The pressure in the atmosphere for the joint may be either atmospheric pressure or a reduced pressure.

The vacuum evacuation can be made through a chip tube preliminarily connected to the substrate and/or the support.

The chip tube is typically comprised of a glass tube, and joined to the periphery of a through hole formed in the ineffective region (i.e., region other than the, effective region which functions as a display portion) of the substrate and/or the support using frit glass or the above-mentioned low melting-point metal material, and cut and sealed by heat melting after the degree of vacuum in the space has reached a predetermined value. It is preferred that, before cutting and sealing the chip tube, the whole of the cold cathode field emission display device is heated and then cooled since the residual gas can be allowed to go into the space and the residual gas can be removed from the space by vacuum evacuation.

In the cold cathode field emission display device, the cathode electrode is connected to a cathode electrode control circuit, the gate electrode is connected to a gate electrode control circuit, and the anode electrode is connected to an anode electrode control circuit. These control circuits can be constituted by a known circuit. The output voltage VA of the anode electrode control circuit is generally constant, and may be, for example, 5 to 10 kV. When the distance between the anode panel and the cathode panel is taken as d (wherein 0.5 mm≦d≦10 mm), a value of VA/d (unit: kV/mm) is desirably 0.5 to 20, preferably 1 to 10, further preferably 5 to 10.

With respect to the voltage VC applied to the cathode electrode and the voltage VG applied to the gate electrode, when a voltage modulation method is used as a gradation control method, there are:

(1) a mode in which the voltage VC applied to the cathode electrode is constant, and the voltage VG applied to the gate electrode is changed;

(2) a mode in which the voltage VC applied to the cathode electrode is changed, and the voltage VG applied to the gate electrode is constant; and (3) a mode in which the voltage VC applied to the cathode electrode is changed, and the voltage VG applied to the gate electrode is changed.

In the present invention, the color filter and the color filter protective film are formed in this order from the side of the substrate between the substrate and the fluorescent region. That is, the color filter is covered with the color filter protective film. Therefore, the color filter can be surely prevented from suffering a damage due to the heat treatment in a reducing atmosphere or a deoxidizing atmosphere in the assembly and fabrication process for various types of display devices. Further, even when the electrons emitted from the electron source penetrate the fluorescent region and collide with the color filter to partially decompose the material constituting the color filter, gas generated by decomposition of the material constituting the color filter is isolated by the color filter protective film, thus making it possible to prevent the gas from adversely affecting the electron source.

In the first embodiment or the second embodiment of the present invention, for obtaining the electrode or a plurality of electrode units, steps for forming an intermediate film, forming a conductive material layer on the intermediate film, and for burning the intermediate film are required. Therefore, the conductive material layer may suffer a damage in these steps, or it may be difficult to lower the production cost for the anode panel. Further, for obtaining a plurality of electrode units, the resist layer must be dried during the formation of the resist layer, and the conductive material layer or the fluorescent region may be removed in the drying step, or the fluorescent particles constituting the fluorescent region may suffer a damage in the wet etching using an acid for the conductive material layer. In addition, when resist layer residue remains after removing the resist layer, gas may be generated from the resist layer residue in the heat treatment step in the subsequent assembly and fabrication process for the display device.

In the third embodiment or the fourth embodiment of the present invention, the electrode is formed on a portion of the substrate on which the fluorescent region is not formed, and is not formed on a portion of the substrate on which the fluorescent region is formed. In other words, in the third embodiment or the fourth embodiment of the present invention, there is no need to form the electrode on the fluorescent region, and therefore, steps for forming an intermediate film, forming a conductive material layer on the intermediate film, and for burning the intermediate film are not required, which is determined depending on the fabrication process although. Therefore, the electrode or electrode unit can be prevented from suffering a damage, and the production cost for the display panel or display device can be reduced. Further, when a resist layer is formed for obtaining a plurality of electrode units, by forming the fluorescent region on the substrate after forming a plurality of electrode units, a phenomenon such that the fluorescent region is removed in the drying step for the resist layer does not occur, and, even when the conductive material layer is subjected to wet etching using, e.g., an acid, the fluorescent particles constituting the fluorescent region suffer no damage. The fluorescent region is not present when removing the resist layer, and hence the resist layer can be surely removed, and no gas is generated from the resist layer residue in the heat treatment step in the subsequent assembly and fabrication process for the display device.

Further, in the third embodiment or the fourth embodiment of the present invention, the area occupied by the electrode in the display panel can be reduced, and therefore the capacity of a kind of capacitor formed from the electron source in the cathode panel and the electrode in the display panel in the display device can be lowered, so that abnormal discharge (vacuum arc discharge) is unlikely to occur between the display panel and the cathode panel. When the electrode is comprised of a plurality of electrode units wherein the electrode unit and the electrode unit are electrically connected to each other through a resistant layer, the capacity of a kind of capacitor formed from the electron source in the cathode panel and the electrode (electrode unit) in the display panel in the display device can be further lowered, so that abnormal discharge (vacuum arc discharge) is further unlikely to occur between the display panel and the cathode panel. In the fourth embodiment of the present invention, when the display panel is fabricated, for example, in the order shown in case No. "69" in Table 6 above, by using, e.g., a material having a high resistance as the material constituting the color filter protective film, abnormal discharge from the electrode or electrode unit can be further effectively suppressed.

In the third embodiment or the fourth embodiment of the present invention, the electrode is formed so as to surround the fluorescent region. Electrons emitted from the electron source are attracted to the display panel due to an electric field generated by the electrode formed in the display panel. Generally, the electrons emitted from the electron source toward the fluorescent region are slow. On the other hand, the electrons close to the display panel are accelerated by the electric field generated by the electrode formed in the display panel and hence fast. As a result, the electrons move toward the fluorescent region rather than the electrode, and the electrons collide with the fluorescent region to allow the fluorescent region to emit light, thus obtaining a desired image.

In the first embodiment or the second embodiment of the present invention, the electrode is present on the fluorescent region, and light emitted from the fluorescent region is reflected in the direction of the substrate by the electrode or electrode unit on the fluorescent region, so that high luminescence of the display device is achieved. On the other hand, in the third embodiment or the fourth embodiment of the present invention, by appropriately determining the amount of the fluorescent particles in the fluorescent region (the thickness of the fluorescent region on the substrate), a display panel or display device having high luminescence can be obtained even when the electrode is not present on the fluorescent region.

DETAILED DESCRIPTION OF THE PREFERRED EMBODIMENTS

Hereinbelow, the present invention will be described with reference to the accompanying drawings and the following Examples.

EXAMPLE 1

Example 1 relates to a display panel and a display device according to the first embodiment of the present invention. More specifically, in Example 1, the display device constitutes a cold cathode field emission display device, the display panel constitutes an anode panel in the cold cathode field emission display device, the electrode constitutes an anode electrode in the anode panel, and the electron source is comprised of a cold cathode field emission element. In the following description, the cold cathode field emission display device is frequently referred to simply as "field emission display device", the display panel is referred to as "anode panel", the electrode is referred to as "anode electrode", and the electron source is referred to as "cold cathode field emission element (field emission element)".

Figure 1:
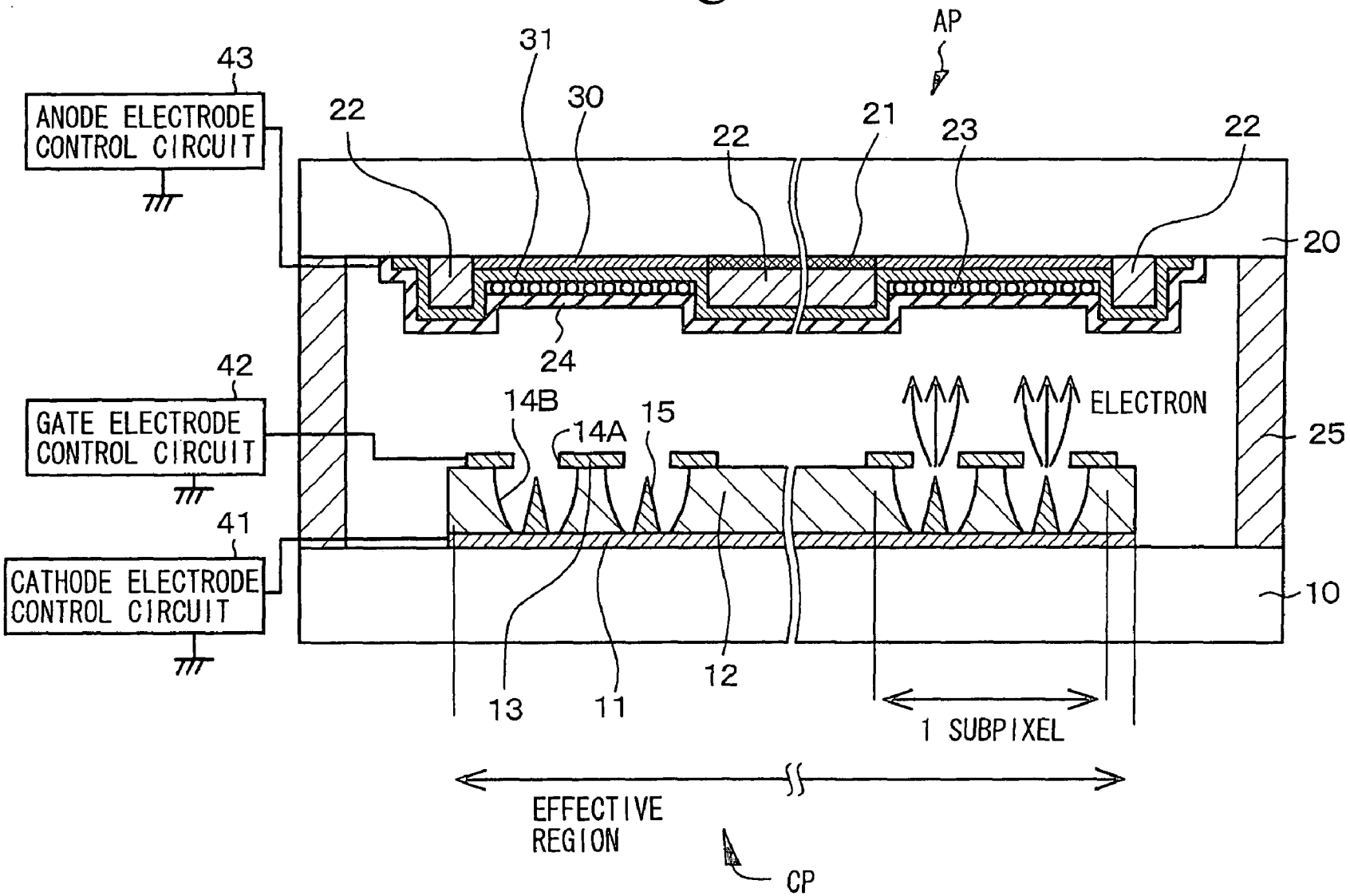
FIG. 1 is a diagrammatic, partial end view of the display device (cold cathode field emission display device) in Example 1.
Figure 4:
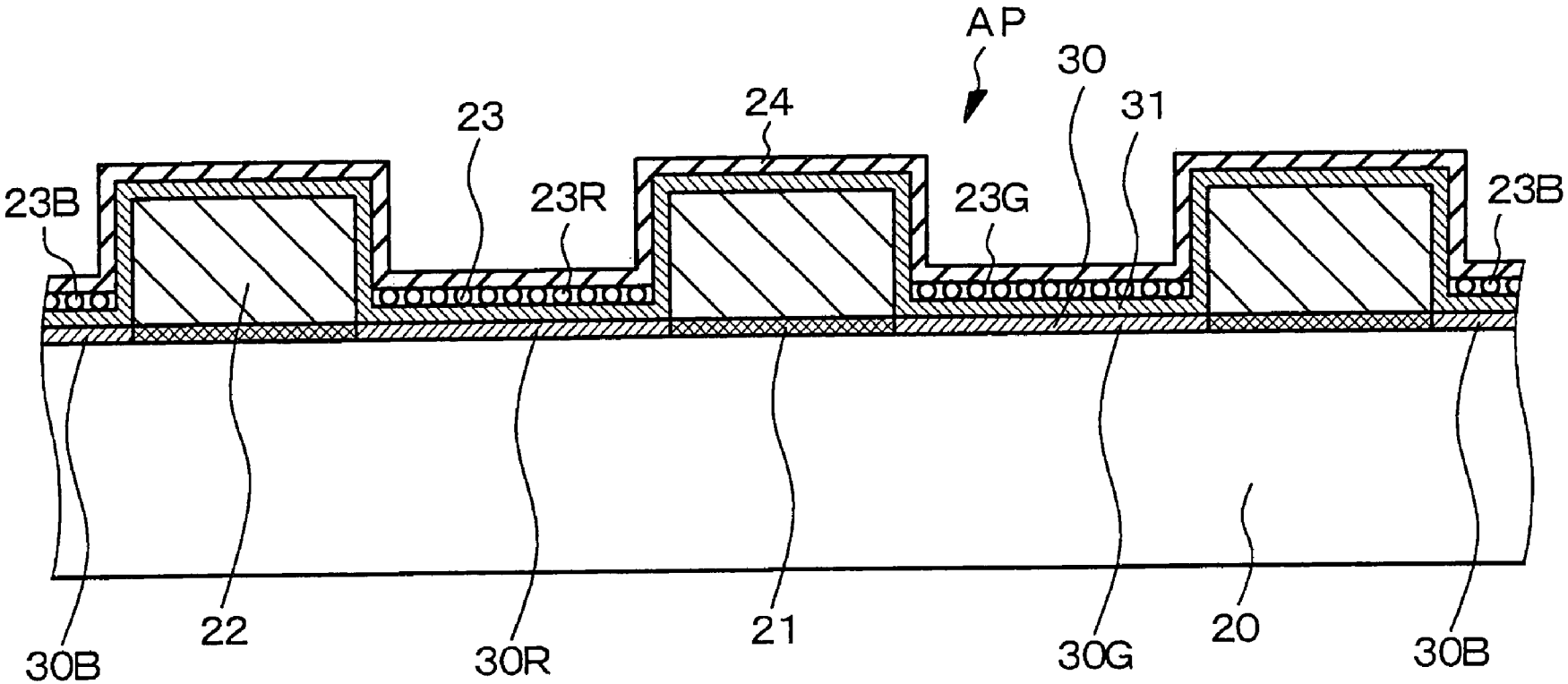
FIG. 4 is a diagrammatic, partial end view of a substrate and the like, subsequent to FIG. 3(B), explaining the fabrication process for the display panel (anode panel constituting the cold cathode field emission display device) in Example 1, namely, a partially enlarged, diagrammatic end view of the display panel (anode panel) in Example 1.
Figure 5:
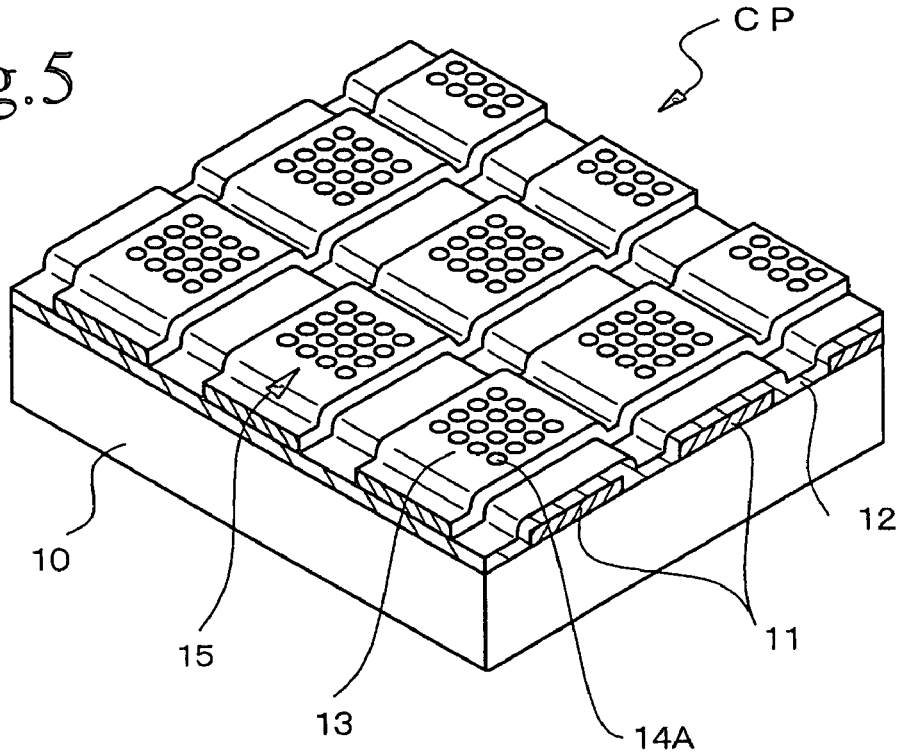
FIG. 5 is a diagrammatic, partial perspective view of the cathode panel in the cold cathode field emission display device.
Figure 6:
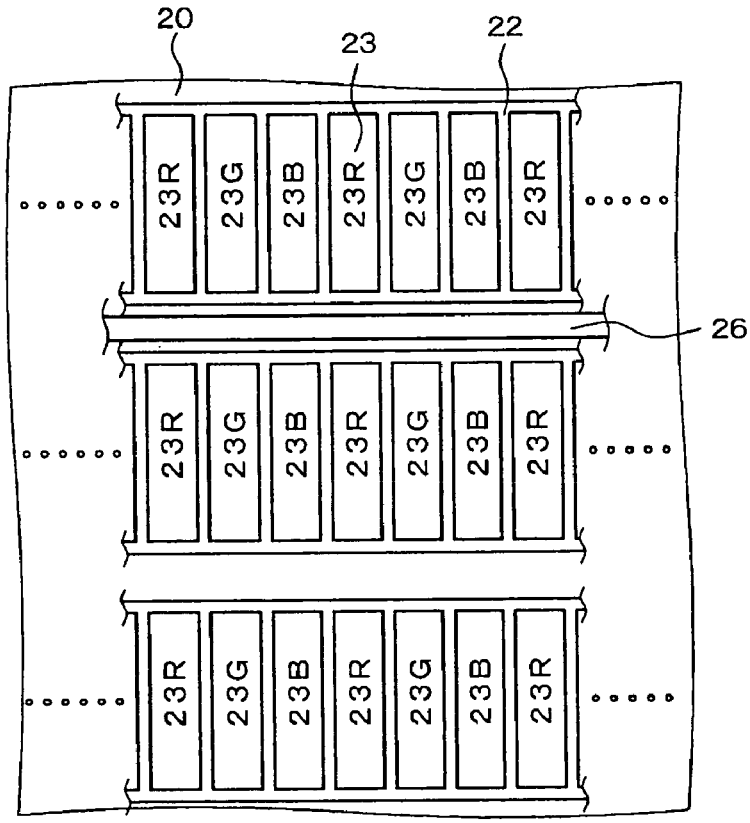
FIG. 6 is a view diagrammatically showing the arrangement of partitions, spacers, and fluorescent regions in the anode panel constituting the cold cathode field emission display device.
Figure 7:
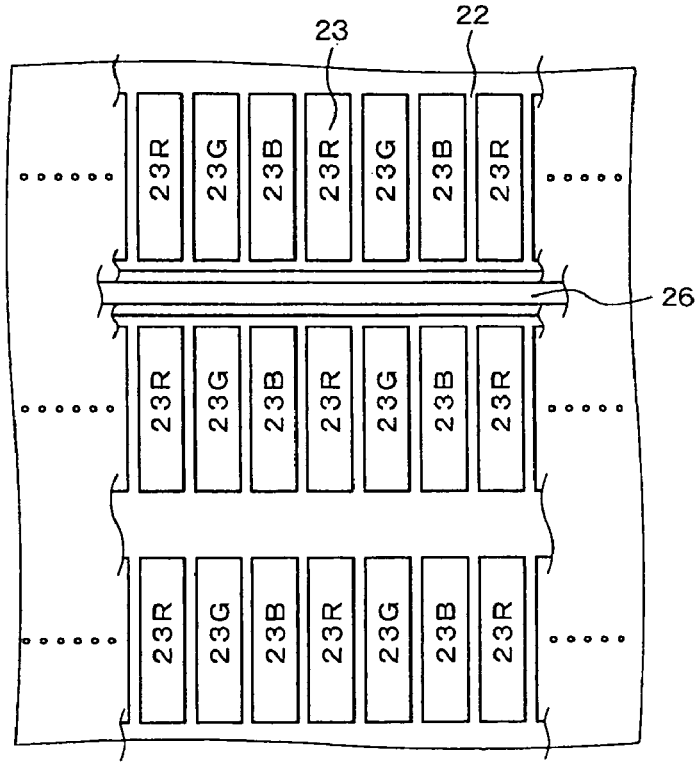
FIG. 7 is a view diagrammatically showing the arrangement of partitions, spacers, and fluorescent regions in the anode panel constituting the cold cathode field emission display device.
Figure 8:
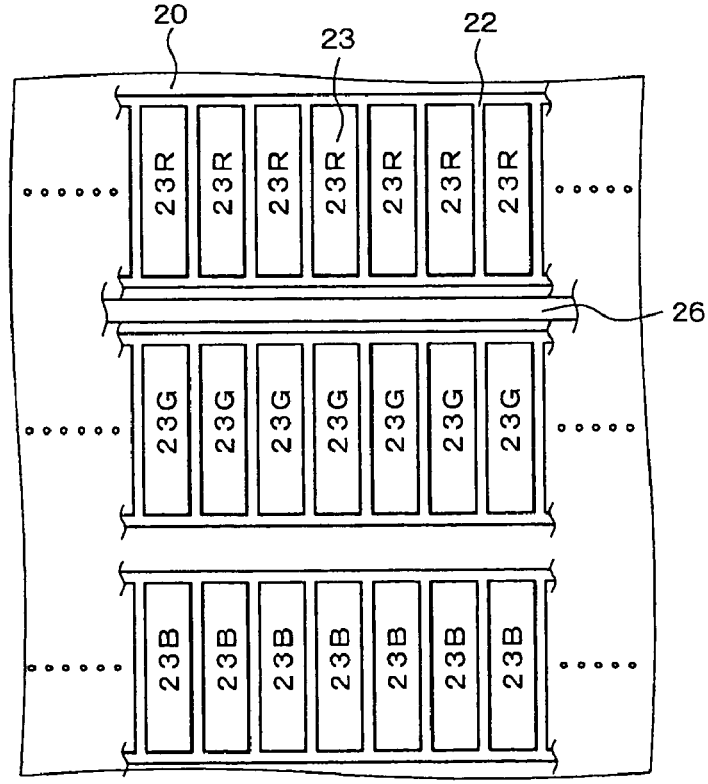
FIG. 8 is a view diagrammatically showing the arrangement of partitions, spacers, and fluorescent regions in the anode panel constituting the cold cathode field emission display device.
Figure 9:
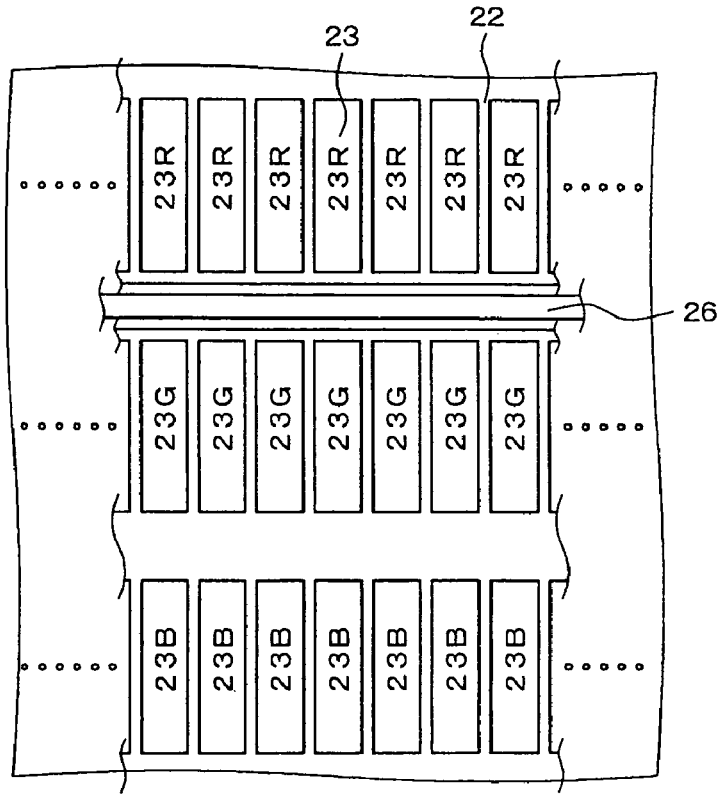
FIG. 9 is a view diagrammatically showing the arrangement of partitions, spacers, and fluorescent regions in the anode panel constituting the cold cathode field emission display device.
Figure 10:
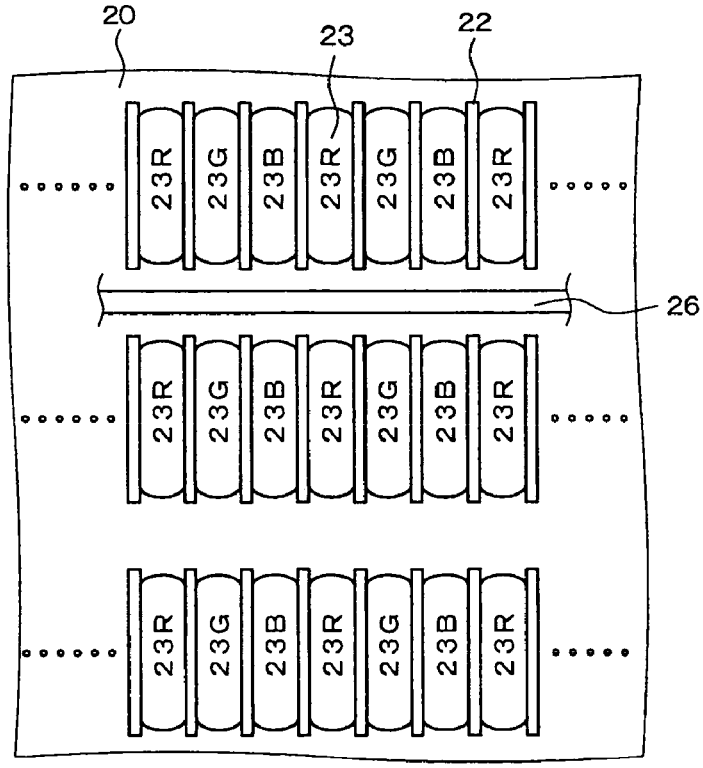
FIG. 10 is a view diagrammatically showing the arrangement of partitions, spacers, and fluorescent regions in the anode panel constituting the cold cathode field emission display device.
Figure 11:
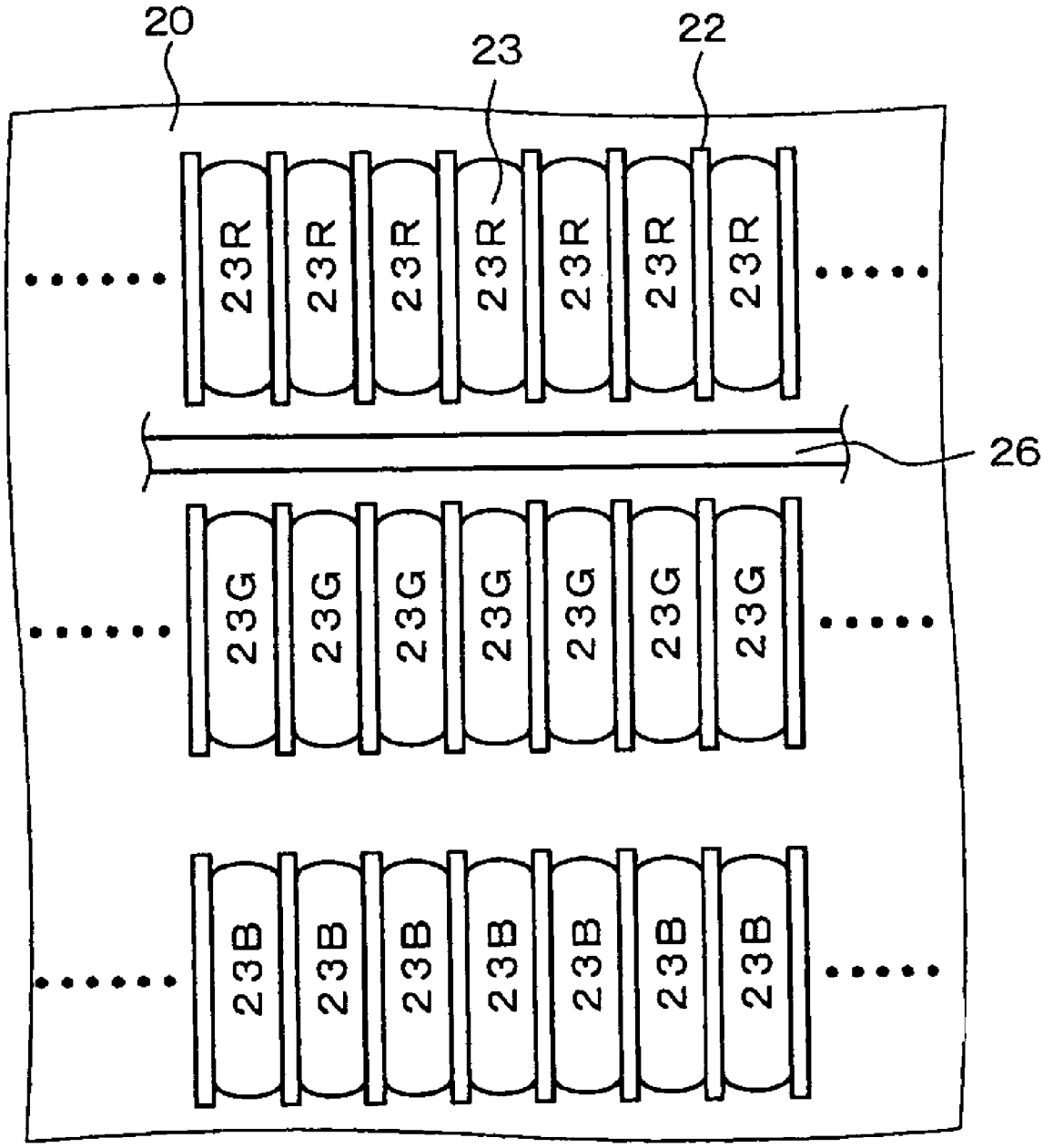
FIG. 11 is a view diagrammatically showing the arrangement of partitions, spacers, and fluorescent regions in the anode panel constituting the cold cathode field emission display device.

A diagrammatic, partial end view of the display device in Example 1 is shown in FIG. 1, a diagrammatic, partial end view of the display panel (anode panel AP) in Example 1 is shown in FIG. 4, and a diagrammatic, partial perspective view of the cathode panel CP is shown in FIG. 5. Further, examples of the arrangement of fluorescent regions and the like are shown in diagrammatic, partial plan views of FIGS. 6 to 11. The arrangement of fluorescent regions and the like in the diagrammatic, partial end view of the anode panel AP corresponds to that shown in FIG. 7 or FIG. 9. In FIGS. 6 to 11, the electrode (anode electrode) is not shown.

The field emission display device in Example 1 is a field emission display device in which the cathode panel CP and the display panel (anode panel AP) are joined together at their circumferential portions through a vacuum layer. The cathode panel CP comprises an electron source (field emission element) formed on a support 10. On the other hand, the display panel (anode panel AP) comprises a plurality of fluorescent regions 23 formed on a substrate 20, and an electrode (anode electrode 24), wherein electrons emitted from the electron source (field emission element) penetrate the electrode (anode electrode 24) and collide with the fluorescent region 23 to allow the fluorescent region 23 to emit light, obtaining a desired image. That is, the field emission display device in Example 1 comprises a cathode panel CP comprised of a plurality of field emission elements each comprising a cathode electrode 11, a gate electrode 13, and an electron emitting portion 15, and the anode panel AP wherein the cathode panel CP and the anode panel AP are joined together at their circumferential portions.

In the display panel (anode panel AP) in Example 1, a black matrix (light absorbing layer) 21 is formed between the fluorescent region 23 and the fluorescent region 23 on the substrate 20. A partition 22 is formed on the black matrix 21. Examples of the arrangement of partitions 22, spacers 26, and fluorescent regions 23 in the anode panel AP are diagrammatically shown in the views of FIGS. 6 to 11. Examples of planar forms of the partition 22 include a lattice form (form of parallel crosses), namely, a form such that the partition surrounds, for example, all the four sides of the fluorescent region 23 having a substantially rectangular form in planar form corresponding to one subpixel (see FIG. 6, FIG. 7, FIG. 8, and FIG. 9), and a strip form (stripe form) extending in parallel with the opposite sides of the substantially rectangular (or stripe-form) fluorescent region 23 (see FIG. 10 and FIG. 11). In the fluorescent region 23 shown in FIG. 10, the fluorescent region (red light-emitting fluorescent region 23R, green light-emitting fluorescent region 23G, and blue light-emitting fluorescent region 23B) may be in a stripe form extending in the longitudinal direction as viewed in FIG. 10.

In Example 1, the electrode (anode electrode 24) is formed on the entire surface within the effective region (region which functions as an actual display portion), specifically, formed on the fluorescent region 23 (including a portion above the fluorescent region 23) and on the partition 22.

A color filter 30 (30R, 30G, 30B) and a color filter protective film 31 are formed in this order from the side of the substrate between the substrate 20 and the fluorescent region 23 (23R, 23G, 23B). The color filter protective film 31 is comprised of $AlN_x$.

The field emission element shown in FIG. 1 is a field emission element having a cone electron emitting portion, i.e., a so-called Spindt-type field emission element. This field emission element comprises a cathode electrode 11 formed on the support 10, an insulating layer 12 formed on the support 10 and the cathode electrode 11, a gate electrode 13 formed on the insulating layer 12, an opening portion 14 formed in the gate electrode 13 and the insulating layer 12 (a first opening portion 14A formed in the gate electrode 13, and a second opening portion 14B formed in the insulating layer 12), and a cone electron emitting portion 15 formed on the cathode electrode 11 at the bottom of the second opening portion 14B. Generally, the cathode electrode 11 and the gate electrode 13 are individually in a stripe form in a direction such that the projected images of these electrodes are perpendicular to each other, and a plurality of field emission elements are generally formed in the region where the projected images of the both electrodes overlap (region corresponding to one subpixel, which is an overlap region or electron emitting region). Further, the electron emitting regions are generally arranged in a two-dimensional matrix form within the effective region (region which functions as an actual display portion) of the cathode panel CP.

One subpixel is comprised of a group of field emission elements formed in the overlap region of the cathode electrode 11 and the gate electrode 13 on the side of the cathode panel, and the fluorescent region 23 on the side of the anode panel (one red light-emitting fluorescent region 23R, one green light-emitting fluorescent region 23G, or one blue light-emitting fluorescent region 23B) opposite to the group of field emission elements. In the effective region, pixels, each pixel being comprised of three subpixels, on the order of, e.g., several hundred thousand to several million are arranged. One pixel is comprised of three subpixels, and each subpixel comprises one red light-emitting fluorescent region 23R, one green light-emitting fluorescent region 23G, or one blue light-emitting fluorescent region 23B.

The anode panel AP and the cathode panel CP are arranged so that the electron emitting region is opposite to the fluorescent region 23, and they are joined together at their circumferential portions through frit bars 25 as bonding layers to fabricate a field emission display device. A through hole (not shown) for vacuum evacuation is formed in the ineffective region surrounding the effective region, and to the through hole is connected a chip tube (not shown) which is cut and sealed after the evacuation. That is, a space defined by the anode panel AP, the cathode panel CP, and the frit bars 25 is a vacuum, and the space constitutes a vacuum layer. Therefore, atmospheric pressure is applied to the anode panel AP and the cathode panel CP. For preventing the field emission display device from suffering a damage due to the atmospheric pressure, a spacer 26 is disposed between the anode panel AP and the cathode panel CP. In FIG. 1, the spacer is not shown. Part of the partition 22 functions also as a spacer holding portion for holding the spacer 26.

A relatively negative voltage is applied to the cathode electrode 11 from a cathode electrode control circuit 41, a relatively positive voltage is applied to the gate electrode 13 from a gate electrode control circuit 42, and a positive voltage higher than that applied to the gate electrode 13 is applied to the anode electrode 24 from an anode electrode control circuit 43. When display is made by the field emission display device, for example, a scan signal is inputted to the cathode electrode 11 from the cathode electrode control circuit 41, and a video signal is inputted to the gate electrode 13 from the gate electrode control circuit 42. Alternatively, conversely, a video signal may be inputted to the cathode electrode 11 from the cathode electrode control circuit 41, and a scan signal may be inputted to the gate electrode 13 from the gate electrode control circuit 42. Electrons are emitted from the electron emitting portion 15 in accordance with a quantum tunnel effect due to an electric field generated when a voltage is applied to a portion between the cathode electrode 11 and the gate electrode 13, and the electrons are attracted to the anode panel AP due to the electric field formed by the anode electrode 24, and collide with the fluorescent region 23, so that the fluorescent region 23 is excited to emit light, thus obtaining a desired image. In other words, the operation of this field emission display device is basically controlled by the voltage applied to the gate electrode 13 and the voltage applied to the electron emitting portion 15 through the cathode electrode 11.

In Example 1, the output voltage VA of the anode electrode control circuit 43 is 7 kV, and the distance d between the anode panel and the cathode panel is 1 mm, and therefore VA/d is 7 (unit: kV/mm).

Hereinbelow, the fabrication process for the display panel (anode panel AP) and display device (cold cathode field emission display device) in Example 1 will be described with reference to FIGS. 2(A) and 2(B), FIGS. 3(A) and 3(B), and FIG. 4, which are diagrammatic, partial end views of a substrate and the like (see case No. "1" in (A) of Table 1).

[Step-100]

Figure 2A:
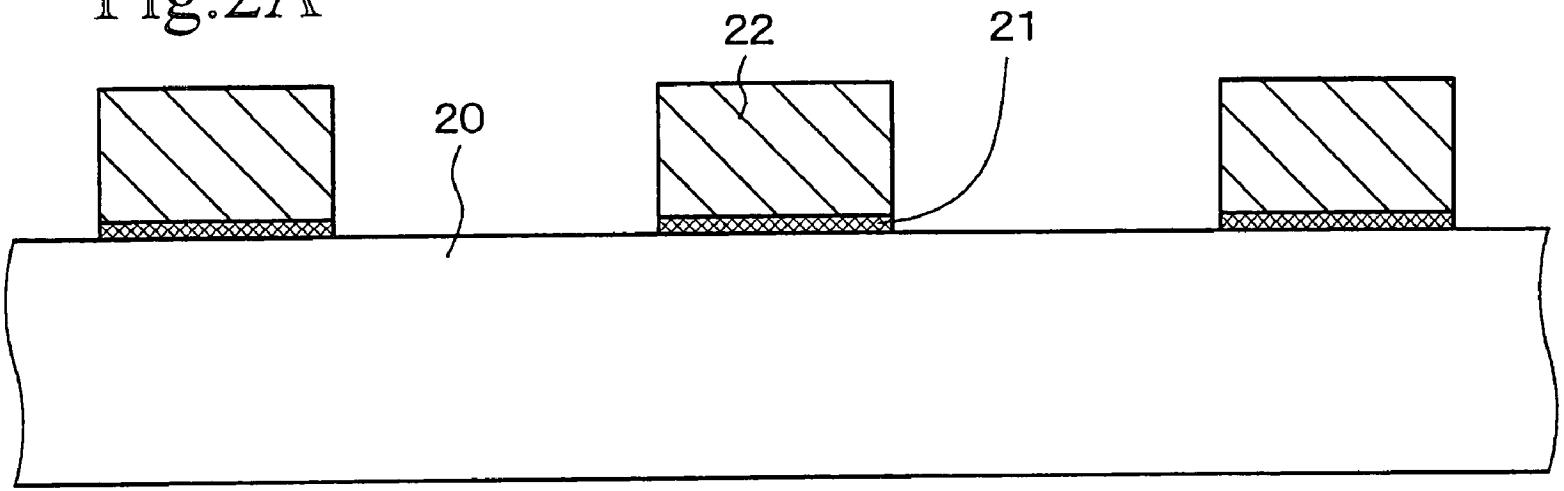
FIGS. 2 (A) and 2 (B) are diagrammatic, partial end views of a substrate and the like, explaining the fabrication process for the display panel (anode panel constituting the cold cathode field emission display device) in Example 1.
Figure 2B:
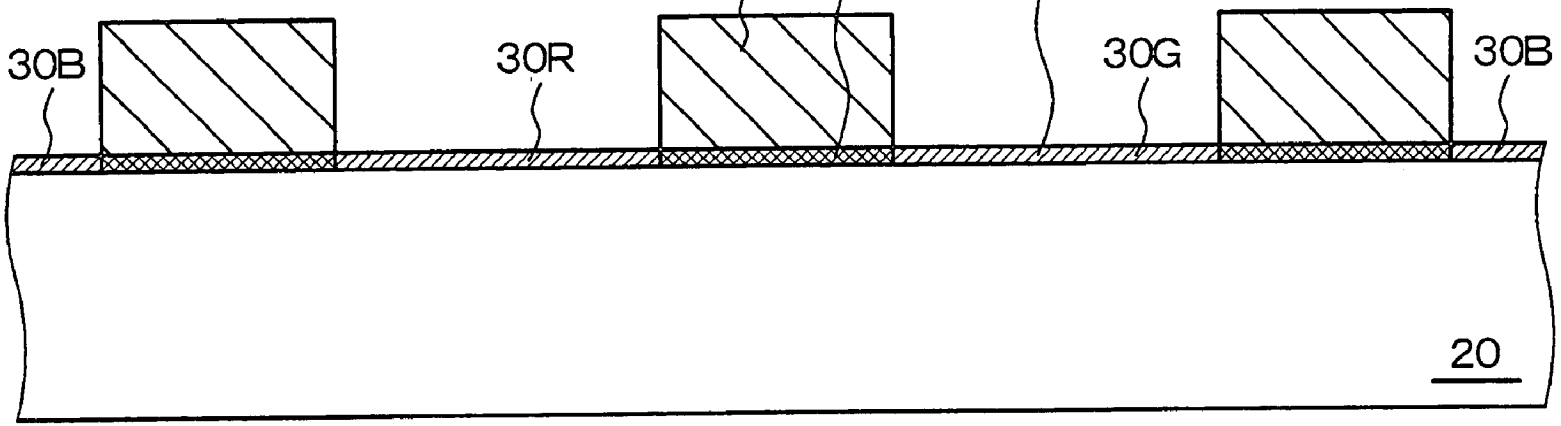
Figure 3A:
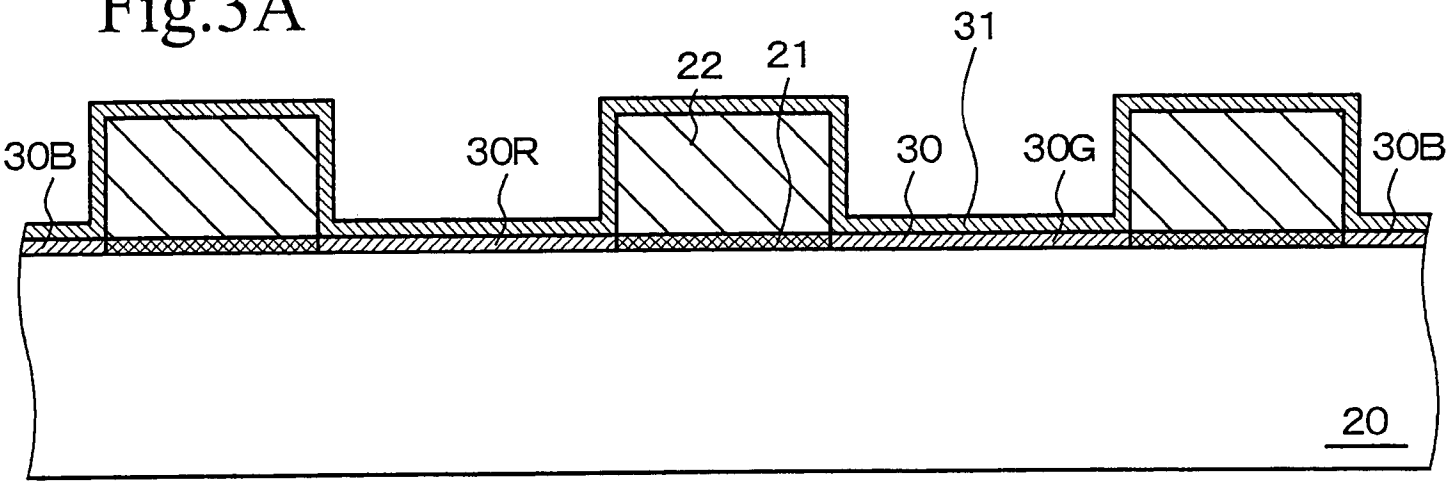
FIGS. 3(A) and 3(B) are diagrammatic, partial end views of a substrate and the like, subsequent to FIG. 2(B), explaining the fabrication process for the display panel (anode panel constituting the cold cathode field emission display device) in Example 1.
Figure 3B:
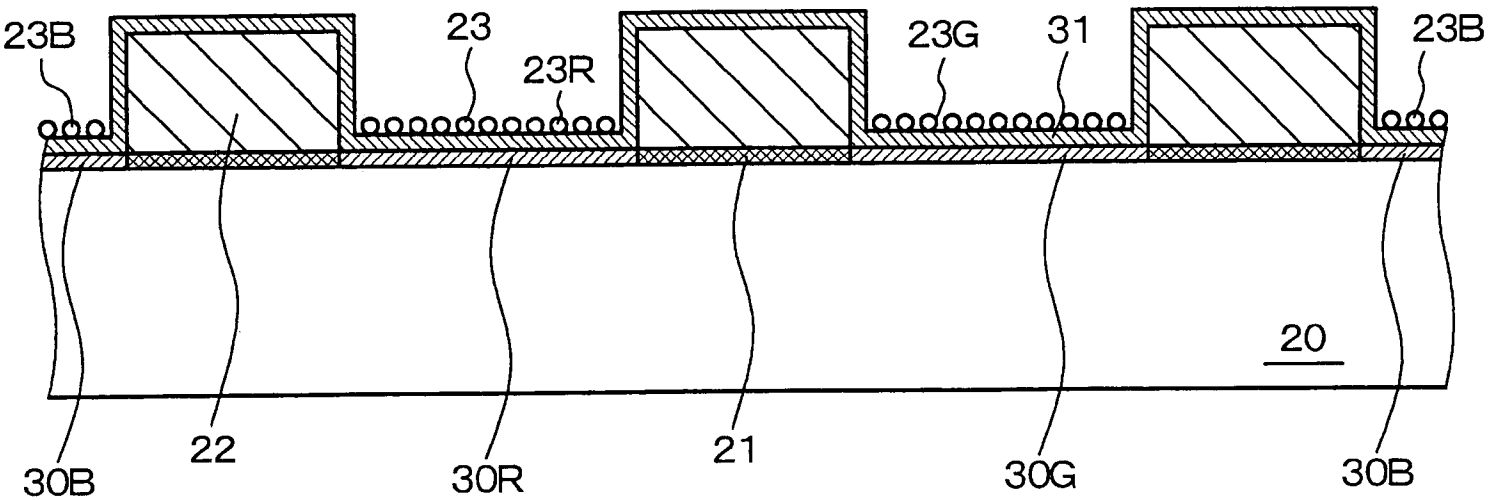

First, a partition 22 is formed on a substrate 20 comprised of a glass substrate (see FIG. 2(A)). The planar form of the partition 22 is a lattice form (form of parallel crosses). Specifically, a photosensitive polyimide resin layer is formed on the entire surface of the substrate 20, and then the photosensitive polyimide resin layer is subjected to exposure and development to obtain the partition 22 having a lattice form (form of parallel crosses)(see, e.g., FIG. 7). Alternatively, a lead glass layer colored black with a metal oxide, such as cobalt oxide, is formed, and then the lead glass layer is selectively processed by a photolithography technique and an etching technique to form a partition. Further alternatively, a low melting-point glass paste may be printed on the substrate 20 by a screen printing process, followed by burning of the low melting-point glass paste, to form a partition. The height of the partition 22 in one subpixel is about 50 μm. Part of the partition functions also as a spacer holding portion for holding a spacer 26. From the viewpoint of improving the contrast of the display image, it is preferred that, before forming the partition 22, a black matrix 21 is formed on the surface of a portion of the substrate 20 on which the partition 22 will be formed.

[Step-110]

Then, for example, a red color filter 30R is first formed. Specifically, a PVA-deuterated chromate sensitizing solution, such as a PVA-ADC sensitizing solution or a PVA-SDC sensitizing solution, or an azide sensitizing solution (e.g., polyvinyl pyrrolidone) is applied to the entire surface, and dried to obtain a sensitizing solution dried product. Then, the sensitizing solution dried product is irradiated with ultraviolet light using a not shown mask, and then developed using pure water to selectively remove the sensitizing solution dried product from a portion of the substrate 20 on which the red color filter 30R will be formed. Next, a suspension containing 10% by weight of a red pigment comprised of iron oxide ($Fe_2O_3$) ultrafine particles (the remaining ingredient is water) is prepared, and the suspension is applied to the entire surface and dried. Then, aqueous hydrogen peroxide is sprayed onto the surface, and then the resultant product is subjected to reversal development using pure water to remove the unnecessary sensitizer dried product and pigment, thus obtaining the red color filter 30R.

Then, a dispersion of a blue pigment comprised of $CoO.Al_2O_3$ ultrafine particles in a PVA-deuterated chromate sensitizing solution is applied to the entire surface and dried, and then irradiated with ultraviolet light using a not shown mask, and developed using pure water to obtain a blue color filter 30B. Subsequently, a dispersion of a green pigment comprised of $TiO_2.ZnO.CoO.NiO$ ultrafine particles in a PVA-deuterated chromate sensitizing solution is applied to the entire surface and dried, and then irradiated with ultraviolet light using a not shown mask, and developed using pure water to obtain a green color filter 30G, thus obtaining a structure shown in FIG. 2(B). The red color filter 30R can also be formed in the same manner.

[Step-120]

Next, a color filter protective film 31 is formed on the entire surface. Specifically, the color filter protective film 31 comprised of $AlN_x$ is formed on the entire surface by a sputtering process, thus obtaining a structure shown in FIG. 3 (A).

[Step-130]

Next, for forming a red light-emitting fluorescent region 23R, a red light-emitting fluorescent slurry, which is obtained by dispersing red light-emitting fluorescent particles in, e.g., a polyvinyl alcohol (PVA) resin and water and adding ammonium deuterated chromate thereto, is applied to the entire surface, and then the red light-emitting fluorescent slurry is dried. Then, a portion of the red light-emitting fluorescent slurry on which the red light-emitting fluorescent region 23R will be formed is irradiated with ultraviolet light from the side of the back surface of the substrate 20 so that the red light-emitting fluorescent slurry is exposed. The red light-emitting fluorescent slurry is gradually cured from the side of the back surface of the substrate 20. The thickness of the red light-emitting fluorescent region 23R to be formed is determined by the irradiation dose of ultraviolet light to the red light-emitting fluorescent slurry. The red light-emitting fluorescent slurry is then developed to form the red light-emitting fluorescent region 23R between the predetermined partitions 22. Subsequently, a green light-emitting fluorescent slurry is subjected to similar treatment to form a green light-emitting fluorescent region 23G, and further a blue light-emitting fluorescent slurry is subjected to similar treatment to form a blue light-emitting fluorescent region 23B, thus obtaining a structure shown in FIG. 3(B). The thickness of the fluorescent region 23 is 3.5 to 10 μM.

[Step-140]

Then, an intermediate film is formed on the entire surface by a screen printing process. The resin (lacquer) constituting the intermediate film is comprised of a kind of varnish in a broad sense, e.g., a solution of a composition comprised mainly of a cellulose derivative, generally nitrocellulose in a volatile solvent, such as a lower fatty acid ester, or an urethane lacquer or acrylic lacquer using another synthetic polymer. The intermediate film is then dried.

[Step-150]

Then, a conductive material layer is formed on the intermediate film. Specifically, a conductive material layer comprised of aluminum (Al) is formed by a vacuum deposition process so as to cover the intermediate film. The average thickness of the conductive material layer is 0.07 μm.

[Step-160]

Next, the intermediate film is burned at about 400° C. In the burning treatment, the intermediate film is burned up, so that an anode electrode 24 comprised of the conductive material layer remains on the fluorescent region 23 and the partition 22. Gas generated due to burning of the intermediate film is discharged through fine pores formed in, for example, the region of the conductive material layer bending along the form of the partition 22. Thus, an anode panel AP having a structure shown in FIG. 4 can be obtained.

[Step-170]

A cathode panel CP having formed field emission elements is prepared. Then, a field emission display device is assembled. Specifically, a spacer 26 is fitted to a spacer holding portion formed in, for example, the effective region of the anode panel AP, and the anode panel AP and the cathode panel CP are arranged so that the fluorescent region 23 is opposite to the field emission element, and the anode panel AP and the cathode panel CP (more specifically, the substrate 20 and the support 10) are joined together at their circumferential portions through frit bars 25 as bonding layers. In the joint for them, the frit bars 25 are disposed between the anode panel AP and the cathode panel CP, followed by burning of the frit bars 25 in a deoxidizing atmosphere (specifically, in a nitrogen gas atmosphere). Then, a space defined by the anode panel AP, the cathode panel CP, and the frit bars 25 is evacuated using a through hole (not shown) and a chip tube (not shown), and, at a point in time when the pressure in the space has reached about $10^{-4}$ Pa, the chip tube is cut and sealed by heat melting. In this way, the space defined by the anode panel AP, the cathode panel CP, and the frit bars 25 can be a vacuum, thus obtaining a field emission display device shown in FIG. 1. Alternatively, according to the structure of the field emission display device, the anode panel AP and the cathode panel CP may be laminated together using a frame comprised of an insulating rigid material, such as glass or ceramic, and a bonding layer in combination. Then, wiring connection to a necessary external circuit is made, thus completing the field emission display device.

In Example 1, in the [step-170], the color filter 30 (especially, red color filter 30R) suffered no damage during the burning of frit glass. For comparison, the [step-120] was omitted and an anode panel having no color filter protective film 31 formed was prepared to fabricate a field emission display device. As a result, in the [step-170], the color filter 30 (especially, red color filter 30R) suffered a damage during the burning of frit glass. That is, oxygen atoms in $Fe_2O_3$ particles constituting the red color filter 30R were eliminated (i.e., deoxidized) during the burning of frit glass in a deoxidizing atmosphere, so that the red color filter 30R was not able to function appropriately.

Hereinbelow, the fabrication process for a Spindt-type field emission element will be described with reference to FIGS. 12(A) and 12(B) and FIGS. 13(A) and 13(B), which are diagrammatic, partial end views of the support 10 and the like constituting the cathode panel.

The Spindt-type field emission element, basically, can be obtained by a method in which the cone electron emitting portion 15 is formed by vertical evaporation of a metal material. Specifically, evaporated particles enter in the vertical direction the first opening portion 14A formed in the gate electrode 13, but, utilizing a shielding effect of an overhang-form deposit formed near the opening end of the first opening portion 14A, the amount of the evaporated particles which reach the bottom of the second opening portion 14B is gradually reduced, so that the electron emitting portion 15 as a cone deposit is self-coordinately formed. Here, a method in which a release layer 16 is preliminarily formed on the gate electrode 13 and the insulating layer 12 for facilitating removal of the unnecessary overhang-form deposit is described. In the drawings for explaining the fabrication process for the field emission element, one electron emitting portion is solely shown.

[Step-A0]

First, a conductive material layer for cathode electrode comprised of, e.g., polysilicon is deposited by a plasma CVD process on a support 10 comprised of, e.g., a glass substrate, and then the conductive material layer for cathode electrode is patterned in accordance with a lithography technique and a dry etching technique to form a stripe-shaped cathode electrode 11. Then, an insulating layer 12 comprised of $SiO_2$ is formed on the entire surface by a CVD process.

[Step-A1]

Next, a conductive material layer for gate electrode (e.g., TiN layer) is deposited on the insulating layer 12 by a sputtering process, and then the conductive material layer for gate electrode is patterned in accordance with a lithography technique and a dry etching technique to obtain a stripe-shaped gate electrode 13. The stripe-shaped cathode electrode 11 extends in the direction parallel with the plane of the drawing, and the stripe-shaped gate electrode 13 extends in the direction perpendicular to the plane of the drawing.

The gate electrode 13 may be formed by, if necessary, a combination of a known thin film forming method, e.g., a PVD process, such as a vacuum deposition process; a CVD process; a plating process, such as an electroplating process or an electroless plating process; a screen printing process; a laser abrasion process; a sol-gel process; or a lift-off process, and an etching technique. For example, a stripe-shaped gate electrode can be directly formed by a screen printing process or a plating process.

[Step-A2]

Figure 12A:
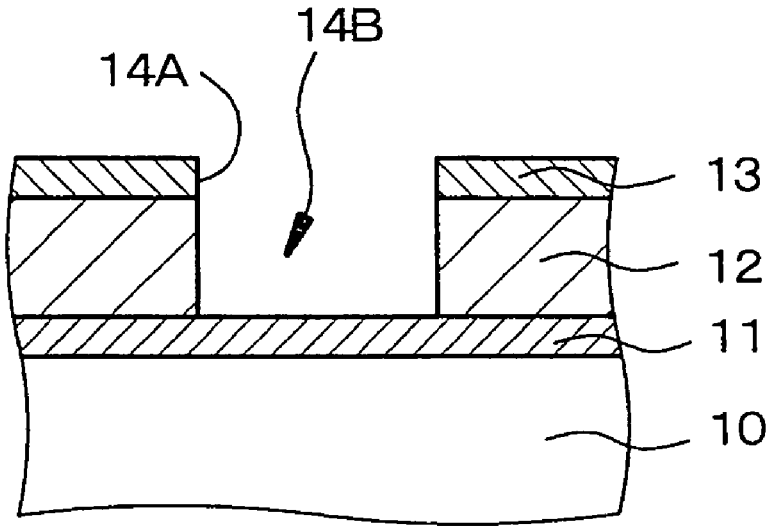
FIGS. 12(A) and 12(B) are diagrammatic, partial end views of a support and the like, explaining the fabrication process for a Spindt-type cold cathode field emission element.

Then, a resist layer is formed again, and a first opening portion 14A is formed in the gate electrode 13 by etching, and further a second opening portion 14B is formed in the insulating layer so that the cathode electrode 11 is exposed at the bottom of the second opening portion 14B, followed by removal of the resist layer, thus obtaining a structure shown in FIG. 12(A).

[Step-A3]

Figure 12B:
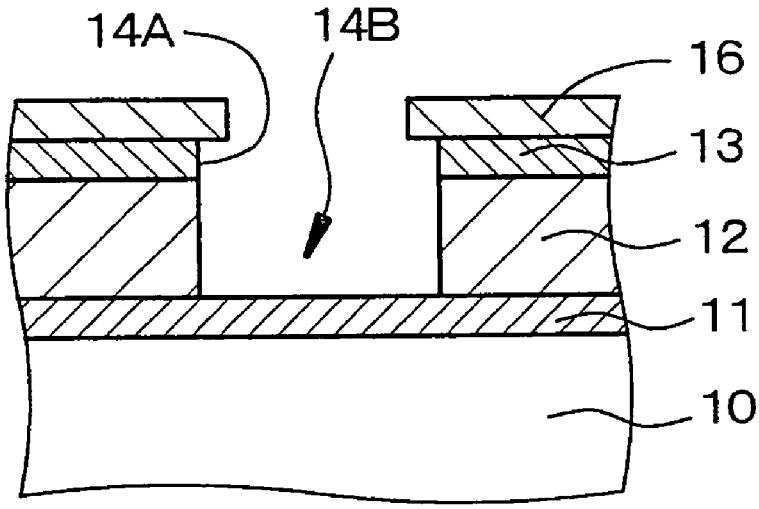

Next, nickel (Ni) is deposited on the insulating layer 12 including the gate electrode 13 by oblique incident vacuum deposition while spinning the support 10 to form a release layer 16 (see FIG. 12(B)). In this instance, by selecting a satisfactorily large incident angle of the evaporated particles to the normal of the support 10 (for example, at an incident angle of 65 to 85°), the release layer 16 can be formed on the gate electrode 13 and insulating layer 12 so that almost no nickel is deposited on the bottom of the second opening portion 14B. The release layer 16 protrudes like eaves from the opening end of the first opening portion 14A, so that the diameter of the first opening portion 14A is substantially reduced.

[Step-A4]

Figure 13A:
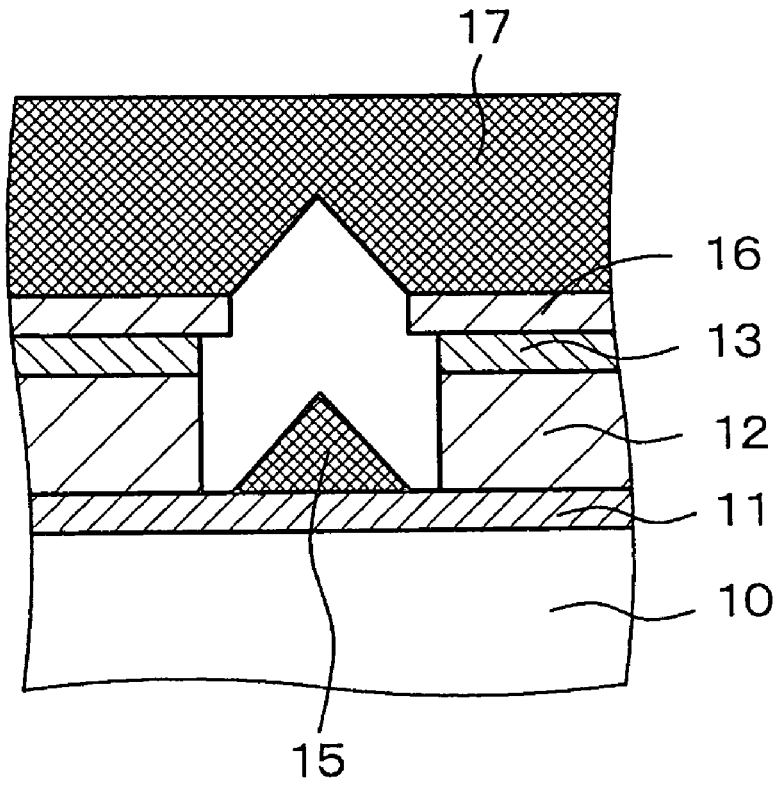
FIGS. 13(A) and 13(B) are diagrammatic, partial end views of a support and the like, subsequent to FIG. 12(B), explaining the fabrication process for a Spindt-type cold cathode field emission element.

Next, for example, molybdenum (Mo) as a conductive material is deposited on the entire surface by vertical evaporation (at an incident angle of 3 to 10°). In this instance, as shown in FIG. 13(A), as a conductive layer 17 having an overhang form grows on the release layer 16, the substantial diameter of the first opening portion 14A is gradually reduced, and therefore the evaporated particles for forming a deposit on the bottom of the second opening portion 14B gradually pass only near the center of the first opening portion 14A, so that a cone deposit is formed on the bottom of the second opening portion 14B and the cone deposit constitutes the electron emitting portion 15.

[Step-A5]

Figure 13B:
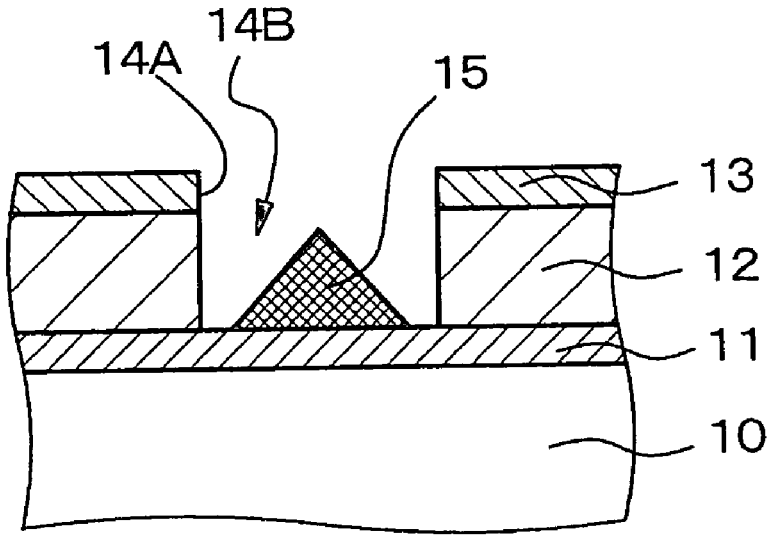

Then, as shown in FIG. 13(B), the release layer 16 is removed by a lift-off process from the surface of the gate electrode 13 and the insulating layer 12 to selectively remove the conductive layer 17 over the gate electrode 13 and the insulating layer 12. Then, the sidewall surface of the second opening portion 14B formed in the insulating layer 12 is preferably etched by isotropic etching from the viewpoint of exposing the opening end of the gate electrode 13. The isotropic etching can be made by dry etching using radicals as main etching species, such as chemical dry etching, or wet etching using an etching solution. As the etching solution, for example, a 1:100 (volume ratio) mixed solution of a 49% aqueous solution of hydrofluoric acid and pure water can be used. Thus, the cathode panel having a plurality of Spindt-type field emission elements formed can be obtained.

EXAMPLE 2

Example 2 relates to a display panel and a display device according to the second embodiment of the present invention. More specifically, like in Example 1, in Example 2, the display device constitutes a field emission display device, the display panel constitutes an anode panel in the field emission display device, the electrode constitutes an anode electrode in the anode panel, and the electron source is comprised of a field emission element.

Figure 14:
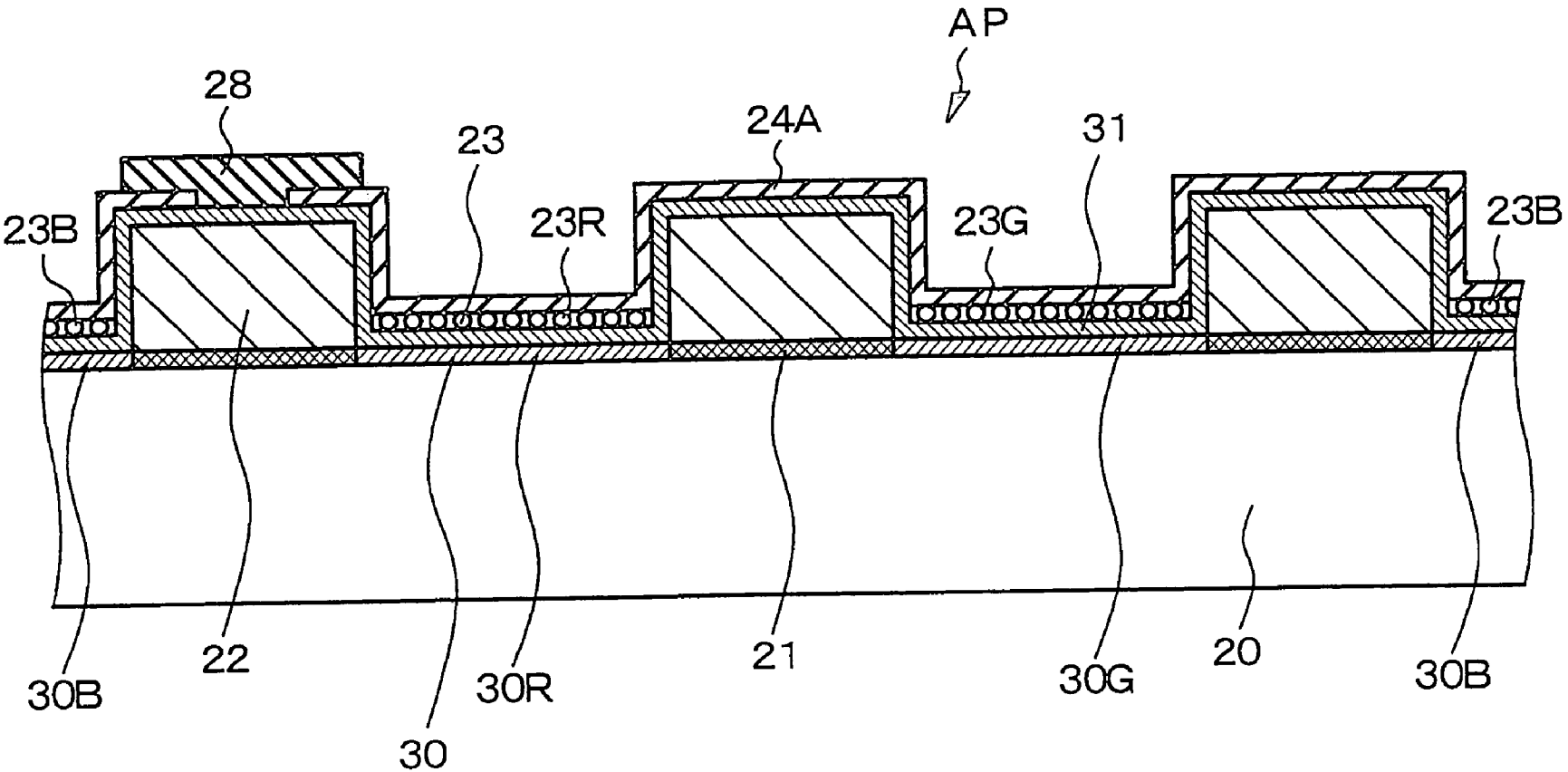
FIG. 14 is a partially enlarged, diagrammatic end view of the display panel (anode panel) in Example 2.

A partially enlarged, diagrammatic partial end view of an anode panel AP constituting the field emission display device in Example 2 is shown in FIG. 14. A diagrammatic, partial perspective view of a cathode panel CP is similar to that shown in FIG. 5. In Example 2 or Examples 3 to 6 mentioned below, with respect to the arrangement of fluorescent regions and the like, for example, those shown in FIGS. 6 to 11 can be employed, and therefore the detailed description is omitted. In addition, in Example 2 or Examples 3 to 6 mentioned below, with respect to the construction and structure of the cathode panel CP in the field emission display device and the driving method for the field emission display device, the construction and structure of the cathode panel CP in the field emission display device and the driving method for the field emission display device in Example 1 can be employed, and therefore the detailed description is omitted.

The field emission display device in Example 2 is also a field emission display device in which the cathode panel CP and the display panel (anode panel AP) are joined together at their circumferential portions through a vacuum layer. The cathode panel CP comprises an electron source (field emission element) formed on a support 10. The display panel (anode panel AP) in Example 2 also comprises a fluorescent region 23 (23R, 23G, 23B) formed on a substrate 20, and an electrode (anode electrode) formed on the fluorescent region 23, wherein electrons emitted from the electron source (field emission element) penetrate the electrode (anode electrode) and collide with the fluorescent region 23 to allow the fluorescent region 23 to emit light, obtaining a desired image. That is, the field emission display device in Example 2 also comprises the cathode panel CP comprised of a plurality of field emission elements each comprising a cathode electrode 11, a gate electrode 13, and an electron emitting portion 15, and the anode panel AP wherein the cathode panel CP and the anode panel AP are joined together at their circumferential portions. This applies to Examples 3 to 6 mentioned below.

In Example 2, a color filter 30 (30R, 30G, 30B) and a color filter protective film 31 are formed in this order from the side of the substrate between the substrate 20 and the fluorescent region 23 (23R, 23G, 23B). The color filter protective film 31 is comprised of $AlN_x$.

Further, in Example 2, the electrode (anode electrode) is formed on the entire surface within the effective region (region which functions as an actual display portion), specifically, formed on the fluorescent region 23 (including a portion above the fluorescent region 23) and on the partition 22. Differing from Example 1, the electrode (anode electrode) is comprised of a plurality of electrode units. In the following description, the electrode unit is referred to as "anode electrode unit 24A". The anode electrode unit 24A and the anode electrode unit 24A are electrically connected to each other through a resistant layer 28. In Example 2, the number of the anode electrode units 24A is equal to the number of pixels (one third of the number of subpixels), but is not limited to this.

The resistant layer 28 is comprised of silicon carbide (SiC). In Example 2, the electrode unit (anode electrode unit 24A) is formed on the top surface of the partition 22, on the sidewall of the partition 22, and on the fluorescent region 23, and the boundary of the anode electrode unit 24A is positioned on the top surface of the partition 22. The resistant layer 28 is formed on the anode electrode unit 24A at least on the top surface of the partition 22 (more specifically, on the anode electrode unit 24A positioned on the top surface of the partition 22). The average thickness of the electrode unit (anode electrode unit 24A) comprised of molybdenum (Mo) on the top surface of the partition 22 is 0.3 μm, and the average thickness of the resistant layer 28 on the top surface of the partition 22 is 0.33 μm. The sheet resistance of the resistant layer 28 is about $4\times10^5$ Ω/□.

The display panel (anode panel AP) in Example 2 can be obtained in a method in which, subsequent to the same step as the [step-160] in Example 1, the conductive material layer is patterned to form a recess in a portion of the conductive material layer positioned on the top surface of the partition 22, obtaining an anode electrode unit 24A, and then further a resistant layer 28 is formed on the entire surface, followed by patterning of the resistant layer 28, or a resistant layer 28 can be obtained in accordance with an oblique incident vacuum deposition process {see case No. "1" in (B) of Table 1}. Alternatively, the display panel (anode panel AP) can be fabricated by a method in which, subsequent to the same step as the [step-130] in Example 1, a resistant layer is formed on the top surface or the top surface and sidewall of the partition 22, and then the same steps as the [step-140] through [step-160] in Example 1 are carried out, and then the conductive material layer is patterned to form a recess in a portion of the conductive material layer positioned on the top surface of the partition 22, obtaining an anode electrode unit 24A (see case No. "2" in (B) of Table 1). In this case, the anode electrode unit 24A is positioned on the resistant layer.

Alternatively, the display panel (anode panel AP) can be fabricated by a method in which, subsequent to the same step as the [step-100] in Example 1, a resistant layer is formed on the top surface or the top surface and sidewall of the partition 22, and then the same steps as the [step-110] through [step-160] in Example 1 are carried out, and then the conductive material layer is patterned to form a recess in a portion of the conductive material layer positioned on the top surface of the partition 22, obtaining an anode electrode unit 24A (see case No. "3" in (B) of Table 1). Also in this case, the anode electrode unit 24A is positioned on the resistant layer.

In Example 2, in the step similar to the [step-170], the color filter 30 (especially, red color filter 30R) suffered no damage during the burning of frit glass. For comparison, the step similar to the [step-120] was omitted and an anode panel having no color filter protective film formed was prepared to fabricate a field emission display device. As a result, in the [step-170], the color filter 30 (especially, red color filter 30R) suffered a damage during the burning of frit glass. That is, oxygen atoms in $Fe_2O_3$ particles constituting the red color filter 30R were eliminated (i.e., deoxidized) during the burning of frit glass in a deoxidizing atmosphere, so that the red color filter 30R was not able to function appropriately.

EXAMPLE 3

Example 3 relates to a display panel and a display device according to the third embodiment of the present invention. More specifically, like in Example 1, in Example 3, the display device constitutes a field emission display device, the display panel constitutes an anode panel in the field emission display device, the electrode constitutes an anode electrode in the anode panel, and the electron source is comprised of a field emission element.

Figure 15:
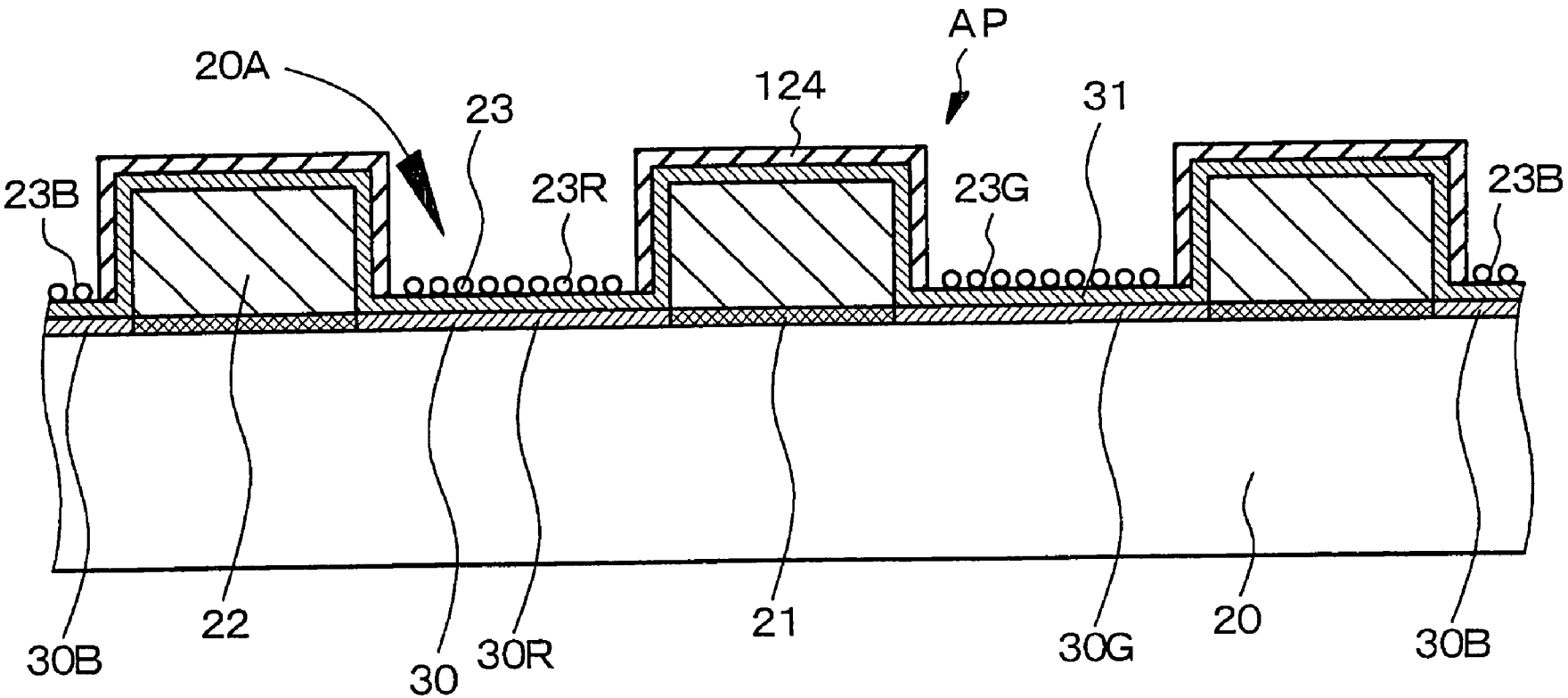
FIG. 15 is a partially enlarged, diagrammatic end view of the display panel (anode panel) in Example 3.
Figure 16:
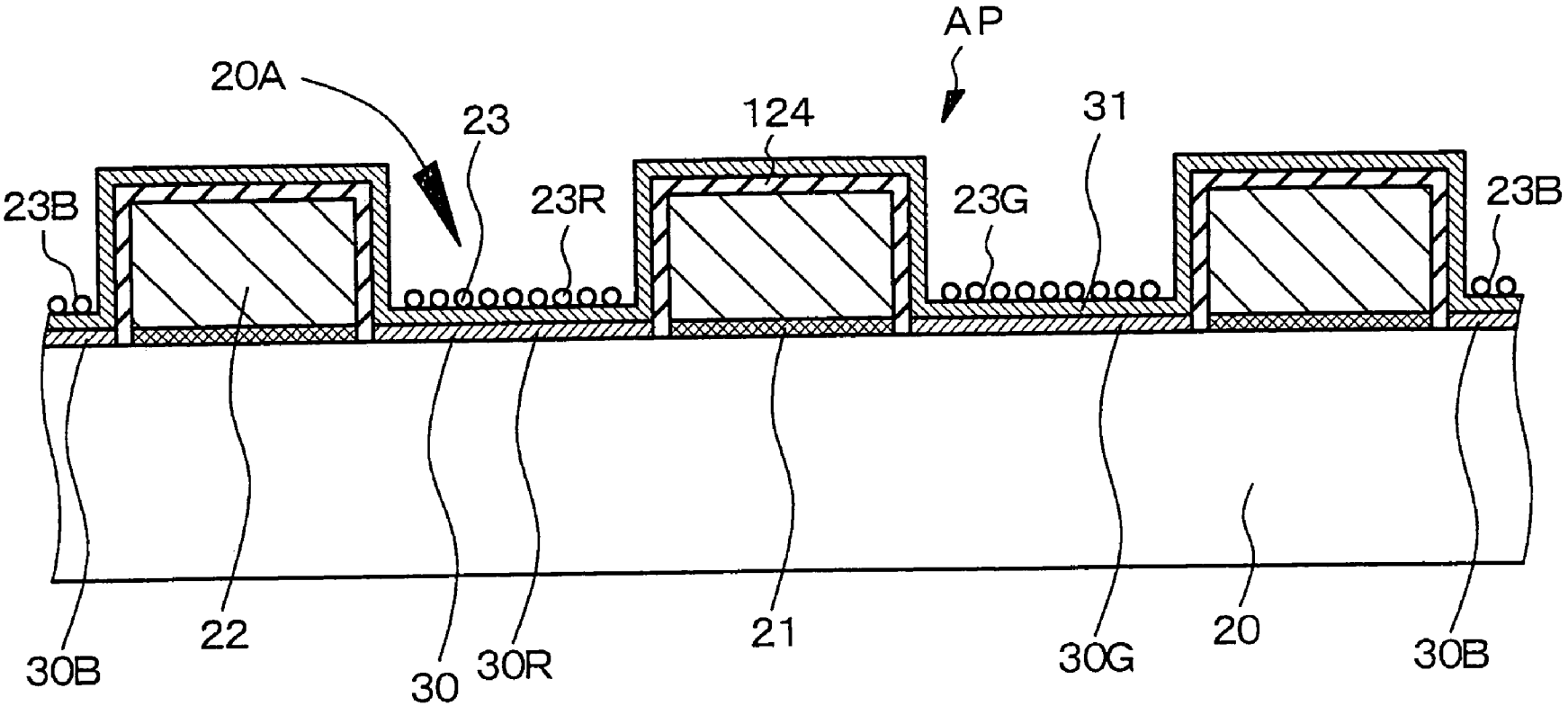
FIG. 16 is a partially enlarged, diagrammatic end view of an example of variation of the display panel (anode panel) in Example 3.

A partially enlarged, diagrammatic partial end view of an anode panel AP constituting the field emission display device in Example 3 is shown in FIG. 15 or FIG. 16.

In Example 3, a color filter 30 (30R, 30G, 30B) and a color filter protective film 31 are formed in this order from the side of the substrate between the substrate 20 and the fluorescent region 23 (23R, 23G, 23B). The color filter protective film 31 is comprised of $AlN_x$.

In Example 3, an electrode (anode electrode 124) is formed on a portion of the substrate 20, on which the fluorescent region 23 is not formed, within the effective region (region which functions as an actual display portion) (more specifically, formed on the top surface and sidewall of the partition 22 formed on the substrate 20, and further formed on a portion of the substrate 20 on which the fluorescent region 23 is not formed), and is not formed on a portion 20A of the substrate 20 on which the fluorescent region 23 is formed. The average thickness of the electrode (anode electrode 124) on the top surface of the partition 22 is 0.1 μm. The average thickness of the fluorescent region 23 is about 10 μm.

The display panel (anode panel AP) in Example 3 shown in FIG. 15 can be fabricated by the following method (see case No. "1" in (C) of Table 1).

[Step-300A]

First, the same steps as the [step-100] through [step-160] in Example 1 are carried out.

[Step-310A]

Then, the conductive material layer is patterned to remove the conductive material layer on the fluorescent region 23 so that a portion of the conductive material layer positioned on the top surface and sidewall of the partition 22 remains, thus obtaining an anode electrode 124.

The display panel (anode panel AP) in Example 3 shown in FIG. 16 can be fabricated by the following method (see case No. "4" in (C) of Table 1).

[Step-300B]

First, formation of a black matrix 21 and formation of a partition 22 corresponding to the step similar to the [step-100] in Example 1 are carried out.

[Step-310B]

Then, an electrode (anode electrode 124) is formed on a portion of the substrate 20 on which the fluorescent region 23 is not formed. It is noted that the electrode is not formed on a portion 20A of the substrate 20 on which the fluorescent region 23 will be formed. Specifically, an electrode (anode electrode 124) comprised of a conductive material layer comprised of molybdenum (Mo) is formed by an oblique incident vacuum deposition process on the top surface and sidewall of the partition 22 formed on the substrate 20 so that the electrode (anode electrode 124) is not formed on the portion 20A of the substrate 20 surrounded by the partition 22.

[Step-320B]

Then, formation of a color filter 30 (30R, 30G, 30B) and formation of a color filter protective film 31 corresponding to the steps similar to the [step-110] through [step-120] in Example 1 are carried out.

[Step-330B]

Then, formation of a fluorescent region 23 (23R, 23G, 23B) corresponding to the step similar to the [step-130] in Example 1 is carried out to obtain the display panel (anode panel AP) in Example 3 shown in FIG. 16.

Alternatively, the display panel (anode panel AP) in Example 3 can be fabricated in accordance with the order of steps shown in case No. "2" or case No. "3" in (C) of Table 1.

EXAMPLE 4

The display panel (anode panel) and display device (cold cathode field emission display device) in Example 4 are variations of the display panel (anode panel) and display device (cold cathode field emission display device) in Example 3.

Figure 17:
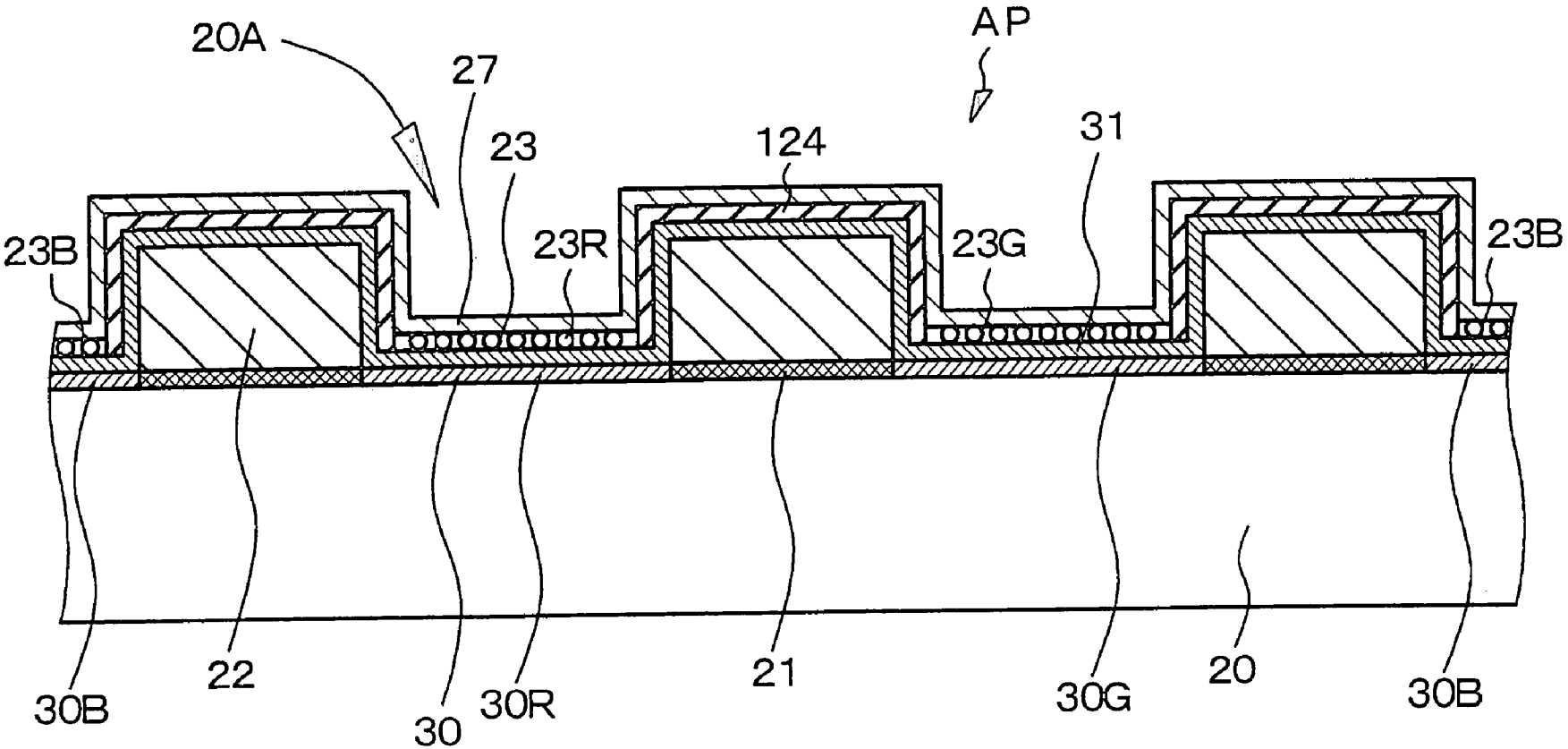
FIG. 17 is a partially enlarged, diagrammatic end view of the display panel (anode panel) in Example 4.
Figure 18:
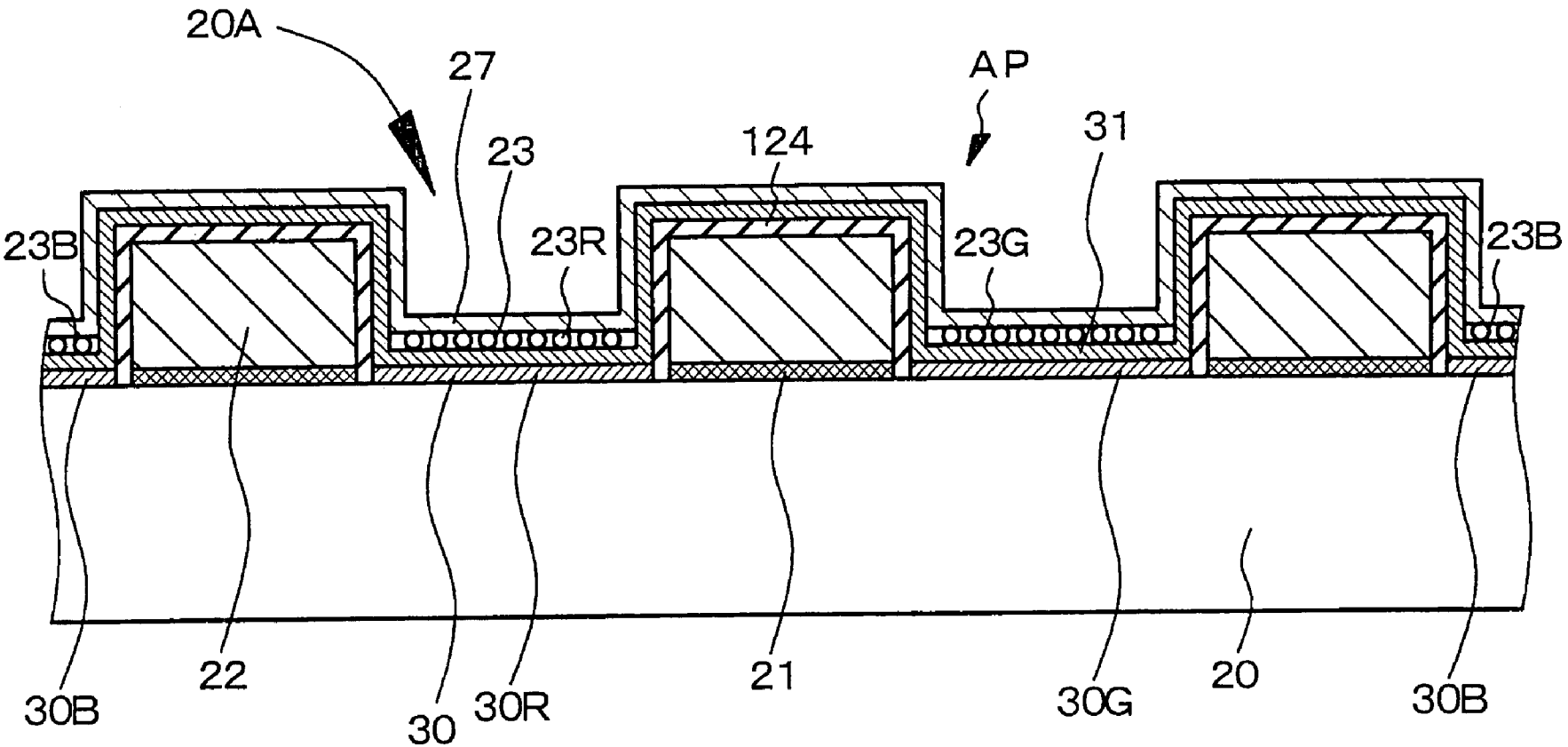
FIG. 18 is a partially enlarged, diagrammatic end view of an example of variation of the display panel (anode panel) in Example 4.

A partially enlarged, diagrammatic partial end view of an anode panel AP constituting the field emission display device in Example 4 is shown in FIG. 17 or FIG. 18.

In the field emission display device in Example 4, for protecting the fluorescent region from ions or the like generated in the field emission display device due to the operation of the field emission display device, for suppressing generation of gas from the fluorescent region, and for preventing the fluorescent region from being removed, a fluorescent protective film 27 is formed at least on the fluorescent region 23 (in Example 4, more specifically, not only on the fluorescent region 23 but also on the anode electrode 124 as an electrode). The fluorescent protective film 27 is comprised of a transparent material, specifically, aluminum nitride ($AlN_x$). The average thickness of the fluorescent protective film 27 on the fluorescent region 23 is 50 nm.

The display panel (anode panel AP) in Example 4 shown in FIG. 17 can be fabricated by the following method (see case No. "1" in (D) of Table 1).

[Step-400A]

First, the same steps as the [step-100] through [step-160] in Example 1 are carried out.

[Step-410A]

Then, the conductive material layer is patterned to remove the conductive material layer on the fluorescent region 23 so that a portion of the conductive material layer positioned on the top surface and sidewall of the partition 22 remains, thus obtaining an anode electrode 124.

[Step-420A]

Next, a fluorescent protective film 27 comprised of aluminum nitride ($AlN_x$) is formed on the entire surface by a sputtering process.

The display panel (anode panel AP) in Example 4 shown in FIG. 18 can be fabricated by the following method (see case No. "5" in (D) of Table 1).

[Step-400B]

First, the same steps as the [step-300B] through [step-330B] in Example 3 are carried out.

[Step-410B]

Next, a fluorescent protective film 27 comprised of aluminum nitride ($AlN_x$) is formed on the entire surface by a sputtering process.

Except for the above points, the display panel (anode panel) and display device (cold cathode field emission display device) in Example 4 are similar to the display panel (anode panel) and display device (cold cathode field emission display device) in Example 3, and therefore the detailed description is omitted.

Alternatively, the display panel (anode panel AP) in Example 4 can be fabricated in accordance with the order of steps shown in case No. "2", case No. "3", or case No. "4" in (D) of Table 1.

EXAMPLE 5

The display panel (anode panel) and display device (cold cathode field emission display device) in Example 5 are also variations of the display panel (anode panel) and display device (cold cathode field emission display device) in Example 3, and relates to a display panel and a display device according to the fourth embodiment of the present invention.

Figure 19:
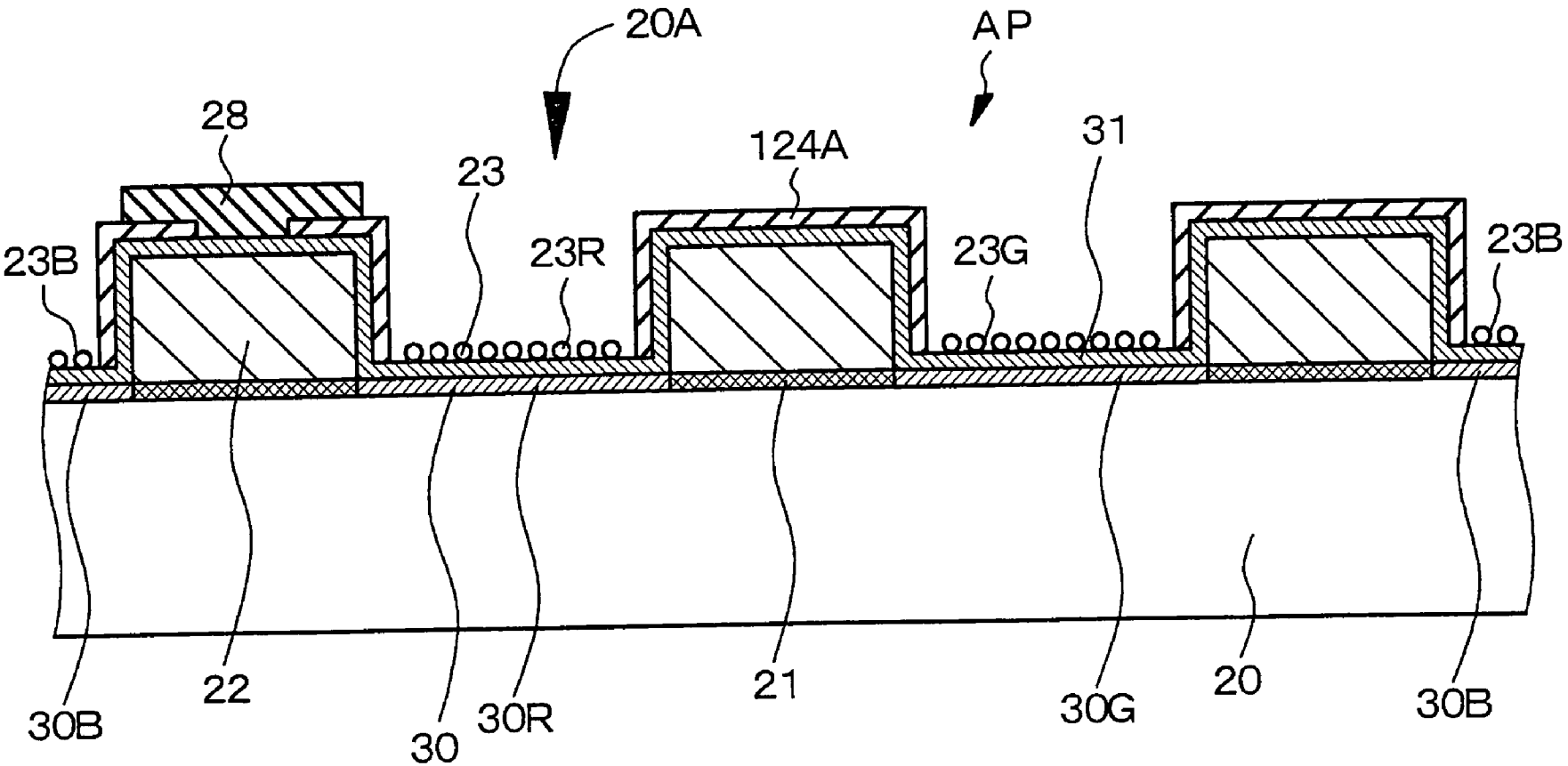
FIG. 19 is a partially enlarged, diagrammatic end view of the display panel (anode panel) in Example 5.
Figure 20:
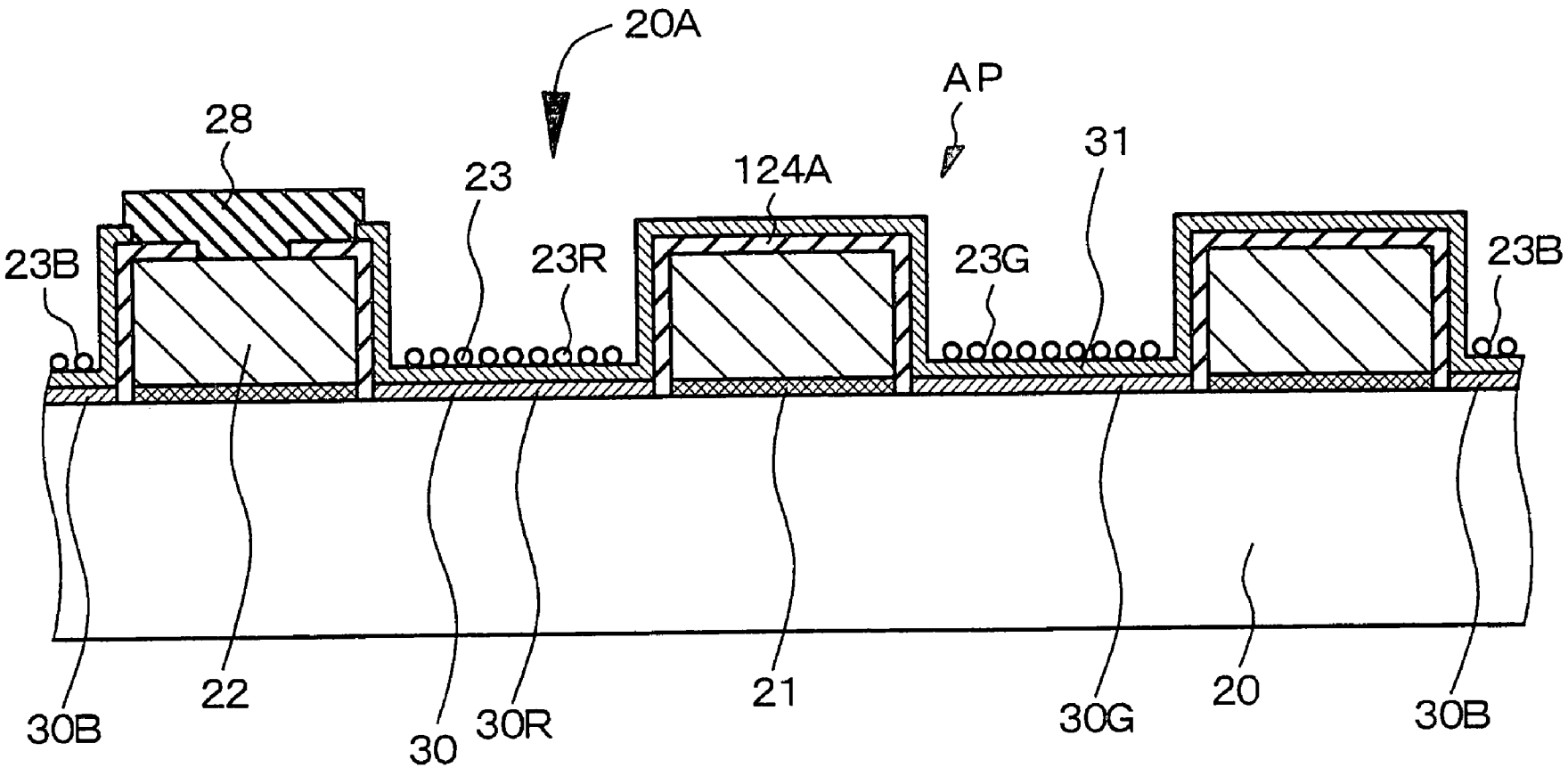
FIG. 20 is a partially enlarged, diagrammatic end view of an example of variation of the display panel (anode panel) in Example 5.
Figure 21:
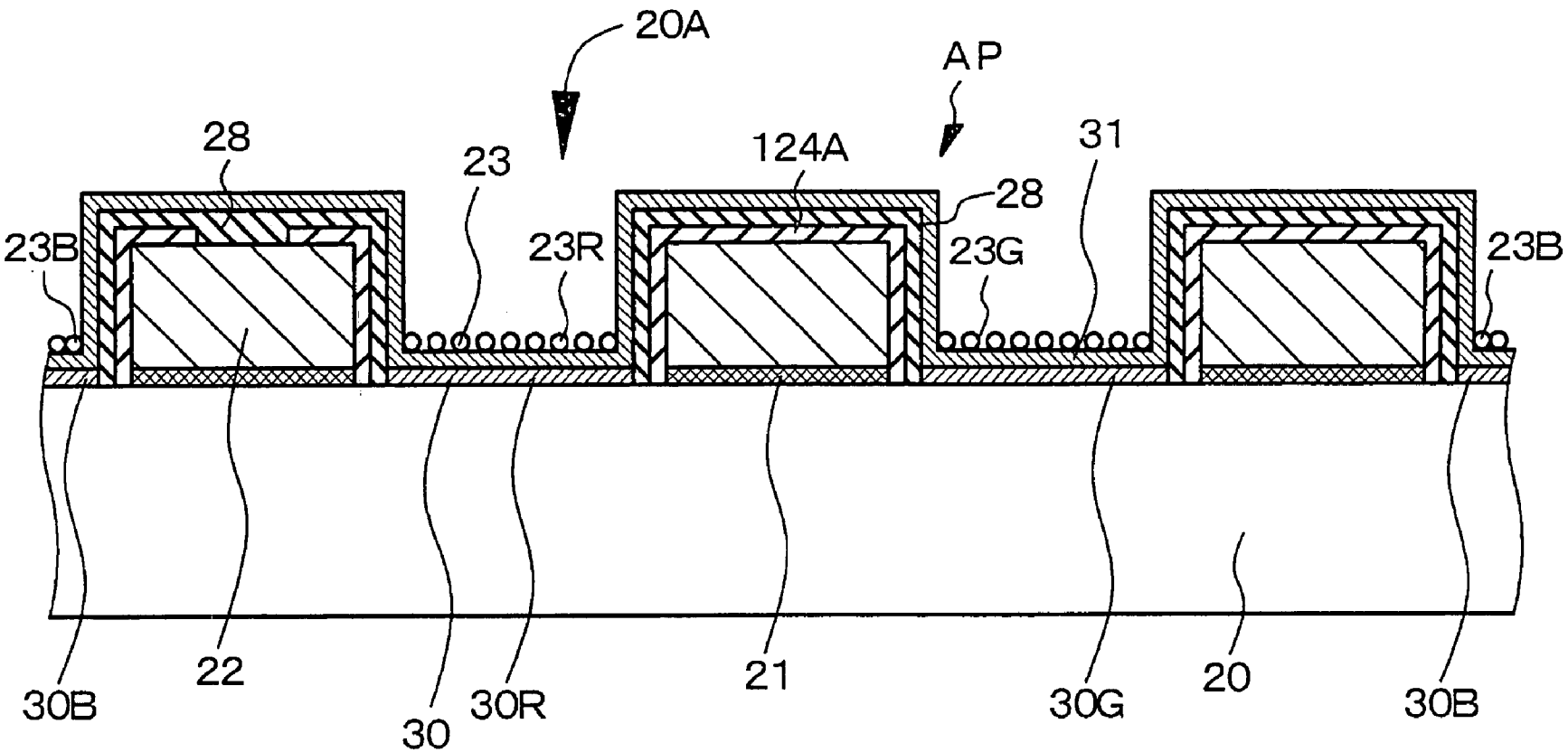
FIG. 21 is a partially enlarged, diagrammatic end view of another example of variation of the display panel (anode panel) in Example 5.

A partially enlarged, diagrammatic partial end view of an anode panel AP constituting the field emission display device in Example 5 is shown in FIG. 19, FIG. 20, or FIG. 21.

In the field emission display device in Example 5, the electrode (anode electrode) is comprised of a plurality of electrode units (anode electrode units 124A), and the anode electrode unit 124A and the anode electrode unit 124A are electrically connected to each other through a resistant layer 28. In Example 5, the number of the anode electrode units 124A is equal to the number of pixels (equal to one third of the number of subpixels), but is not limited to this.

The resistant layer 28 is comprised of silicon carbide (SiC). In Example 5, the electrode units (anode electrode units 124A) are formed on the top surface of the partition 22 and on the sidewall of the partition 22, and the boundary of the anode electrode unit 124A is positioned on the top surface of the partition 22. The resistant layer 28 is formed on the anode electrode unit 124A at least on the top surface of the partition 22 (more specifically, on the anode electrode unit 124A positioned on the top surface of the partition 22 as shown in FIG. 19 and FIG. 20, or on the anode electrode unit 124A positioned on the top surface of the partition 22 and on the sidewall of the partition 22 as shown in FIG. 21). The average thickness of the electrode units (anode electrode units 124A) comprised of molybdenum (Mo) on the top surface of the partition 22 is 0.3 μm, and the average thickness of the resistant layer 28 on the top surface of the partition 22 is 0.33 μm. The sheet resistance of the resistant layer 28 is about $4\times10^5$ Ω/□.

The display panel (anode panel AP) in Example 5 shown in FIG. 19 can be fabricated by the following method (see case No. "11" in Table 2).

[Step-500A]

First, the same steps as the [step-300A] through [step-310A] in Example 3 are carried out.

[Step-510A]

Then, a resistant layer 28 is formed on the entire surface, and then the resistant layer 28 is patterned.

The display panel (anode panel AP) in Example 5 shown in FIG. 20 can be fabricated by the following method (see case No. "36" in Table 3).

[Step-500B]

First, the same step as the [step-100] in Example 1 is carried out.

[Step-510B]

Then, a conductive material layer comprised of molybdenum (Mo) is formed by an oblique incident vacuum deposition process on the top surface and sidewall of the partition 22 formed on the substrate 20. Subsequently, a resist layer is formed on the entire surface (more specifically, on the conductive material layer comprised of molybdenum), and the resist layer is patterned in accordance with a photolithography technique. Then, the conductive material layer comprised of molybdenum is patterned by a wet etching process using the patterned resist layer as an etching mask, followed by removal of the resist layer, thus obtaining an anode electrode unit 124A.

[Step-520B]

Next, the same step as the [step-320B] in Example 3 is carried out, and then a portion of the color filter protective film 31 positioned on the top surface of the partition 22, on which a resistant layer 28 will be formed, is removed by patterning. Then, a resistant layer 28 is formed on the entire surface, and then the resistant layer 28 is patterned and then the same step as the [step-330B] is carried out.

The display panel (anode panel AP) in Example 5 shown in FIG. 21 can be fabricated by the following method (see case No. "39" in Table 3).

[Step-500C]

First, the same steps as the [step-500B] through [step-510B] are carried out.

[Step-510C]

Then, a resistant layer 28 comprised of SiC is formed by an oblique incident vacuum deposition process on the anode electrode unit 124A positioned on the top surface of the partition 22 and on the sidewall of the partition 22.

[Step-520C]

Next, the same steps as the [step-320B] through [step-330B] in Example 3 are carried out.

Except for the above points, the display panel (anode panel) and display device (cold cathode field emission display device) in Example 5 are similar to the display panel (anode panel) and display device (cold cathode field emission display device) in Example 3, and therefore the detailed description is omitted.

Alternatively, the display panel (anode panel AP) in Example 5 can be fabricated in accordance with the order of steps shown in case Nos. "2" to "30" in Table 2, or case Nos. "31" to "35", case No. "37", case No. "38", or case No. "40" in Table 3.

EXAMPLE 6

The display panel (anode panel) and display device (cold cathode field emission display device) in Example 6 are variations of the display panel (anode panel) and display device (cold cathode field emission display device) in Example 5, and relates to a display panel and a display device according to the fourth embodiment of the present invention, especially a combination of Example 5 and Example 4.

Figure 22:
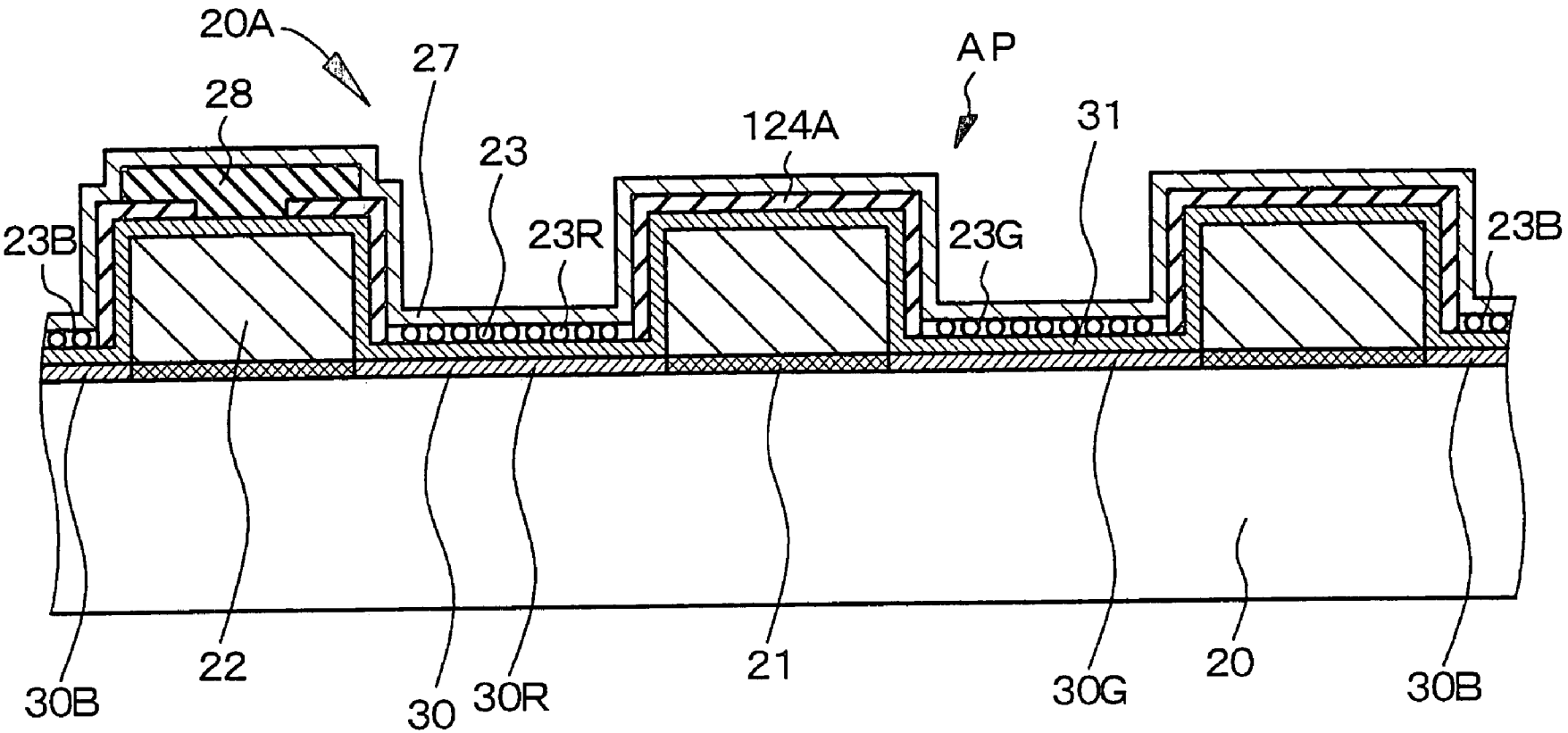
FIG. 22 is a partially enlarged, diagrammatic end view of the display panel (anode panel) in Example 6.
Figure 23:
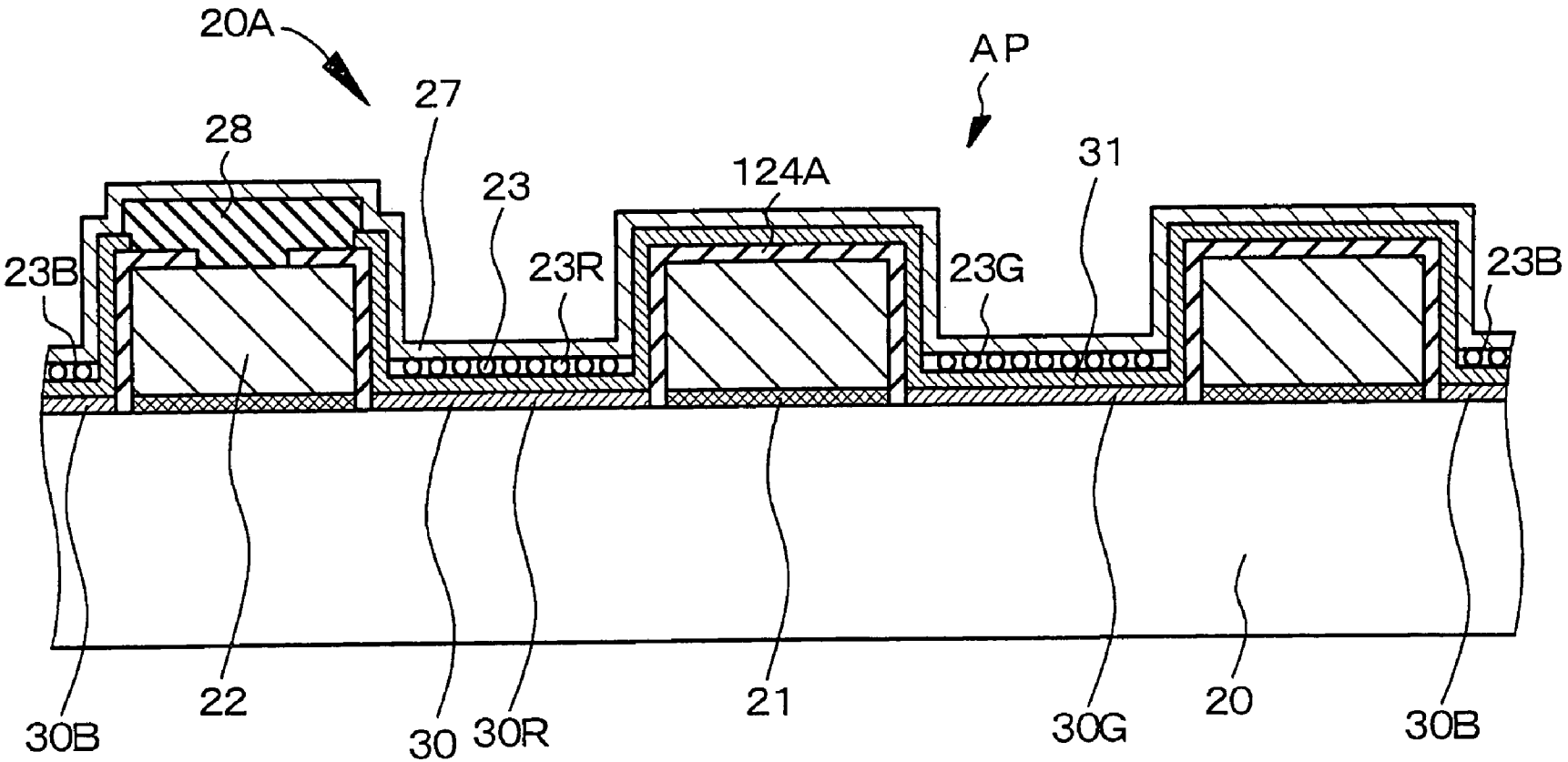
FIG. 23 is a partially enlarged, diagrammatic end view of an example of variation of the display panel (anode panel) in Example 6.
Figure 24:
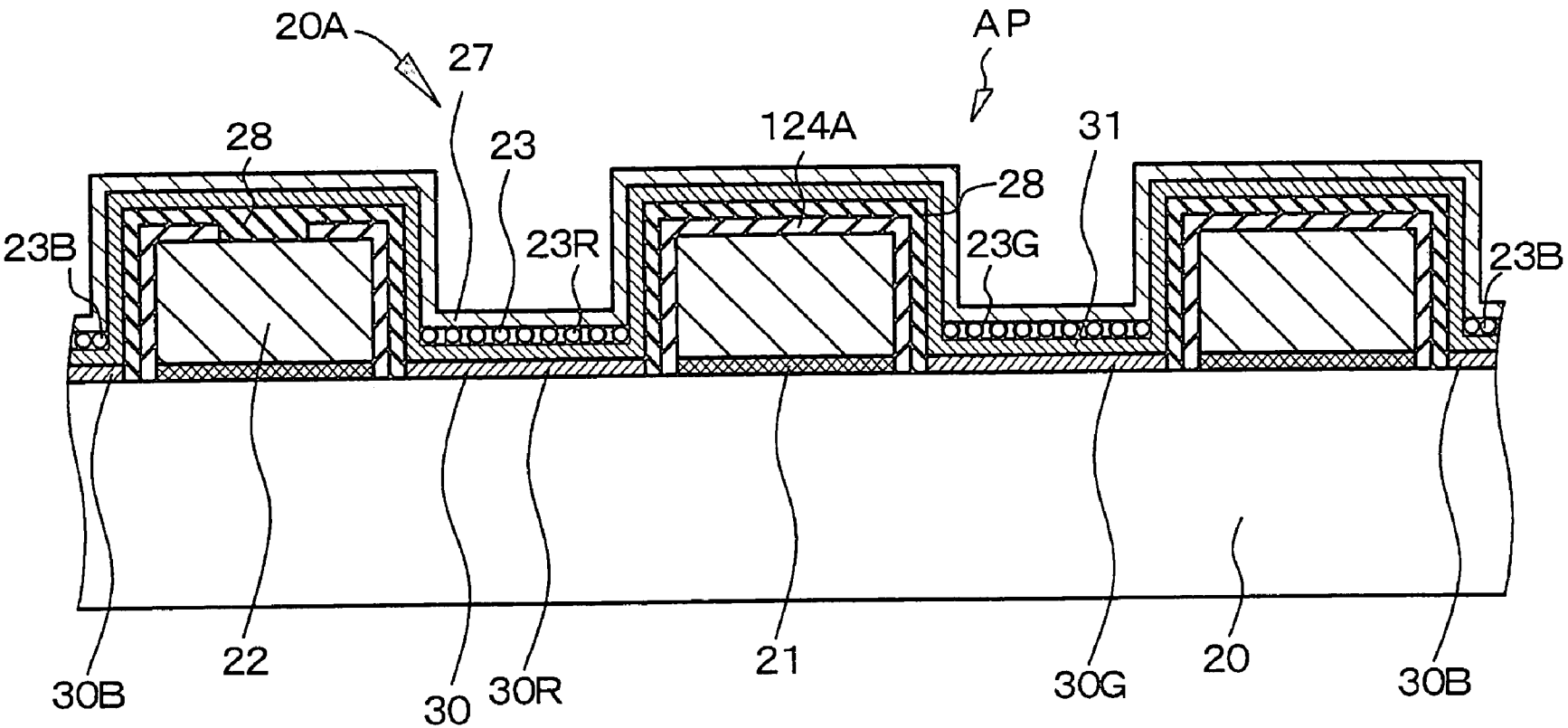
FIG. 24 is a partially enlarged, diagrammatic end view of another example of variation of the display panel (anode panel) in Example 6.

A partially enlarged, diagrammatic partial end view of an anode panel AP constituting the field emission display device in Example 6 is shown in FIG. 22, FIG. 23, or FIG. 24.

In the field emission display device in Example 6, for protecting the fluorescent region from ions or the like generated in the field emission display device due to the operation of the field emission display device, for suppressing generation of gas from the fluorescent region, and for preventing the fluorescent region from being removed, a fluorescent protective film 27 is formed at least on the fluorescent region 23 (in Example 6, more specifically, not only on the fluorescent region 23 but also on the anode electrode 124 as an electrode and the resistant layer 28). The fluorescent protective film 27 is comprised of a transparent material, specifically, aluminum nitride ($AlN_x$). The average thickness of the fluorescent protective film 27 on the fluorescent region 23 is 50 nm.

The display panel (anode panel) in Example 6 can be obtained by a method in which, subsequent to the same step as the [step-510A], subsequent to the same step as the [step-520B], or subsequent to the same step as the [step-520C] in Example 5, a fluorescent protective film 27 comprised of aluminum nitride ($AlN_x$) is formed on the entire surface by a sputtering process (see case No. "1" in Table 4, case No. "66" in Table 6, and case No. "69" in Table 6).

Except for the above points, the display panel (anode panel) and display device (cold cathode field emission display device) in Example 6 are similar to the display panel (anode panel) and display device (cold cathode field emission display device) in Example 5, and therefore the detailed description is omitted.

Alternatively, the display panel (anode panel AP) in Example 6 can be fabricated in accordance with the order of steps shown in case Nos. "2" to "30" in Table 4, case Nos. "31" to "60" in Table 5, or case Nos. "61" to "65", case No. "67", case No. "68", or case No. "70" in Table 6.

Hereinabove, the present invention is described with reference to the Examples, but the present invention is not limited to the Examples. The constructions and structures of the display panel (anode panel), cathode panel, display device (cold cathode field emission display device), and field emission element described above in the Examples are merely examples and can be appropriately changed. In addition, the fabrication processes for the anode panel, cathode panel, field emission display device, or field emission element are also merely examples and can be appropriately changed. Further, the materials used in the fabrication of the anode panel or cathode panel are merely examples and can be appropriately changed. With respect to the field emission display device, explanations are made solely taking color display as an example, but the field emission display device may be of monochrome display.

In the display panel (anode panel AP) in Example 5 or Example 6, the resistant layer 28 may be formed on the partition 22 between the anode electrode unit 124A and the anode electrode unit 124A (i.e., between the partition 22 and the anode electrode unit 124A).

With respect to the field emission element, explanations are made solely on the mode in which one electron emitting portion corresponds to one opening portion, but, according to the structure of the field emission element, a mode in which a plurality of electron emitting portions correspond to one opening portion or a mode in which one electron emitting portion corresponds to a plurality of opening portions can be employed. Alternatively, there can be employed a mode in which a plurality of first opening portions are formed in the gate electrode, and a plurality of second opening portions in communication with the first opening portions are formed in the insulating layer to form one or a plurality of electron emitting portions.

Figure 25:
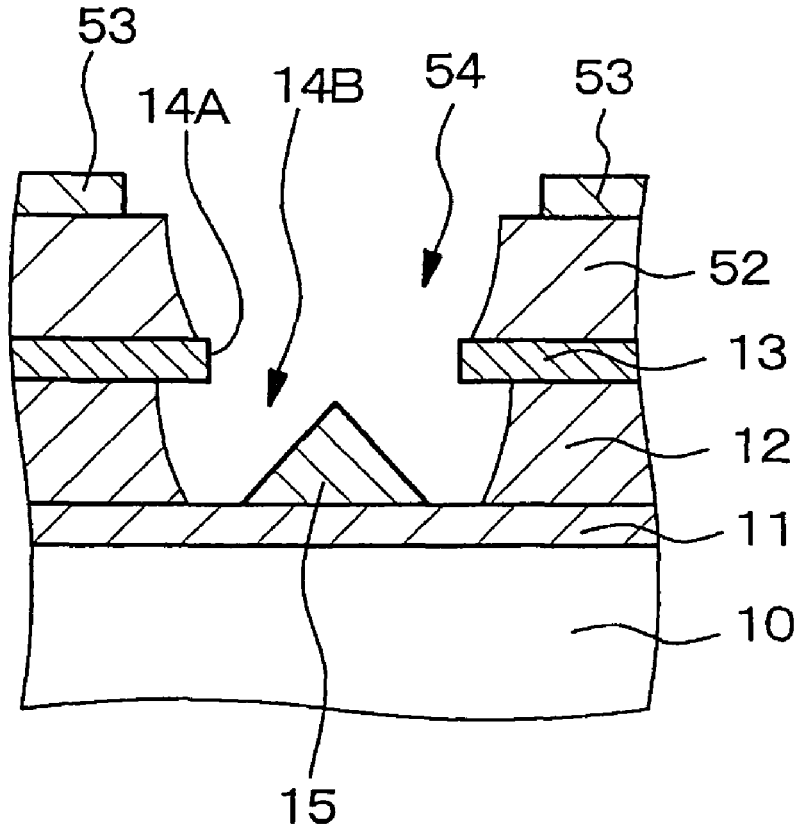
FIG. 25 is a diagrammatic, partial end view of a Spindt-type cold cathode field emission element having a focusing electrode.

In the field emission element, an interlayer dielectric layer 52 may be formed on the gate electrode 13 and the insulating layer 12, and a focusing electrode 53 may be formed on the interlayer dielectric layer 52. A diagrammatic, partial end view of a field emission element having the above structure is shown in FIG. 25. In the interlayer dielectric layer 52, a third opening portion 54 in communication with the first opening portion 14A is formed. The focusing electrode 53 may be formed by a method in which, for example, in the [step-A2], the stripe-shaped gate electrode 13 is formed on the insulating layer 12, and then the interlayer dielectric layer 52 is formed, and subsequently the patterned focusing electrode 53 is formed on the interlayer dielectric layer 52, and then the third opening portion 54 is formed in the focusing electrode 53 and the interlayer dielectric layer 52, and further the first opening portion 14A is formed in the gate electrode 13. By selecting the patterning of the focusing electrode, the focusing electrode can be of a type such that the focusing electrode is comprised of a group of focusing electrode units corresponding to one or a plurality of electron emitting portions or one or a plurality of pixels, or a type such that the effective region is covered with one sheet-form conductive material. In FIG. 25, a Spindt-type field emission element is shown, but, needless to say, the field emission element can be of another type.

The gate electrode can be of a type such that the effective region is covered with one sheet-form conductive material (having an opening portion). In this case, a positive voltage is applied to the gate electrode. A switching element comprised of, for example, a TFT is formed between the cathode electrode and the cathode electrode control circuit constituting each pixel, and the voltage applied to the electron emitting portion constituting each pixel is adjusted by the operation of the switching element to control light emission of the pixel.

The cathode electrode can be of a type such that the effective region is covered with one sheet-form conductive material. In this case, a voltage is applied to the cathode electrode. A switching element comprised of, for example, a TFT is formed between the electron emitting portion and the gate electrode control circuit constituting each pixel, and the voltage applied to the gate electrode constituting each pixel is adjusted by the operation of the switching element to control light emission of the pixel.

Figure 26:
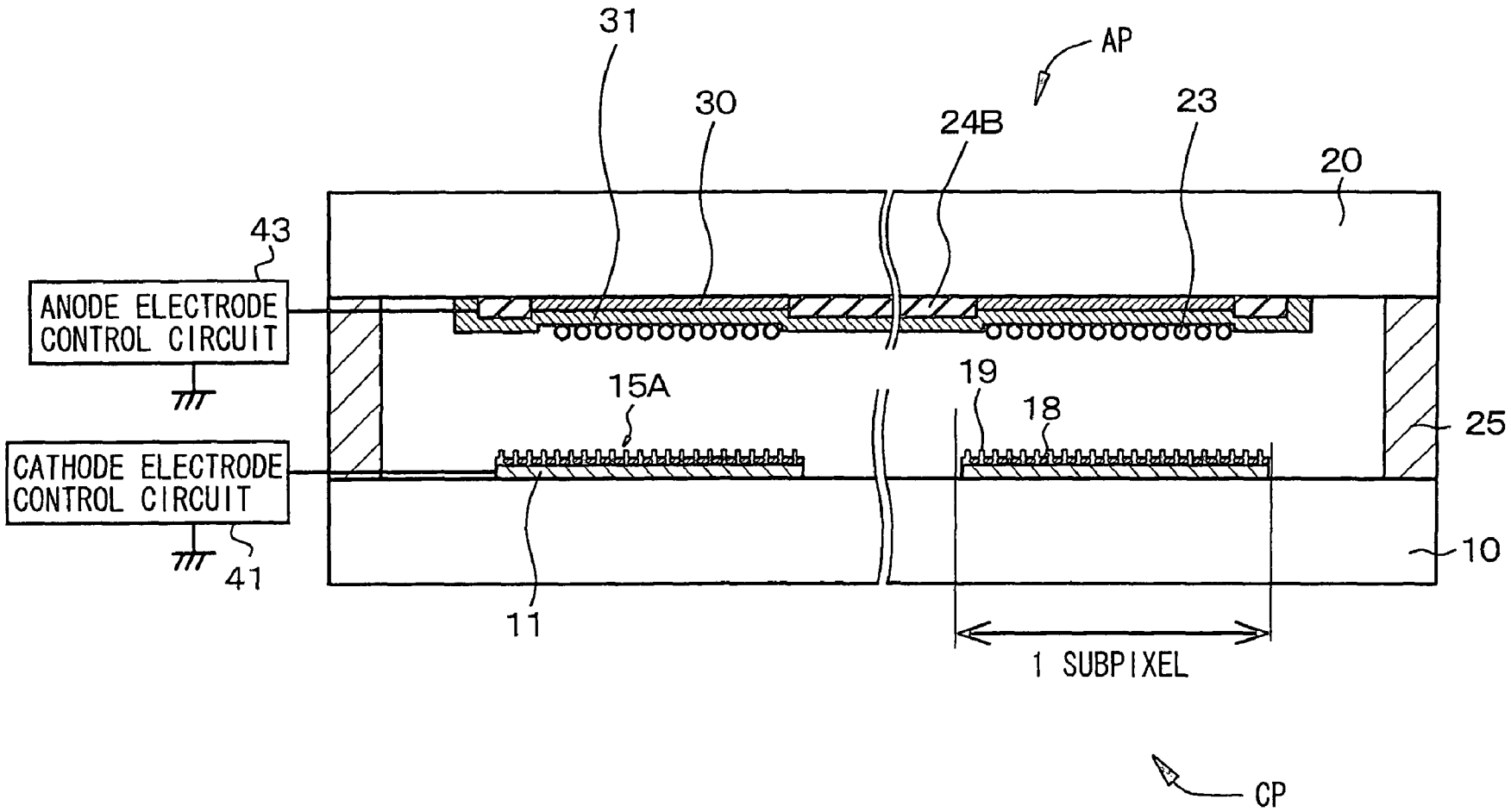
FIG. 26 is a diagrammatic, partially cross-sectional view of a so-called two-electrode type cold cathode field emission display device.

The cold cathode field emission display device is not limited to one of a so-called three-electrode type comprising a cathode electrode, a gate electrode, and an anode electrode described above in the Examples, but can be of a so-called two-electrode type comprising a cathode electrode and an anode electrode. A diagrammatic, partially cross-sectional view of an example of the field emission display device having the structure of a two-electrode type, to which the construction of the anode panel described above in Example 5 is applied, is shown in FIG. 26. In FIG. 26, a black matrix and the like are not shown. A partition is not formed, but it may be formed. The field emission element in the field emission display device comprises a cathode electrode 11 formed on a support 10, and an electron emitting portion 15A comprised of carbon nanotube 19 formed on the cathode electrode 11. The carbon nanotube 19 is fixed to the surface of the cathode electrode 11 by a matrix 18. The structure of the electron emitting portion is not limited to the carbon nanotube.

The anode electrode constituting the anode panel AP is comprised of a plurality of stripe-shaped anode electrode units 24B. The adjacent stripe-shaped anode electrode units 24B are not electrically connected to each other. In addition, in the stripe-shaped anode electrode unit 24B, the conductive material layer constituting the anode electrode unit 24B is not formed on a portion of the substrate 20 on which the fluorescent region 23 is formed. In other words, in the stripe-shaped anode electrode unit 24B, the fluorescent region 23 in an island-like form is formed. The projected image of the stripe-shaped cathode electrode 11 and the projected image of the stripe-shaped anode electrode unit 24B are perpendicular to each other. Specifically, the cathode electrode 11 extends in the direction perpendicular to the plane of the drawing, and the stripe-shaped anode electrode unit 24B extends in the direction parallel with the plane of the drawing. In the cathode panel CP in the field emission display device, a number of electron emitting regions comprised of a plurality of field emission elements mentioned above are formed in a two-dimensional matrix form in the effective region.

In the field emission display device, electrons are emitted from the electron emitting portion 15A in accordance with a quantum tunnel effect due to the electric field formed by the anode electrode unit 24B, and the electrons are attracted to the anode panel AP, and collide with the fluorescent region 23. That is, the field emission display device is driven by a so-called simple matrix mode in which electrons are emitted from the electron emitting portion 15A positioned in the region where the projected image of the anode electrode unit 24B and the projected image of the cathode electrode 11 overlap (anode electrode/cathode electrode overlap region). Specifically, a relatively negative voltage is applied to the cathode electrode 11 from the cathode electrode control circuit 41, and a relatively positive voltage is applied to the anode electrode unit 24B from the anode electrode control circuit 43. As a result, electrons are selectively emitted into a vacuum space from the carbon nanotube 19 constituting the electron emitting portion 15A positioned in the anode electrode/cathode electrode overlap region of the cathode electrode 11 selected as a column and the anode electrode unit 24B selected as a row (or the cathode electrode 11 selected as a row and the anode electrode unit 24B selected as a column), and the electrons are attracted to the anode panel AP and collide with the fluorescent region 23 constituting the anode panel AP, so that the fluorescent region 23 is excited to emit light.

The stripe-shaped anode electrode unit 24B may be divided into further smaller anode electrode units wherein the anode electrode units are connected to one another through resistant layers. Specifically, the display panel (anode panel AP) described above in Example 6 can be applied. A structure of a so-called two-electrode type can be applied to the cold cathode field emission display devices described above in Examples 1 to 4.

In the cold cathode field emission display device in the present invention, the field emission element can be a field emission element of any type, and the field emission element can be, for example, as described above in the Examples, not only:

(1) a Spindt-type field emission element in which the cone electron emitting portion is formed on the cathode electrode positioned on the bottom of the opening portion, but also:

(2) a flat-type field emission element in which the substantially plane-form electron emitting portion is formed on the cathode electrode positioned on the bottom of the opening portion;

(3) a crown-type field emission element in which the crown-form electron emitting portion is formed on the cathode electrode positioned on the bottom of the opening portion and electrons are emitted from the crown-form portion of the electron emitting portion;

(4) a plane-type field emission element in which electrons are emitted from the surface of the flat cathode electrode;

(5) a crater-type field emission element in which electrons are emitted from a number of protruding portions of the uneven surface of the cathode electrode; or (6) an edge-type field emission element in which electrons are emitted from the edge portion of the cathode electrode.

In addition to the field emission elements of the above-mentioned various types, an element called a surface conductive electron emitting element is known, and can be applied to the cold cathode field emission display device in the present invention. In the surface conductive electron emitting element, thin films each having a very small area comprised of a material, such as tin oxide ($SnO_2$), gold (Au), indium oxide ($In_2O_3$)/tin oxide ($SnO_2$), carbon, or palladium oxide (PdO), are formed in a matrix form on a substrate comprised of, e.g., glass, and each thin film is comprised of two pieces of thin film wherein wiring in the row direction is connected to one piece of thin film and wiring in the column direction is connected to another piece of thin film. A gap of several nm is formed between one piece of thin film and another piece of thin film. In the thin film selected by the wiring in the row direction and the wiring in the column direction, electrons are emitted from the thin film through the gap.

In the Spindt-type field emission element, examples of materials constituting the electron emitting portion include molybdenum mentioned above in the Examples, and at least one material selected from the group consisting of tungsten, a tungsten alloy, a molybdenum alloy, titanium, a titanium alloy, niobium, a niobium alloy, tantalum, a tantalum alloy, chromium, a chromium alloy, and silicon containing an impurity (polysilicon or amorphous silicon). The electron emitting portion in the Spindt-type field emission element can be formed by a vacuum deposition process, or, for example, a sputtering process or a CVD process.

In the flat-type field emission element, it is preferred that the electron emitting portion is comprised of a material having a work function Φ smaller than that of the material constituting the cathode electrode, and the material may be selected depending on the work function of the material constituting the cathode electrode, the potential difference between the gate electrode and the cathode electrode, the emission current density required, or the like. Representative examples of materials constituting the cathode electrode in the field emission element include tungsten (Φ=4.55 eV), niobium (Φ=4.02 to 4.87 eV), molybdenum (Φ=4.53 to 4.95 eV), aluminum (Φ=4.28 eV), copper (Φ=4.6 eV), tantalum (Φ=4.3 eV), chromium (Φ=4.5 eV), and silicon (Φ=4.9 eV). It is preferred that the electron emitting portion has a work function Φ smaller than that of the above material, and generally has a work function of 3 eV or less. Examples of such materials include carbon (Φ<1 eV), cesium (Φ=2.14 eV), $LaB_6$ (Φ=2.66 to 2.76 eV), BaO (Φ=1.6 to 2.7 eV), SrO (Φ=1.25 to 1.6 eV), $Y_2O_3$ (Φ=2.0 eV), CaO (Φ=1.6 to 1.86 eV), BaS (Φ=2.05 eV), TiN (Φ=2.92 eV), and ZrN (Φ=2.92 eV). It is further preferred that the electron emitting portion is comprised of a material having a work function Φ of 2 eV or less. The material constituting the electron emitting portion does not necessarily have conduction properties.

In the flat-type field emission element, the material constituting the electron emitting portion may be appropriately selected from materials having a secondary electron gain δ larger than the secondary electron gain δ of the conductive material constituting the cathode electrode. Specifically, the material constituting the electron emitting portion can be appropriately selected from metals, such as silver (Ag), aluminum (Al), gold (Au), cobalt (Co), copper (Cu), molybdenum (Mo), niobium (Nb), nickel (Ni), platinum (Pt), tantalum (Ta), tungsten (W), and zirconium (Zr); semiconductors, such as silicon (Si) and germanium (Ge); inorganic simple substances, such as carbon and diamond; and compounds, such as aluminum oxide ($Al_2O_3$), barium oxide (BaO), beryllium oxide (BeO), calcium oxide (CaO), magnesium oxide (MgO), tin oxide ($SnO_2$), barium fluoride ($BaF_2$), and calcium fluoride ($CaF_2$). The material constituting the electron emitting portion does not necessarily have conduction properties.

In the flat-type field emission element, especially preferred examples of materials constituting the electron emitting portion include carbon, more specifically, diamond, graphite, a carbon nanotube structure, ZnO whisker, MgO whisker, $SnO_2$ whisker, MnO whisker, $Y_2O_3$ whisker, NiO whisker, ITO whisker, $In_2O_3$ whisker, and $Al_2O_3$ whisker. When the electron emitting portion is comprised of the above material, an emission current density required for the cold cathode field emission display device can be obtained at an electric field strength of $5\times10^7$ V/m or less. Diamond is an electrically resistant material, and hence can make uniform the emission current obtained from the electron emitting portions, so that dispersion of the luminance in the cold cathode field emission display device can be suppressed. Further, these materials have extremely high resistance with respect to the sputtering action of ions of the residual gas in the cold cathode field emission display device, making it possible to prolong the life of the field emission element.

Specific examples of carbon nanotube structures include carbon nanotube and/or graphite nanofiber. More specifically, the electron emitting portion may be comprised of carbon nanotube, graphite nanofiber, or a mixture of carbon nanotube and graphite nanofiber. The carbon nanotube or graphite nanofiber may be powdery macroscopically or in the form of a thin film, or the carbon nanotube structure may have a cone form if desired. The carbon nanotube or graphite nanofiber can be produced or formed by a known arc discharge method, a PVD process, such as a laser abrasion process, or a CVD process, such as a plasma CVD process, a laser CVD process, a thermal CVD process, a vapor synthesis process, or a vapor deposition process.

The flat-type field emission element can also be fabricated by a method in which a dispersion of a carbon nanotube structure or the above whisker (hereinafter, collectively referred to simply as "carbon nanotube structure or the like") in a binder material is, for example, applied to a desired region of the cathode electrode, followed by burning or curing of the binder material (more specifically, a method in which a dispersion of a carbon nanotube structure or the like in an organic binder material, such as an epoxy resin or an acrylic resin, or an inorganic binder material, such as water-glass, is, for example, applied to a desired region of the cathode electrode, and then the solvent is removed, followed by burning or curing of the binder material). This method is referred to as "the first method for forming a carbon nanotube structure or the like". As an example of the application method, there can be mentioned a screen printing process.

Alternatively, the flat-type field emission element can be fabricated by a method in which a metal compound solution having dispersed therein a carbon nanotube structure or the like is applied onto the cathode electrode, and then the metal compound is burned to fix the carbon nanotube structure or the like to the surface of the cathode electrode by a matrix comprising metal atoms constituting the metal compound. This method is referred to as "the second method for forming a carbon nanotube structure or the like". The matrix is preferably comprised of a metal oxide having conduction properties, more specifically, preferably comprised of tin oxide, indium oxide, indium tin oxide, zinc oxide, antimony oxide, or antimony tin oxide. After the burning, a state such that part of each carbon nanotube structure or the like is embedded in the matrix can be obtained, or a state such that the whole of each carbon nanotube structure or the like is embedded in the matrix can be obtained. It is desired that the volume resistivity of the matrix is $1\times10^{-9}$ to $5\times10^{-6}$ Ω m.

Examples of metal compounds constituting the metal compound solution include organometal compounds, organic acid metal compounds, and metal salts (e.g., chlorides, nitrates, and acetates). Examples of metal compound solutions comprised of an organic acid metal compound include, specifically, solutions obtained by dissolving an organotin compound, an organoindium compound, an organozinc compound, or an organoantimony compound in an acid (e.g., hydrochlorid acid, nitric acid, or sulfuric acid) and diluting the resultant solution with an organic solvent (e.g., toluene, butyl acetate, or isopropyl alcohol). Examples of metal compound solutions comprised of an organometal compound include, specifically, solutions obtained by dissolving an organotin compound, an organoindium compound, an organozinc compound, or an organoantimony compound in an organic solvent (e.g., toluene, butyl acetate, or isopropyl alcohol). A preferred composition comprises 100 parts by weight of the metal compound solution, 0.001 to 20 parts by weight of a carbon nanotube structure or the like, and 0.1 to 10 parts by weight of the metal compound. The metal compound solution may contain a dispersant or a surfactant. For increasing the thickness of the matrix, an additive, such as carbon black, may be added to the metal compound solution. If desired, instead of the organic solvent, water can be used as a solvent.

Examples of methods for applying the metal compound solution having dispersed therein a carbon nanotube structure or the like onto the cathode electrode include a spraying process, a spin coating process, a dipping process, a die quarter process, and a screen printing process, and, of these, a spraying process is preferably employed from the viewpoint of easiness of the application.

The metal compound solution having dispersed therein a carbon nanotube structure or the like is applied onto the cathode electrode, and then the metal compound solution is dried to form a metal compound layer, and subsequently the unnecessary portion of the metal compound layer on the cathode electrode is removed, and then the metal compound may be burned, or the metal compound is burned and then the unnecessary portion on the cathode electrode may be removed, or the metal compound solution may be applied only to a desired region of the cathode electrode.

The burning temperature for the metal compound may be, for example, a temperature at which a metal salt is oxidized to form a metal oxide having conduction properties, or a temperature at which an organometal compound or an organic acid metal compound decomposes to form a matrix (e.g., a metal oxide having conduction properties) comprising metal atoms constituting the organometal compound or organic acid metal compound, and, preferably, for example, 300° C. or higher. The upper limit of the burning temperature may be a temperature at which the constituents of the field emission element or cathode panel suffer no thermal damage and the like.

In the first method and second method for forming a carbon nanotube structure or the like, it is preferred that, after the formation of the electron emitting portion, a certain activation treatment (cleaning treatment) for the surface of the electron emitting portion is conducted from the viewpoint of further improving the electron emission efficiency of the electron emitting portion. Examples of such treatments include plasma treatments in an atmosphere of hydrogen gas, ammonia gas, helium gas, argon gas, neon gas, methane gas, ethylene gas, acetylene gas, nitrogen gas, or the like.

In the first method and second method for forming a carbon nanotube structure or the like, the electron emitting portion may be formed on the surface of a portion of the cathode electrode positioned on the bottom of the opening portion, and may be formed so that the electron emitting portion extends from a portion of the cathode electrode positioned on the bottom of the opening portion to a portion of the cathode electrode other than the portion on the bottom of the opening portion and is present on the surface thereof. The electron emitting portion may be formed either entirely or partially on the surface of a portion of the cathode electrode positioned on the bottom of the opening portion.

What is claimed is:

1. A display panel including a color filter, a color filter protective film, a phosphor layer, and an anode electrode formed in that order over a substrate in a plurality of fluorescent regions, and including a plurality of electron sources that emit electrons so as to penetrate respective anode electrodes and collide with respective fluorescent regions to allow the fluorescent regions to emit light, wherein the color filter protective layer protects the color filter from being oxidized, wherein a light-absorbing black matrix is formed so as to separate adjacent color filters by said black matrix; and wherein the color filter protective film is comprised of at least one material selected from the group consisting of aluminum nitride, chromium nitride, chromium oxide, silicon nitride, and silicon oxide nitride; and further wherein partitions are formed over the substrate in regions between the color filters and the color filter protective film is formed over the color filters and over the partitions to thereby seal and protect the color filters, the fluorescent regions being formed directly on portions of the color filter protective film at locations corresponding to the color filters, the color filter protective film being the only layer between the color filters and the fluorescent regions.

2. The display panel according to claim 1, wherein a fluorescent protective insulating film layer is formed on the fluorescent region and over the black matrix in a region between fluorescent regions wherein said black matrix is formed, and wherein the color filter protective layer and the fluorescent protective insulating film layer are both comprised of the same material.

3. The display panel according to claim 2, wherein said same material is aluminum nitride ($AlN_x$).

4. The display panel according to claim 2, wherein the anode electrode includes a plurality of separated anode electrode units; and wherein the anode electrode units are electrically connected to each other through a resistant layer formed over the color filter protective film in a region corresponding to a region wherein said black matrix is formed, the resistant layer having a different material composition than the material composition of the anode electrode units.

5. The display panel according to claim 4, wherein said same material is aluminum nitride ($AlN_x$).

6. The display panel according to claim 1, wherein said color filter protective layer is formed on the color filters and over the black matrix in a region between color filters wherein said black matrix is formed.

7. The display panel according to claim 1, further comprising partition elements formed over the black matrix and comprised of a different composition than the black matrix, the partitions preventing or reducing the occurrence of optical cross-talk.

8. A display panel including a color filter, a color filter protective film, a phosphor layer, and an anode electrode formed in that order over a substrate in a plurality of fluorescent regions, and an electron source such that electrons emitted from the electron source penetrate the anode electrode and collide with the respective fluorescent regions to allow the fluorescent regions to emit light, wherein a light-absorbing black matrix is formed so as to separate adjacent color filters by said black matrix, wherein the anode electrode includes a plurality of separated anode electrode units;

wherein the anode electrode units are electrically connected to each other through a resistant layer formed over the color filter protective film in a region corresponding to a region wherein said black matrix is formed, the resistant layer having a different material composition than the material composition of the anode electrode units;

wherein the color filter protective layer protects the color filter from being oxidized; and wherein the color filter protective film is comprised of at least one material selected from the group consisting of aluminum nitride, chromium nitride, chromium oxide, silicon nitride, and silicon oxide nitride; and further wherein partitions are formed over the substrate in regions between the color filters and the color filter protective film is formed over the color filters and over the partitions to thereby seal and protect the color filters, the fluorescent regions being formed directly on portions of the color filter protective film at locations corresponding to the color filters, the color filter protective film being the only layer between the color filters and the fluorescent regions.

9. The display panel according to claim 8, wherein said resistant layer is comprised of silicon carbide (SiC).

10. A display panel including a fluorescent region, an anode electrode, and an electron source, such that electrons emitted from the electron source collide with the fluorescent region to allow the fluorescent region to emit light, wherein a light-absorbing black matrix is formed so as to separate adjacent color filters by said black matrix, wherein the anode electrode is formed over a portion of a substrate over which the fluorescent region is not formed corresponding to a region wherein said black matrix is formed, and is not formed over a portion of the substrate over which the fluorescent region is formed;

a color filter and a color filter protective film are formed in this order between the substrate and the fluorescent region; and wherein the color filter protective film is comprised of at least one material selected from the group consisting of aluminum nitride, chromium nitride, chromium oxide, silicon nitride, and silicon oxide nitride; and further wherein partitions are formed over the substrate in regions between the color filters and the color filter protective film is formed over the color filters and over the partitions to thereby seal and protect the color filters, the fluorescent regions being formed directly on portions of the color filter protective film at locations corresponding to the color filters, the color filter protective film being the only layer between the color filters and the fluorescent regions.

11. The display panel as cited in claim 10, wherein a fluorescent protective insulating film layer is formed on the fluorescent region and over the black matrix in a region between fluorescent regions wherein said black matrix is formed.

12. The display panel as cited in claim 11, wherein the fluorescent protective insulating film layer is comprised of at least one material selected from the group consisting of aluminum nitride, indium tin oxide, chromium oxide, and chromium nitride.

13. The display panel as cited in claim 10, wherein the anode electrode includes a plurality of separated anode electrode units; and the anode electrode units are electrically connected to each other through a resistant layer formed over the color filter protective film in a region corresponding to where the black matrix is formed, the resistant layer having a different material composition than the material composition of the anode electrode units.

14. The display panel according to claim 13, wherein said resistant layer is comprised of silicon carbide (SiC).

15. The display panel according to claim 10, wherein a fluorescent protective insulating film layer is formed on the fluorescent region and over the black matrix in a region between fluorescent regions wherein said black matrix is formed, and wherein the color filter protective layer and the fluorescent protective insulating film layer are both comprised of the same material.

16. The display panel according to claim 15, wherein said same material is aluminum nitride ($AlN_x$).

17. The display panel according to claim 15, wherein the anode electrode includes a plurality of separated anode electrode units; and wherein the anode electrode units are electrically connected to each other through a resistant layer formed over the color filter protective film in a region corresponding to a region wherein said black matrix is formed, the resistant layer having a different material composition than the material composition of the anode electrode units.

18. The display panel according to claim 17, wherein said same material is aluminum nitride ($AlN_x$).

19. The display panel according to claim 10, wherein said color filter protective layer is formed on the color filters and over the black matrix in a region between color filters wherein said black matrix is formed.

20. The display panel according to claim 10, further comprising partition elements formed over the black matrix and comprised of a different composition than the black matrix, the partitions preventing or reducing the occurrence of optical cross-talk.

21. A display device comprising:

(A) a cathode panel having a plurality of electron sources formed over a support; and (B) a display panel having a color filter, a color filter protective film, a phosphor layer, and an anode electrode formed in that order over a substrate in a plurality of fluorescent regions, wherein a light-absorbing black matrix is formed so as to separate adjacent color filters by said black matrix, wherein electrons emitted from the electron sources penetrate respective anode electrodes and collide with respective fluorescent regions to allow the fluorescent regions to emit light, wherein the cathode panel and the display panel are joined together at their circumferential portions through a vacuum region, wherein the color filter protective layer protects the color filter from being oxidized; and wherein the color filter protective film is comprised of at least one material selected from the group consisting of aluminum nitride, chromium nitride, chromium oxide, silicon nitride, and silicon oxide nitride; and further wherein partitions are formed over the substrate in regions between the color filters and the color filter protective film is formed over the color filters and over the partitions to thereby seal and protect the color filters, the fluorescent regions being formed directly on portions of the color filter protective film at locations corresponding to the color filters, the color filter protective film being the only layer between the color filters and the fluorescent regions.

22. The display panel according to claim 21, wherein said color filter protective layer is formed on the color filters and over the black matrix in a region between color filters wherein said black matrix is formed.

23. The display panel according to claim 21, further comprising partition elements formed over the black matrix and comprised of a different composition than the black matrix, the partitions preventing or reducing the occurrence of optical cross-talk.

24. A display device comprising:

(A) a cathode panel having an electron source formed over a support; and (B) a display panel having a fluorescent region, and an anode electrode formed over the fluorescent region, wherein a light-absorbing black matrix is formed so as to separate adjacent color filters by said black matrix, wherein electrons emitted from the electron source penetrate the anode electrode and collide with the fluorescent region to allow the fluorescent region to emit light, wherein the cathode panel and the display panel are joined together at their circumferential portions through a vacuum region, wherein a color filter and a color filter protective film are formed in this order between the substrate and the fluorescent region, and wherein the anode electrode is comprised of a plurality of separated anode electrode units, and the anode electrode units are connected to each other through a resistant layer formed over the color filter protective film in a region corresponding to a region wherein said black matrix is formed, the resistant layer having a different material composition than the material composition of the anode electrode units; and further wherein partitions are formed over the substrate in regions between the color filters and the color filter protective film is formed over the color filters and over the partitions to thereby seal and protect the color filters, the fluorescent regions being formed directly on portions of the color filter protective film at locations corresponding to the color filters, the color filter protective film being the only layer between the color filters and the fluorescent regions.

25. A display device comprising:

(A) a cathode panel comprising an electron source formed over a support; and (B) a display panel comprising a fluorescent region and an anode electrode formed in that order over a substrate, wherein electrons emitted from the electron source collide with the fluorescent region to allow the fluorescent region to emit light, wherein a light-absorbing black matrix is formed so as to separate adjacent color filters by said black matrix, and wherein a color filter and a color filter protective film are formed in this order between the substrate and the fluorescent region, and further wherein the color filter protective layer protects the color filter from being oxidized; and wherein the color filter protective film is comprised of at least one material selected from the group consisting of aluminum nitride, chromium nitride, chromium oxide, silicon nitride, and silicon oxide nitride; and further wherein partitions are formed over the substrate in regions between the color filters and the color filter protective film is formed over the color filters and over the partitions to thereby seal and protect the color filters, the fluorescent regions being formed directly on portions of the color filter protective film at locations corresponding to the color filters, the color filter protective film being the only layer between the color filters and the fluorescent regions.

26. The display panel as cited in claim 25, wherein a fluorescent protective insulating film layer is formed on the fluorescent region and over the black matrix in a region between fluorescent regions wherein said black matrix is formed.

27. The display panel as cited in claim 26, wherein the fluorescent protective insulating film layer is comprised of at least one material selected from the group consisting of aluminum nitride, indium tin oxide, chromium oxide, and chromium nitride.

28. The display panel as cited in claim 25, wherein the anode electrode includes a plurality of separated anode electrode units; and the anode electrode units are electrically connected to each other through a resistant layer formed over the color filter protective film in a region corresponding to a region wherein said black matrix is formed, the resistant layer having a different material composition than the material composition of the anode electrode units.

29. The display panel according to claim 25, wherein said color filter protective layer is formed on the color filters and over the black matrix in a region between color filters wherein said black matrix is formed.

30. The display panel according to claim 25, further comprising partition elements formed over the black matrix and comprised of a different composition than the black matrix, the partitions preventing or reducing the occurrence of optical cross-talk.

* * * * *